US006032016A

United States Patent [19]

Morigami et al.

[11] Patent Number: 6,032,016

[45] Date of Patent: Feb. 29, 2000

[54] FIXING APPARATUS INCLUDING APPARATUS FOR CONTROLLING THE SUPPLY OF RELEASING AGENT

[75] Inventors: Yuusuke Morigami; Noboru Yonekawa, both of Toyohashi; Mitsuru Isogai; Takashi Yamada, both of Aichi-ken; Ryo Kawamura; Eiji Okabayashi, both of Toyokawa, all of Japan

[73] Assignee: Minolta Co., Ltd., Osaka, Japan

[21] Appl. No.: 09/154,240

[22] Filed: Sep. 16, 1998

[30] Foreign Application Priority Data

| | | | |
|---|---|---|---|
| Sep. 19, 1997 | [JP] | Japan | 9-255751 |
| Sep. 19, 1997 | [JP] | Japan | 9-255752 |
| Sep. 19, 1997 | [JP] | Japan | 9-255753 |
| Sep. 22, 1997 | [JP] | Japan | 9-257059 |
| Sep. 26, 1997 | [JP] | Japan | 9-260748 |
| Oct. 7, 1997 | [JP] | Japan | 9-274644 |
| Oct. 14, 1997 | [JP] | Japan | 9-280691 |

[51] Int. Cl.[7] ..... G03G 15/20

[52] U.S. Cl. ..... 399/325; 118/DIG. 1; 399/324

[58] Field of Search ..... 399/324–326; 118/DIG. 1, 60; 219/216

[56] References Cited

U.S. PATENT DOCUMENTS

| | | | |
|---|---|---|---|
| 4,193,681 | 3/1980 | Tanigawa et al. . | |
| 4,429,990 | 2/1984 | Tamary | 399/325 |
| 4,994,862 | 2/1991 | Hoover | 399/325 |
| 5,045,889 | 9/1991 | Hoover | 399/325 |
| 5,267,004 | 11/1993 | Mills | 399/325 |
| 5,327,204 | 7/1994 | Sculley et al. | 399/325 |
| 5,353,107 | 10/1994 | Sculley et al. | 399/43 |
| 5,482,552 | 1/1996 | Kikukawa et al. | 118/264 |
| 5,534,986 | 7/1996 | Irro et al. | 399/325 |
| 5,563,695 | 10/1996 | Sakurai et al. | 399/327 |
| 5,708,914 | 1/1998 | Mills et al. | 399/325 X |
| 5,732,317 | 3/1998 | Orchard, II et al. | 399/325 |
| 5,881,348 | 3/1999 | Onodera et al. | 399/325 |

FOREIGN PATENT DOCUMENTS

| | | |
|---|---|---|
| 52-155536 | 12/1977 | Japan . |
| 54-076234 | 6/1979 | Japan . |
| 54-106310 | 8/1979 | Japan . |
| 60-151680 | 8/1985 | Japan . |
| 61-61564 | 4/1986 | Japan . |
| 5-265346 | 10/1993 | Japan . |
| 6-274061 | 9/1994 | Japan . |
| 7-210025 | 8/1995 | Japan . |

*Primary Examiner*—Matthew S. Smith
*Attorney, Agent, or Firm*—Morrison & Foerster LLP

[57] ABSTRACT

A fixing apparatus for controlling an oil transfer apparatus to maintain a releasing agent holding layer such that it is not always saturated with the releasing agent. This makes it a compact, cost-effective unit with a long service life and provides a uniform, stable oil coating that eliminates image noise problems. In order to use a constant and minimum necessary amount of releasing agent, a releasing agent supply nozzle is incorporated with multiple protrusive or retrusive droplet growth assisting members at or near multiple releasing agent discharge ports. The supply nozzle used for supplying the oil has multiple discharge holes having approximately equal opening cross-sectional areas and an equalizing member which equalizes the amount of oil discharged from each discharge hole. The outer diameter D1 of the oil supply roller, the outer diameter D2 of the metal core and the distance P of adjacent through-holes formed on the periphery of the metal core satisfy a relation, $0.6<D1\cdot(D1-D2)/(D2\cdot P)<6$. A quantifying apparatus is provided to equalize the amount of oil transferred by the oil pump when it is intermittently transferred. The quantifying apparatus contributes in achieving a constant amount of releasing agent coating. A releasing agent leakage prevention member is provided to prevent unnecessary oil leakage from the releasing agent supply nozzle and rollers.

A specific correlation is established between the centerline average roughness of the oil supply roller surface and the amount of the releasing agent supply to the fixing roller by the oil supply roller. This makes it possible to achieve a uniform coating with excellent releasing capability and prevents adhesion of add particles.

40 Claims, 51 Drawing Sheets

Oil discharge vs. L x Sn

FIXING APPARATUS INCLUDING APPARATUS FOR CONTROLLING THE SUPPLY OF RELEASING AGENT

BACKGROUND OF THE INVENTION

1. Field of the Invention

This invention relates to a fixing apparatus provide in an image forming apparatus such as an electrophotographic printer, copying machine and the like, and more specifically, a fixing apparatus equipped with a mechanism for coating a rotating member for the pressure-thermal fixing process with a releasing agent to prevent the offset phenomenon.

2. Description of the Related Art

An image forming apparatus such as an electrophotographic printer, copying machine and the like is equipped with a fixing apparatus which fixes undeveloped toner images on sheets of recording media. One of the most widely used fixing apparatuses today is the pressure-thermal type.

A fixing apparatus based on the pressure-thermal fixing process comprises a fixing roller and a pressure roller, which are opposed to each other, and a tubular heater, such as a halogen lamp, which is placed in the center shaft of the fixing roller. The heat generated by the halogen lamp is radiated uniformly on the inner wall of the fixing roller, so that the temperature distribution on the outer wall of the fixing roller becomes uniform in the peripheral direction. The outer wall of the fixing roller is heated up to a temperature appropriate for fixing (e.g., 150–200° C.). Under such a condition, the fixing roller and the pressure roller rotate in directions opposite to each other while being in contact under pressure and nipping a sheet that holds the toner. In the nipping area where the fixing roller and the pressure roller are in contact under pressure, the unfixed toner on the sheet melt due to the heat transferred from the fixing roller and is fixed on the sheet with the help of thepressure exerted by the two rollers.

The fixing apparatus based on such a process tends to cause a transfer of a portion of the unfixed toner image on the sheet to the fixing roller side since the toner holding surface of the sheet makes a direct contact with the fixing roller surface. As a result, the molten toner adhered to the fixing roller may smear said sheet by being transferred back to the rear end of the sheet, or smear the next sheet by being transferred to it. This problem, known as the offset phenomenon, is a common problem of this type of apparatus.

Therefore, the fixing apparatus based on the pressure-thermal fixing process, in particular, the color fixing apparatus, has a mechanism for coating the fixing roller with a releasing agent to help the separation of the toner from the fixing roller. As the releasing agent, silicon releasing agent (hereinafter referred to as "oil") is normally used.

In such an oil coating mechanism, the oil on the fixing roller surface has to be replenished as the oil on the fixing roller is taken away by the sheet when the sheet passes through the mechanism for replenishing the oil to said oil coating mechanism.

Such an oil replenishing mechanism can be a mechanism which coats more than enough amount of oil on the fixing roller and collect the excessive amount by means of an oil recovery mechanism so that the collected oil can be recycled (refer to JP-A-05-265346), or a mechanism that which allows a small amount of oil to be seeped out from a roller which holds a predetermined amount of oil and the entire unit is replaced after a certain amount of oil has been consumed (refer to JP-A-02-23382).

The former case, however, has a disadvantage that too much oil is taken away by the sheet. Also, since it requires an oil recovery mechanism, it is disadvantageous from the cost standpoint. On the other hand, the latter case has a limitation to the amount of oil retained If it is attempted to hold a large amount of oil to extent the life, the apparatus becomes too large. In other words, in order to hold a large amount of oil, the roller diameter has to be enlarged, for example, which results in increasing the size of the apparatus itself. Also, as shown in FIG. 1, a large amount of oil seeps out when the oil containing roller is first set, the seepage gradually decreases as the number of sheets processed increases; in other words, the amount of seepage changes with the amount of oil remaining on the roller. Therefore, the oil seepage is unstable and, in other cases, it may even cause a problem of image noise such as oil streaks and offsets due to oil leakage from the fixing roller.

One of the oil coating mechanisms of the prior art comprises an oil tank which extends along an axial direction of the fixing roller and a felt pad or roller which is arranged to be immersed in the oil contained in the oil tank, so that the oil can be supplied to the oil coating roller which maintains contact with the fixing roller by means of the felt, etc. (refer to JP-A-54-76234). However, such an oil coating mechanism may cause oil spillage or oil smearing because it has a large amount of oil in an open oil tank. Moreover, if the image forming device itself vibrates or is installed in a tilted position, the fixing apparatus, hence the oil coating apparatus as well, vibrate or tilt, which tends to cause oil spillage. Moreover, in an oil coating mechanism which supplies the oil in a planar fashion to the oil coating roller, it is difficult to provide a uniform amount of oil on the surface of the fixing roller relative the axial direction of the fixing roller, and this may be a cause of image noise problems such as oil streaks.

Therefore, another type of oil coating mechanism has been proposed in recent years where multiple oil discharge ports are provided on a supply nozzle so that the oil is supplied in multiple droplets on the oil coating roller (refer to JP-A-06-274061 and JP-A-07-210025). In such a processing format where the oil is supplied form a nozzle, a sealed oil tank can be used, so that any oil spillage from the tank can be prevented. Also, by adjusting the operating time period of the oil pump, the oil supply amount can be arbitrarily selected from small to large thus giving an advantage of broadening the range of oil supply amount.

On the other hand, as shown in FIG. 2A, it is difficult to control the growth of droplet 4 accurately. This is because oil 3 adheres to and spreads around the vicinity of discharge port 2 and joins with the oil 3 that is leaving adjacent discharge ports 2 causing droplet 4 to grow. As a result, even though the total quantity of oil 3 discharge is controllable, it is difficult to controllable, it is difficult to control accurately the size and growth rate of droplet 4 generated at each discharge port 2.

Moreover, if the supply nozzle 1 is tilted, as shown in FIG. 2B, oil 3 that has left discharge port 2 flows along the surface of supply nozzle 1 in a descending direction and joins with oil 3 that has left other discharge ports 2. This oil 3 therefore drips at a point offset from the intended dripping point and the amount of droplet 4 becomes large than the intended amount.

Consequently, in a constitution described above, which depends on the growth of droplets from the discharge ports of the supply nozzle, the oil from the discharge ports of the supply nozzle, the oil from the discharge ports tends to flow down along the surface of the nozzle if the fixing apparatus is tilted, causing droplets to gather at lower points of the tilted nozzle so that they fail to grow in the intended point. As a consequence, the oil drops at unintended places or the droplets fail to grow to an intended size, causing fluctuation of the discharge amount and image noise problems such as oil streaks and offsets.

Also, in case of a supply nozzle having multiple oil discharge ports on a pipe extending along the axial direction of the oil coating roller, a technique of changing diameters of discharge ports along the longitudinal direction in order to obtain a uniform oil discharge quantity along the longitudinal direction has also been proposed.

However, since the diameters of discharge ports have to be changed substantially along the longitudinal direction, the maximum discharge port diameter becomes substantially large as the nozzle length becomes longer. As a result, the diameter of the nozzle itself has to be larger, making the oil coating mechanism larger and consequently making the fixing apparatus larger. Another problem is that the process of forming discharge ports becomes complex as the diameters of the discharge ports vary, thus causing an increase of manufacturing cost. Moreover, if the fixing apparatus is under vibration or tilted, the varying diameters of the discharge ports aggravate the oil leakage and vary the amount of the oil discharge amount, discharged thus creating image noise problems such as oil streaks and offsets.

Another type of oil coating mechanism of the prior art comprises an oil coating roller which rotates and maintains contact with the fixing roller surface under pressure, and an oil supply roller which holds a releasing agent in its cylindrical body and maintains contact with the oil coating roller surface under pressure (refer to JP-Y-03-10525).

In such an oil coating mechanism, the oil which is applied to the fixing roller surface is supplied from the oil supply roller by way of the oil coating roller. This makes it possible to delegate the function of contacting under pressure and uniformly coating the fixing roller surface with the oil and the function of holding the oil and controlling the coating amount to the oil coating roller and the oil supply roller, respectively. Since the oil coating roller exists between the oil supply roller and the fixing roller, the oil coating roller prevents the fixing roller's heat from being directly transferred to the oil supply roller, thus reducing the chances of evaporating the releasing agent contained therein.

In the oil coating mechanism of the fixing apparatus described above, the oil supply roller comprises a cylindrical metal core with small holes formed on its outer surface and a porous sheet which covers it, and the oil is sealed in the inside of the metal core and, as such, the oil is always ready to permeate into the porous sheet through small holes of the metal core. In other words, the porous sheet of the oil supply roller is always impregnated with the oil and as the oil is consumed, it is replenished from the inside of the metal core through the holes. Therefore, in order to prolong its useful life, the size and number of the small holes on the metal core have to be limited.

However, in color copying machines manufactured in recent years, the oil used for making each A4-size copy is more than it used to be; for example, it requires more than 10 mg in some cases. On an oil supply roller such as the one described above, there has always been a problem in providing a sufficient response, i.e., to supply a sufficient amount of oil quickly. If the amount of oil applied on the fixing roller is insufficient, it leaves some parts of the roller uncoated, resulting in offset phenomena or contamination of the oil supply roller as a result of odd objects adhering to it.

On the other hand, increasing the diameters and the number of small holes formed on the metal core in order to increase the amount of oil to be coated on the fixing roller creates a condition wherein the porous sheet is impregnated with excessive amount of oil constantly and thus creating oil streaks on the sheet. Also, in such a case, the oil supply roller has a relatively short usage life, hence increasing the frequency of part replacement.

Yet another type of oil coating mechanism of prior art is the one comprising a coating roller which coats the fixing roller with oil, an impregnating material such as felt to supply the oil to the coating roller, a tank unit which stores the oil, a transferring passage which transfers the oil stored in the tank unit, and a pump unit provided on the transferring passage in order to transfer the oil.

As one of such an oil coating mechanism, a mechanism has been disclosed (refer to U.S. Pat. No. 4,193,681 and JP-B-63-11669), wherein an oil holding member made of felt makes contact with the coating roller at one end and immerses itself in the oil contained in an auxiliary tank on the other end, while the main tank supplies an excessive amount of oil to the auxiliary tank, thus allowing the excessive oil overflowing from the auxiliary tank to be collected in the main tank.

There is yet another type of mechanism of prior art, wherein the pump unit has a pair of tubes equipped with a ball valve, which are connected with a flexible tube made of urethane rubber and the like having an excellent restoring capability, and an pressuring number, such as a cam, which presses the rubber tube (refer to JP-A-54-76234). This pump unit causes an elastic deformation to the rubber tube be means of the pressuring member to push out the oil contained in the rubber tube and, by removing the pressure, allows the rubber tube to restore its original shape to such the oil from the tank.

On a fixing apparatus of an image forming apparatus which is capable of printing or copying full color images, it is normally necessary to coat the fixing roller with a larger amount of oil compared to the monochromatic image fixing apparatus. On the other hand, it is necessary to reduce the amount of oil consumption in order to prolong the maintenance interval or to reduce the waste of material. In order to accomplish this, it is desirable to replenish the required amount at the required moment, so that it is necessary to establish a technique of supplying a small metered amount of oil intermittently and steadily.

However, the oil coating mechanism of the prior art which supplies the oil excessively and collects the excessive amount of oil is not constituted to supply the oil intermittently, although it can supply the oil continuously. Therefore, it is necessary to provide a means of intermittently supplying the oil from the auxiliary tank to the coating roller in addition to the means of supplying an excessive amount of oil from the tank to the auxiliary tank, thus causing a complexity to the constitution.

Moreover, the above-mentioned pump unit of the prior art has a very simple constitution using a ball valve, is inexpensive and shows a stable oil supplying capability in case of a continuous supply. However, since the ball valve, is inexpensive and shows a stable oil supplying capability in case of continuous supply. However, since the ball valve is not enough to stop the back-flow of oil, the oil level in the transfer passage drops substantially which the pump is at a stand-still. Consequently, if the oil has to be transferred intermittently, the oil level in the transfer passage may change each time when the pump is restarted, so that the amount of oil transferred may vary even if the pump is operated the same number of times and for the same number of time periods. This created a problem that the amount of oil coated on the fixing roller can not be stabilized.

Furthermore, in the aforementioned oil coating mechanism (refer to JP-A-06-274061 and JP-A-07-210025) which supplies the oil in droplets from the multiple oil delivering holes provided on the supply nozzle, an amount oil which exited a delivering hole and remained in the vicinity of the delivering hole flows down along the surface of the supply nozzle; if the supply nozzle is tilted, then the oil combines with other amounts of oil remaining in the vicinities of other delivering holes and eventually reaches the lower end of the supply nozzle. The oil that gathered at the supply nozzle end may leak to the outside of the fixing apparatus and soil the hands and/or clothes of the operator, or leak to the other parts of the mechanism causing contamination to those parts.

It is also common for a typical oil coating mechanism of the prior art to have a blade made of metal or rubber which abuts the oil coating roller in order to accomplish a uniform coating of the fixing roller and to stabilize the amount of coating.

This blade, which is intended to produce a uniform coating, often collects odd particles on the edge of the blade edge. When odd particles are collected on the blade, the amount oil coated in the area where odd particles exist is less than areas surrounding it, thus creating uneven coating on the fixing roller. This tends to cause offset phenomena and oil contamination.

Another process that has been disclosed (refer to JP-B-59-29874) comprises an oil coating roller for coating a fixing roller with oil and an oil supply roller, which is designed to contact with the oil supply roller, which is designed to contact with the oil coating roller under pressure, whereby odd particles are transferred due to the surface energy difference between the two rollers and discarded thereafter.

However, the process mentioned above is designed to remove the odd particles after they have attached to the roller is not intended to eliminate the cause of adherence of odd particles to the roller. Moreover, the odd particles move only to the oil supply roller, which is located upstream, and cause an uneven oil transportation from the oil supply roller to the oil coating roller. As a result, it still causes an uneven coating on the fixing roller

SUMMARY OF THE INVENTION

The object of this invention is to provide a fixing apparatus having a long usage life, a compact constitution and an excellent cost advantage, which also provides a uniform and stable oil coating process, thus being capable of preventing the occurrence of image noise.

One aspect of this invention is a faxing apparatus comprising a first rotating member and second rotating member arranged to oppose each other to fix unfixed toner images held on sheets of recording media, a coating apparatus which coats at least one of the two rotating members with a releasing agent, the coating apparatus being equipped with a releasing agent holding roller, which has a releasing agent holding layer on its outer surface, and a transfer apparatus which supplies the releasing agent to the releasing agent holding layer so that the releasing agent is not saturating the releasing agent holding layer all the time.

One aspect of this invention is a fixing apparatus comprising a first rotating member and a second rotating member arranged to oppose each other to fix unfixed toner images held on sheets of recording media, a coating apparatus which coats at least one of the two rotating members with a releasing agent, a transfer apparatus which supplies the releasing agent to the coating apparatus and a controller which controls the supply of the releasing agent from the transfer apparatus to the coating apparatus.

One aspect of this invention is a faxing apparatus comprising a first rotating member and a second rotating member arranged to oppose each other to fix unfixed toner images held on sheets of recording media, a coating apparatus which coats at least one of the two rotating members with a releasing agent, a transfer apparatus which supplies the releasing agent to the coating apparatus, a controller which controls the supply of the releasing agent from the transfer apparatus to the coating apparatus and a forcing switch which forces the supply of the releasing agent from the transfer apparatus to the coating apparatus.

One aspect of this invention is a fixing apparatus comprising a first rotating member and a second rotating member arranged to oppose each other to fix unfixed toner images held on sheets of recording media, coating apparatus which coats at least one of the two rotating members with a releasing agent, a transfer apparatus which supplies the releasing agent to the coating apparatus and a controller which controls the supply of the releasing agent from the transfer apparatus to the coating apparatus, the controller resetting a counter which determines the supply control of the releasing agent when the coating apparatus is replaced.

One aspect of this invention is a fixing apparatus comprising a first rotating member and a second rotating member arranged to oppose each other to fix unfixed toner images held on sheets of recording media, a coating apparatus which coats at lease one of the two rotating members with a releasing agent, a transfer apparatus which supplies the releasing agent to the coating apparatus, and a controller which controls the supply of the releasing agent from the transfer apparatus to the coating apparatus, the controller stopping the image forming operation when a specified amount of releasing agent cannot be supplied during the releasing agent supply period.

Another object of this invention is to provide a fixing apparatus comprising a releasing agent supply nozzle provided with discharge ports and a structural member such as a protrusion or a groove provided at each position where droplets of the releasing agent are supposed to drop by helping stable droplets to be formed regardless of any tilting of the nozzle, so that a uniform supply of a releasing agent is available along the axial direction of the nozzle.

One aspect of this invention is a fixing apparatus comprising a first rotating member and a second rotating member arranged to oppose each other to fix unfixed toner images held on sheets of recording media a coating apparatus which is arranged along the axial direction of at lease one of the two rotating members and coats the rotating member with a releasing agent and a supply nozzle which is arranged along the lengthwise direction of the coating apparatus, the supply nozzle comprising multiple discharge ports to supply the releasing agent to the coating apparatus and droplet growth assisting members to help droplets of the releasing agent released form each discharge port to drop beneath each discharge port.

Another object of this invention is to provide a fixing apparatus having a compact constitution and coat advantage, a fixing apparatus capable of supplying a releasing agent from a supply nozzle uniformly and steadily, thus preventing image noises, even if tilting and vibrating conditions exists.

One aspect of this invention is a fixing apparatus comprising a first rotating member and a second rotating members arranged to oppose each other to fix unfixed toner images held on sheets of recording media, a coating apparatus which is arranged along the axial direction of at least one of the two rotating members and coats the rotation member with a releasing agent and a supply nozzle which is arranged along the lengthwise direction of a coating apparatus, the supply nozzle comprising multiple discharge ports having approximately equal opening cross section areas to supply the releasing agent to the coating apparatus and an equalizing member which equalizes the amount of the releasing agent discharged from each discharge port.

Yet another object of this invention is to apply a required amount of a releasing agent on the fixing roller uniformly.

One aspect of this invention is a fixing apparatus comprising a first rotating and a second rotating members arranged to oppose each other to fix unfixed toner imaged held on sheets of recording media, a coating apparatus which coats at least one of the two rotating members with a releasing agent, the coating apparatus comprises a roller which supplies the releasing agent to the rotating member, the roller comprising a metal core, on which multiple through holes are provided and a releasing agent holding layer which covers the outer surface of the metal core, wherein the roller outer diameter D1, the metal core outer diameter D2 and the distance P between adjacent through holes holding a relation: $0.6<D1\cdot(D1-D2)/(D2\cdot P)<6$; and a transfer apparatus which supplies the releasing agent inside the roller.

One aspect of this invention is a fixing apparatus comprising a first rotating member and a second rotating member arranged to oppose each other to fix unfixed toner images held on sheets of recording media, a coating apparatus which coats at lease one of the two rotating members with a releasing agent, the coating apparatus comprises a roller which supplies the releasing agent to the rotating member, the roller comprising a metal core, on which multiple through holes are provided, and a releasing agent holding layer which covers the outer surface of the metal core, wherein kinematic viscosity S (cSt) of the releasing agent is at 25° C. and the bore D3 (mm) of the through holes satisfies a relation: $0.05<D3/(1n(S))<0.5$, and a transfer apparatus which supplies the releasing agent inside the roller.

One aspect of this invention is a fixing apparatus comprising a first rotating member and a second rotating member arranged to oppose each other to fix unfixed toner images held on sheets of recording media, a coating apparatus which coats at lease one of the two rotating members with a releasing agent, the coating apparatus comprising a roller which supplies the releasing agent to the rotating member, the roller comprising a metal core, on which multiple through holes are provided and a releasing agent holding layer which covers the outer surface of the metal core, wherein the peripheral dimension of each through hole is longer than the axial dimension of the same hole and a transfer apparatus which supplies the releasing agent inside said roller.

Yet another object of this invention is to provide a fixing apparatus that is capable of transferring a constant minute amount of oil intermittently and steadily, so that a uniform amount of oil can be applied to rotating members such as a fixing roller.

One aspect of this invention is a fixing apparatus comprising a first rotating member and a second rotating member arranged to oppose each other to fix unfixed toner images held on sheets of recording media, a coating apparatus which coats at least one of the two rotating members with a releasing agent, a tank unit which stores a releasing agent, a releasing agent supply apparatus which supplies the releasing agent stored in the tank unit, wherein the releasing agent supply apparatus comprises a transfer passage for transferring the releasing agent stored in the tank and a pump unit for transferring the releasing agent intermittently by switching operating and stopping modes, and a quantifying apparatus which meters the releasing agent amount being transferred constant as the releasing agent is intermittently transferred by the pump unit.

Yet another object of this invention is to provide a fixing apparatus which prevents excessive oil from infiltrating into unspecified mechanism areas or seeping out to unintended areas, thus preventing the oil from invading unintended mechanism areas even if the nozzle tilting occurs.

One aspect of this invention is a fixing apparatus comprising a first rotating member and a second rotating member arranged to oppose each other to fix unfixed toner images held on sheets of recording media, a coating apparatus which is arranged along the axial direction of at least one of the two rotating members and coats the rotation member with a releasing agent and a supply nozzle that is arranged along the lengthwise direction of the coating apparatus, the supply nozzle comprising multiple discharge ports to supply the releasing agent to the coating apparatus, and a releasing agent leakage prevention member which prevents the leakage which flows down along the outer surface of the supply nozzle when the releasing agent is discharged from the discharge ports.

One aspect of this invention is a fixing apparatus comprising a first rotating member and a second rotating member arranged to oppose each other to fix unfixed toner imaged held on sheets of recording media, a coating apparatus which coats at least one of the two rotating members with a releasing agent, the coating apparatus comprises a roller which supplies the releasing agent to the rotating member, the roller comprising a hollow metal core and a releasing agent holding layer which covers the outer surface of the metal core, a supply nozzle which is arranged along the lengthwise direction of the coating apparatus, the supply nozzle comprising multiple discharge ports to supply the releasing agent to the coating apparatus and a releasing agent leakage prevention member which prevents the leakage which flows down along the inner surface of the metal core when the releasing agent is discharged from the discharge ports.

One aspect of this invention is a faxing apparatus comprising a first rotating member and a second rotating member arranged to oppose each other to fix unfixed toner images held on sheets of recording media, a coating apparatus which coats at least one of the two rotating members with a releasing agent, the coating apparatus comprises a roller which supplies the releasing agent to the rotating member, a supply nozzle which is arranged along the lengthwise direction of the coating apparatus, the supply nozzle comprising multiple discharge ports to supply the releasing agent to the coating apparatus, and a releasing agent leakage prevention member which prevents the leakage which flows down along the outer surface of the roller.

Yet another object of this invention is to provide a fixing apparatus which is capable of applying a uniform coating on the fixing roller even if the amount of releasing agent is minute, providing an excellent releasing capability and reducing adherence of odd particles.

One aspect of this invention is a fixing apparatus comprising a first rotating member and a second rotating member arranged to oppose each other to fix unfixed toner images held on sheets of recording media and a coating apparatus which coats at least one of the tow rotating members with a releasing agent, the coating apparatus comprises a roller which supplies the releasing agent to the rotating member, wherein the centerline mean roughness of the roller's surface and the amount of releasing agent supplied from the roller to the rotating member has a specified relation.

The objects, features and characteristics of this invention other than those set forth above will become apparent from the description given herein below with reference to preferred embodiments illustrated in the accompanying drawings.

DETAILED DESCRIPTION OF THE PREFERRED EMBODIMENT

The embodiments of this invention will be described below with reference to the accompanying drawings.

Figure 1:
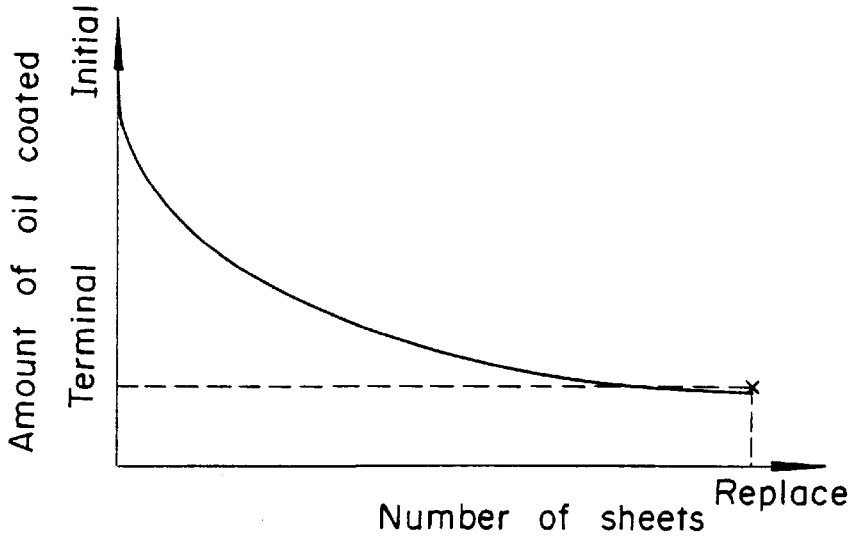
FIG. 1 (RELATED ART)
FIG. 1 is a graph showing the relations between the number of sheets processed through the apparatus and the quantity of oil applied on the sheets.
Figure 2A:
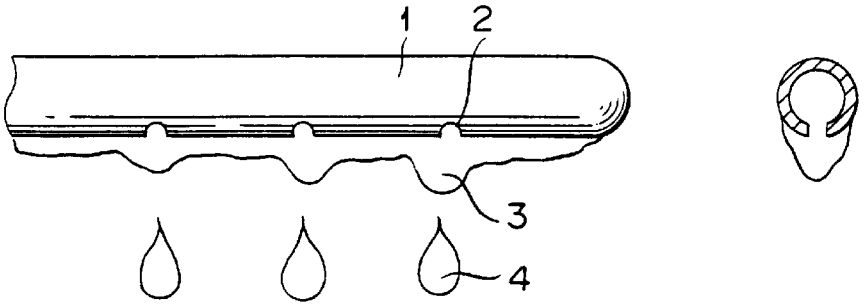
FIG. 2A (RELATED ART)
FIGS. 2A and 2B are the drawings showing the oil dripping action of a releasing agent supply nozzle in each apparatus of prior art.
Figure 2B:
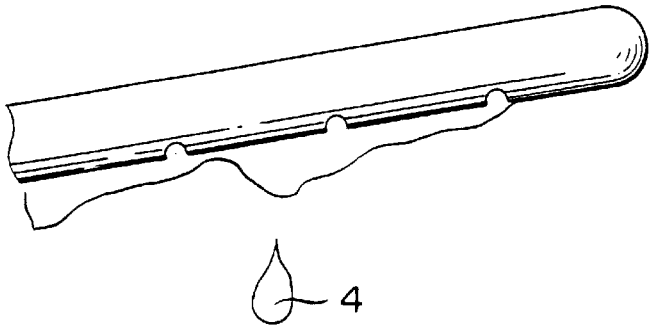
FIG. 2B (RELATED ART)
Figure 3:
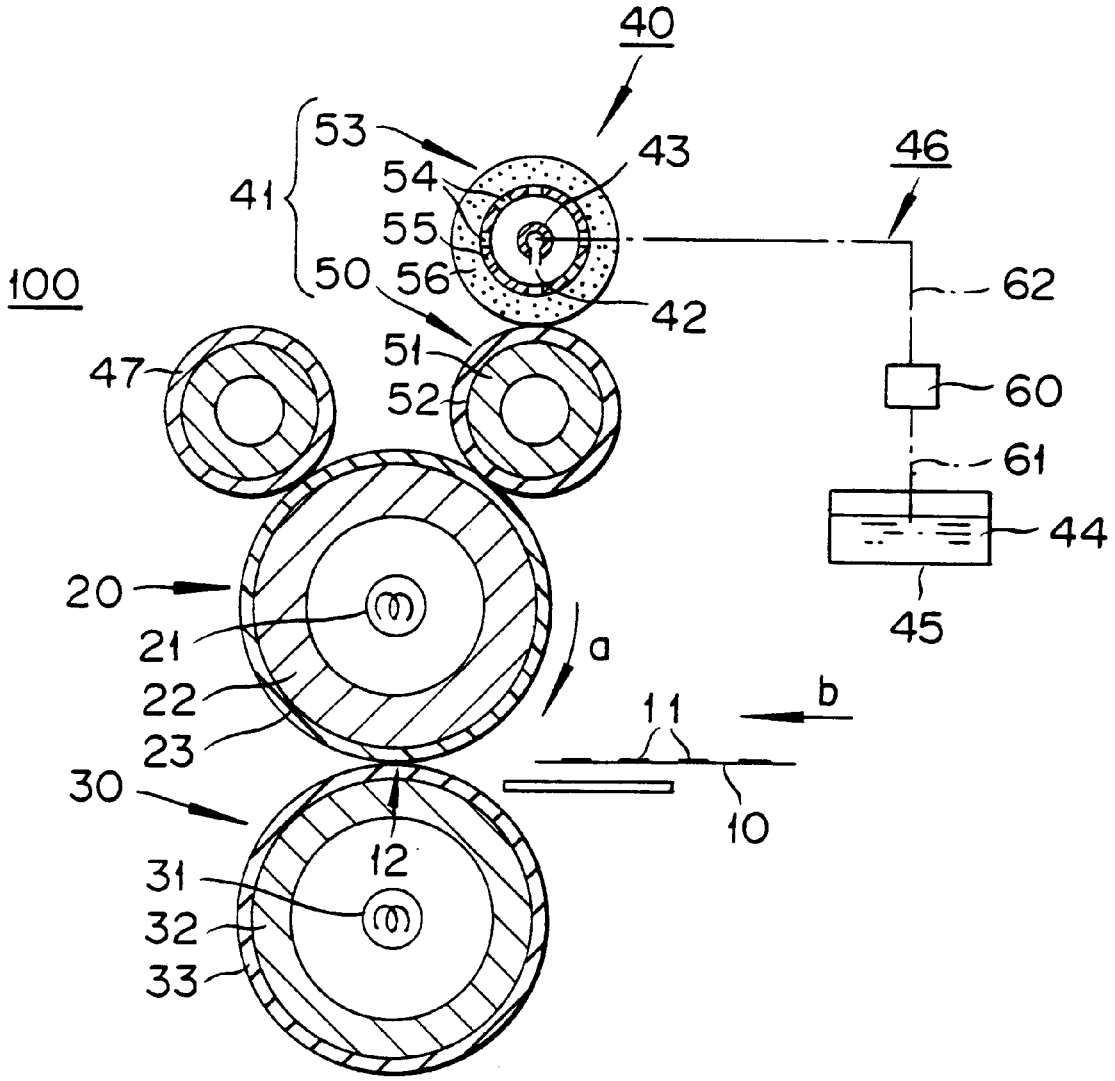
FIG. 3 is an outline schematic drawing of the first embodiment of this invention.
Figures 4A, 4B:
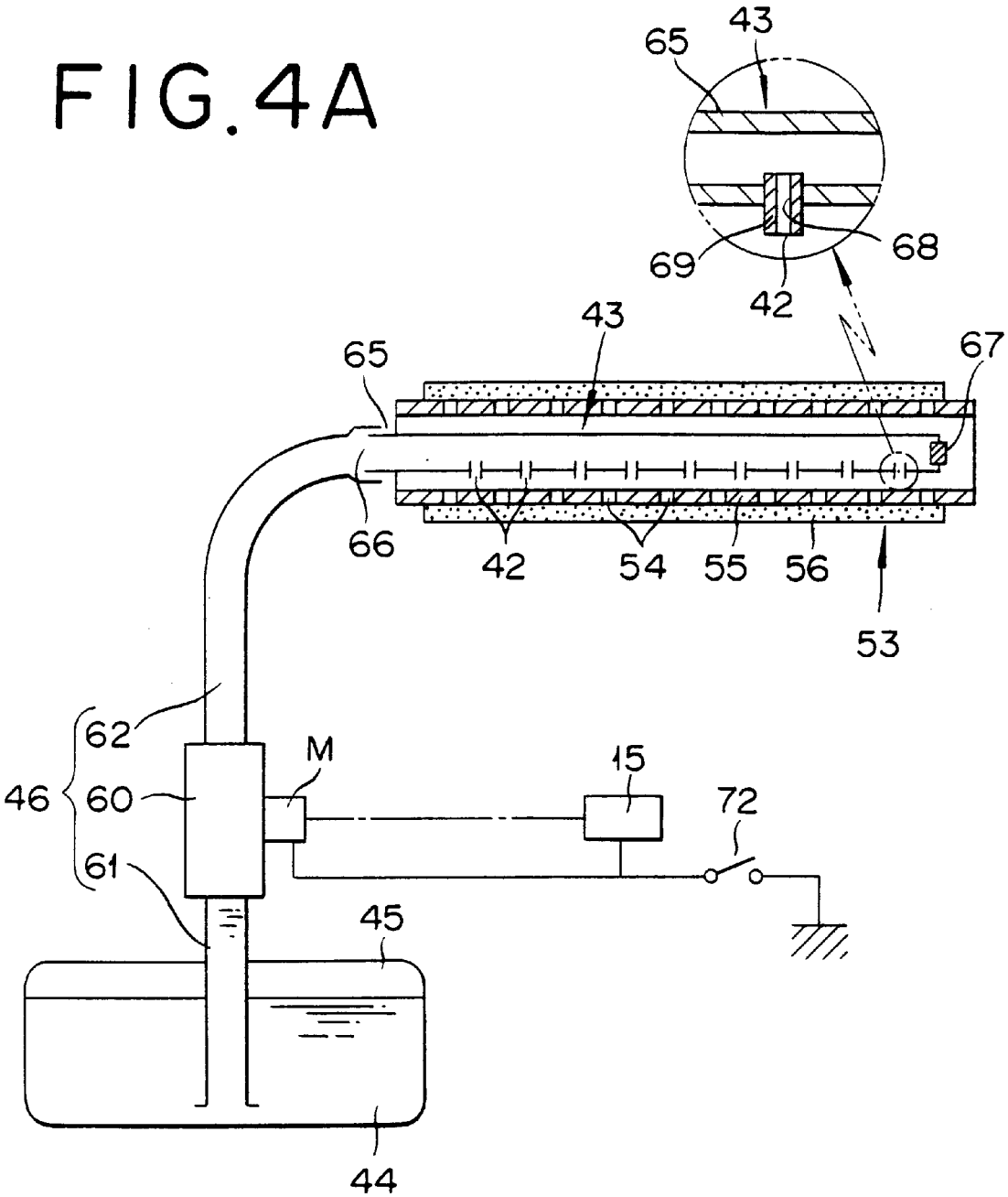
FIG. 4A is a schematic drawing, partly in cross section, of an oil coating mechanism
FIG. 4B is an enlarged view of an oil discharge part.
Figure 5:
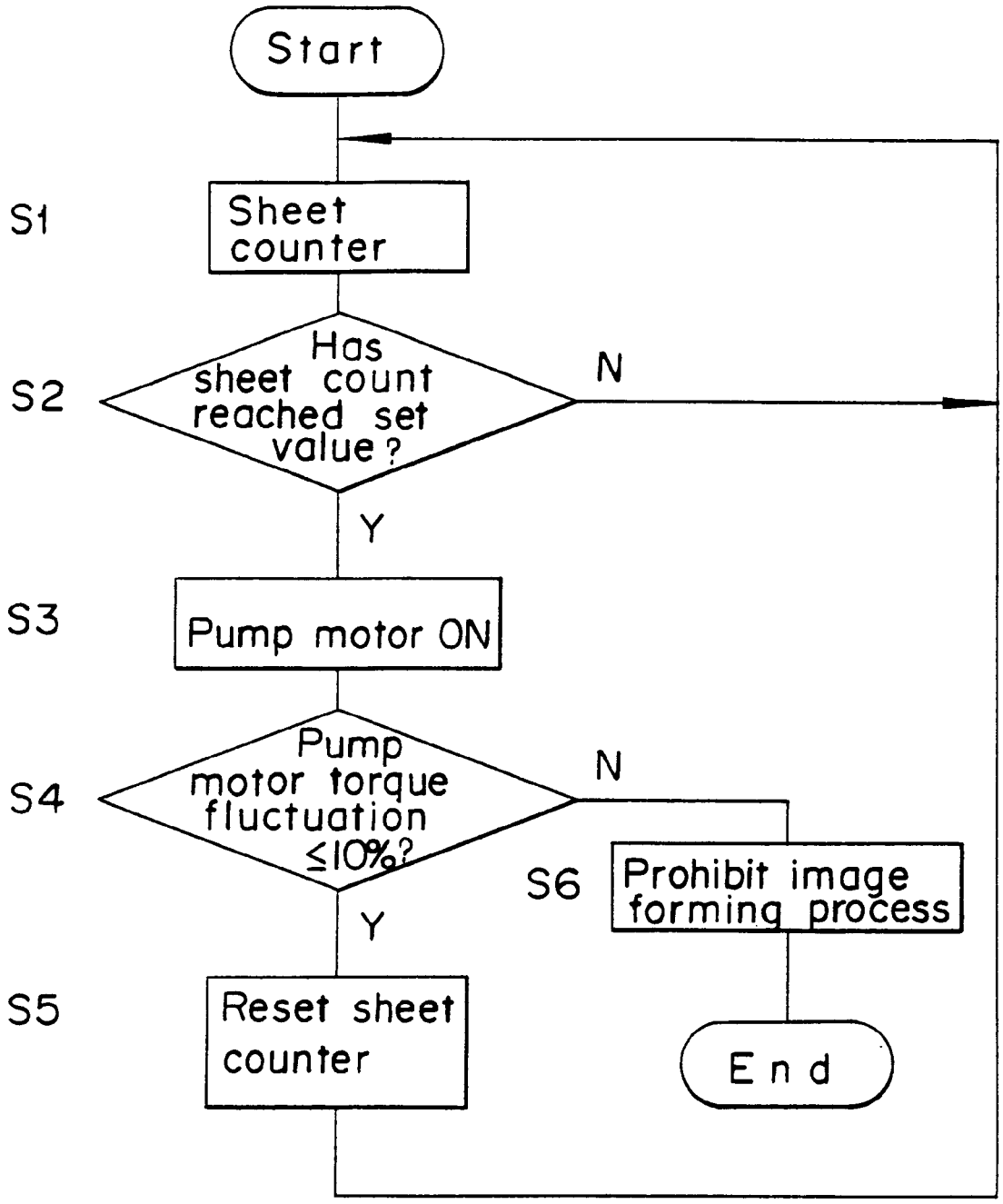
FIG. 5 is a flow charge showing the sheet supplying operation.
Figure 6:
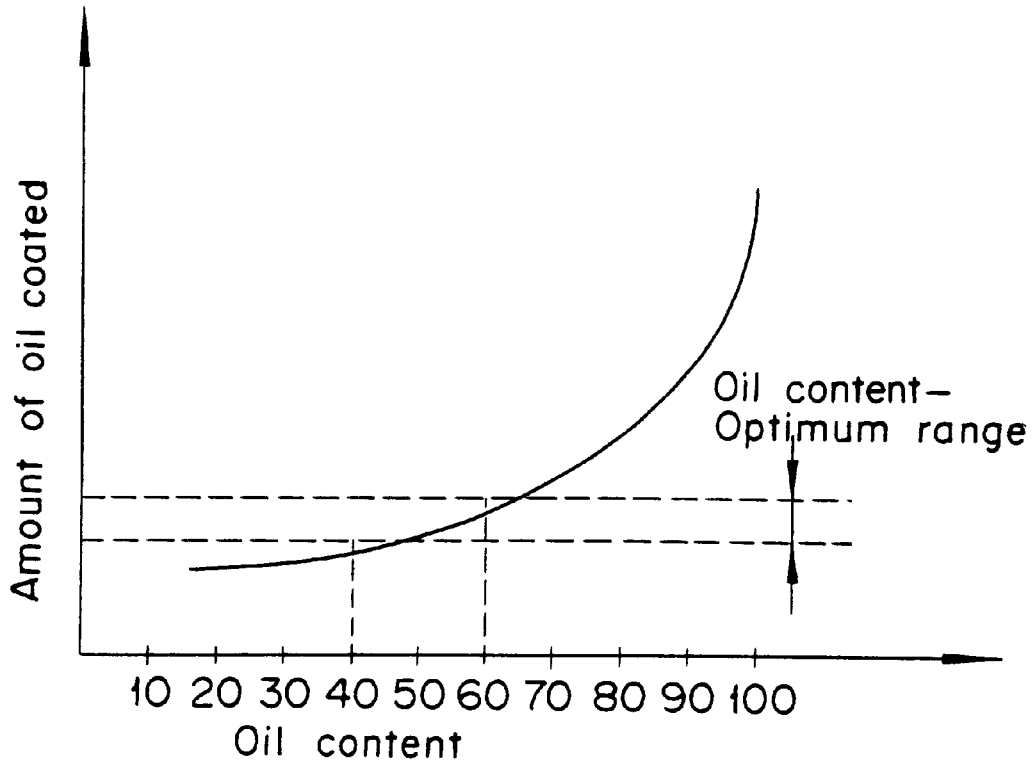
FIG. 6 is a graph showing the relations between oil content and oil coating amount.
Figure 7:
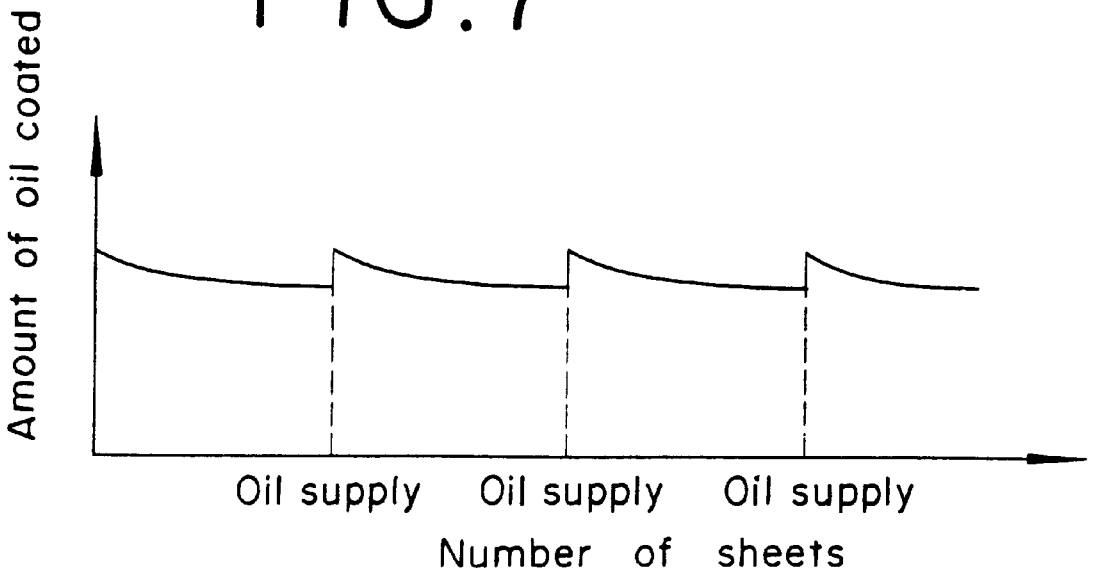
FIG. 7 is a graph showing the oil supply mode.

FIG. 3 is an outline schematic drawing of the first embodiment of this invention, FIG. 4A is a schematic drawing partly in cross section, of an oil coating mechanism and FIG. 4B is an enlarged view of an oil discharge part. FIG. 5 is a flow chart showing the sheet supplying operation, FIG. 6 is a graph showing the relations between oil content and oil coating amount and FIG. 7 is a graph showing the oil supply mode.

In these drawings, a fixing apparatus 100 is based on the pressure-thermal fixing process, and is used as a part of an image forming apparatus, such as a printer, which is equipped with a publicly-known image forming member based on electronic photographing process. Fixing apparatus 100 comprises a fixing roller 20 which rotates in the direction of an arrow "a", a pressure roller 30 which contacts with fixing roller 20 under pressure and which is being driven by fixing roller 20 heaters 21 and 31 which heat rollers 20 and 30 respectively, and an oil coating mechanism 40 which coats at least one of the rollers (fixing roller 20 in the case shown in the drawings) with a releasing agent to prevent offset phenomena Fixing roller 20 and pressure roller 30 correspond to the rotating members that help pressure-thermally fixing a toner 11 on a sheet 10. Silicon oil is used as the releasing agent. The symbol "47" used in the drawings represents a cleaning roller, the surface of which is covered with a fabric layer.

Fixing roller 20 comprises a hollow metal pipe 22 covered with a fluoride resin layer 23 which has an excellent releasing characteristic against the toner and thermal resistance. A tubular heater, such as a halogen lamp 21 is provided on the axis of fixing roller 20. Fixing roller 20 is equipped with a drive gear (not shown) attached to one end thereof, and is driven by a drive source (not shown) connected to the drive gear.

Pressure roller 30 comprises a hollow metal pipe 32 covered with a silicon rubber layer 33 and has a halogen lamp 31 on the axis. Silicon rubber layer 33 has an excellent capability of releasing sheet 10 from its surface and is thermally resistant. Pressure roller 30 is also energized in the direction toward fixing roller 20 by means of a spring (not shown). In case halogen lamp 21 built into fixing roller 20 is sufficient by itself to fix the toner, halogen lamp 31 on pressure roller 30 can be eliminated.

In a fixing operation, a specified voltage is applied to halogen lamps 21 and 31, and fixing roller 20 and pressure roller 30 are heated by the heat radiated by these halogen lamps 21 and 31 until the rollers' outer wall surfaces reach the specified temperatures. Sheet 10 that holds unfixed toner 11 is transferred to the right as shown by an arrow "b" in FIG. 3, and is sent into a nipping area 12 where fixing roller 20 and pressure roller 30 are in contact Sheet 10 is transferred while it is being nipped in nipping area 12 where the heat from fixing roller 20 and pressure roller 30 as well as the pressure from pressure roller 30 are applied. This results in fixing of unfixed toner 11 on sheet 10. Toner 11 is held on the side of sheet 10 that is in contact with fixing roller 20. Sheet 10 that has passed nipping area 12 separates curlingly form fixing roller 20 by its natural resilience and is transferred to the left in FIG. 3. Sheet 10 is transferred by the discharge roller (not shown) and discharged to a discharge tray (not shown).

Next, let us describe the constitution of an oil coating mechanism 40.

Oil coating mechanism 40 comprises a coating apparatus 41 which extends in the axial direction of fixing roller 20 and coats fixing roller 20 with a releasing agent and a supply nozzle 43 which extends in the longitudinal direction of coating apparatus 41 and supplies oil through multiple discharge ports 42. As shown in FIG. 4A, oil coating mechanism 40 further comprises a sealed oil tank 45 which holds oil 44, and an oil transfer apparatus 46 which transfers oil 44 contained in oil tank 45 to nozzle 43. Supply nozzle 43 consists of multiple discharge ports 42, of which the cross-sectional area of each opening is approximately constant.

Coating apparatus 41 is provided on the side of fixing roller 20, on which sheet 10 is transferred, and comprises an oil coating roller 50 which makes contact with fixing roller 20 under pressure and coats fixing roller 20 with oil 44, and an oil supply roller 53 which supplies the oil.

As shown in FIG. 3, oil coating roller 50 comprises a hollow roller made by covering a metal pipe 51 with a silicone rubber layer 52. In the oil coating apparatus 41 of this embodiment, coating roller 50 constitutes a coating layer that transfers oil 44 to fixing roller 20 which constitutes the rotating member.

As shown in FIG. 4A, oil supply roller 53 comprises a cylindrical metal core 55, being formed with multiple through holes 54, the outside surface of which is being covered by an oil impregnation material 56, and having a supply nozzle 43 in a nonOrotating condition on its axis. The through holes 54 are small holes with small diameters, formed at approximately constant intervals. The inside and outside surfaces of core metal 55 communicate through holes 54. Oil impregnation material 56 is made of a porous material such as sponge, paper, felt and silicon rubber. Oil 44 supplied through supply nozzle 34 to the inside of core metal 55 reaches the outside of metal core 55 through through-holes 54 of metal core 55 6o impregnate oil impregnation material 56.

While oil coating roller 50 is supported to be able to rotate freely and is driven by fixing roller 20, oil supply roller 53 is supported to be able to rotate freely and is driven by oil coating roller 50. Through the rotations of these rollers, the oil supplied by supply nozzle 43 is transmitted to oil coating roller 50 by oil impregnation material 56 of oil supply roller 53 and coated on the outside surface of releasing agent layer 23 of fixing roller 20 by oil coating roller 50.

As shown in FIG. 4A, oil transfer apparatus 46 comprises an oil pump 60, a tube 61, one end of which is connected to oil pump 60 and the other end is immersed in oil 44 contained in the inside of an oil tank 45, and a tube 62 connected one end of which is connected to oil pump 60 and the other end is connected to supply nozzle 43. In addition, a controller 15 is provided to control the motor M of oil pump 60.

Since oil tank 45 is a sealed type, the oil overflow does not occur even if a large amount of oil 44 is stored, and the oil leakage does not occur even if it is subjected to vibrations or tilting.

Supply nozzle 43 installed in supply roller 53 is provided with a pipe 65 made of stainless steel and the like, and opening one end of this pipe 65 forms a supply port 66. Supply port 66 of this pipe 65 is connected to tube 62 and the other end is closed by a plug 67 and the like, while multiple discharge ports 42 are pierced in between.

As shown in FIG. 4B, multiple through holes 68 are formed at specified intervals on pipe 65 and each of these through holes 68 is fitted with a tube 69 made of stainless steel and the like. The opening of tube 69 at its bottom end as shown functions as oil discharge port 42, and the diameter of tube 69 is approximately equal so that the cross-sectional area of each opening of the discharge port is approximately equal.

With this arrangement, since the bores of through-holes and the diameters of tube 69 are approximately constant, the diameter of pipe 65 does not have to be enlarged even when the nozzle length is increased, and oil coating apparatus 41 can be designed compactly.

Moreover, since the bore is approximately constant, the process of forming discharge ports 42 is relatively simple, so that the manufacturing cost increase can be suppressed, thus contributing to realization of a compact design and cost reduction of fixing apparatus 100.

Oil 44 is transferred from tank 45 into pipe 65 through its supply port 66 by means of oil transfer apparatus 46, and discharged from each discharge port 42 as droplets. Also, since discharge ports 42 of supply nozzle 43 are formed at specified intervals, oil 44 is supplied not as a plane, but as discrete points.

Regarding the holding of oil 44 in this embodiment, transfer apparatus 46 is constantly controlled so as not to create a condition saturated with oil 44 in oil holding layer 56.

While oil 44 impregnating oil holding layer 56 transfers from supply roller 53 to the surface of coating roller 50, a closer observation of this condition shows that supply roller 53 and coating roller 50 are contacting under a specific pressure, and supply roller 53 having oil holding layer 56 is driven by coating roller 50 under this contact condition.

As these rollers rotate, oil 44 is delivered quickly form oil holding layer 56 to be transferred to the surface of coating roller 50, and the oil gathers at the lower area of oil holding layer 56 due to the gravity. If the oil content of oil holding layer 56 is too high during this process, the oil falls in large drops on coating roller 50. This causes oil streaks and offsets when the unit is restarted. On the other hand, if the oil content of oil holding layer 56 is extremely low, then the oil does not reach coating roller 50 and the function of removing and releasing the toner will be insufficient.

Therefore, an unsaturated condition is always maintained in oil holding layer 56 of this embodiment. The quantity and timing of the oil supply to the oil holding layer are always controlled by controller 15 to prevent oil holding layer 56 from becoming saturated with the oil.

In order to control the oil content of oil holding layer 56, it does not necessarily require to control both the oil supply quantity and timing, i.e., it may be sufficient to control one of those two factors depending on the situation.

The relation between the oil content of oil holding layer 56 and the oil coating quantity can be expressed by a curve such as the one shown in FIG. 6 by expressing the content of oil 44 as a volumetric percentage.

Based on their relations described above, an experiment was conducted to study the separation result for a specific number of sheets to judge the quality of printing.

The experiment was conducted by expressing the content of oil 44 in oil holding layer 56 in terms of volumetric percentage, and looking for soiling of the sheets, oil streaks, and image luster unevenness by visual inspection when 10 sheets each are fed through fixing roller 20 and pressuring roller 30 at 10 minutes intervals for each oil content level. The result is shown in the following Table 1.

TABLE 1

| Oil Content (%) | Existence of smeared sheets caused by offsetting | Existence of oil streaks | Existence of image luster unevenness |
|---|---|---|---|
| 10 | x | -- | x |
| 20 | -- | -- | slightly x |
| 30 | -- | -- | slightly x |
| 40 | -- | -- | -- |
| 50 | -- | -- | -- |
| 60 | -- | -- | -- |
| 70 | -- | slightly x | -- |
| 80 | -- | slightly x | -- |
| 90 | -- | x | -- |

x: exists
--: not exist

It is clear from the above result of this experiment that the oil content must be above 20% in order to eliminate smearing due to offsetting and below 80% in order to eliminate oil streaks. Also, it is clear that it is preferable to have an oil content above 30% in order to eliminate image luster unevenness in color copying. However, the image luster unevenness which occurred at 30% oil content is a permissible level for practical purposes.

From this result, it is clear that practically acceptable results can be obtained by controlling the oil content of oil holding layer 56 to 20–80% in volumetric percentage, and preferably 40–60% for better results, In other words, by holding such ranges, it is possible to achieve uniformity, stability and longevity of the oil coating process and maintain a good oiling condition for oil holding layer 56.

In this embodiment, therefore, the quantity and timing of supply of oil 44 into the inside of supply roller 53 are controlled in order to maintain the content of oil 44 contained in oil holding layer 56 to be within 4060% in volumetric percentage. This control is accomplished by controlling motor M of oil pump 60 by means of controller 15.

Controller 15, which can be a CPU and the like built into the main unit of a copying machine, etc., is essentially connected to motor M of oil pump 60 as shown in FIG. 4, detects the variance of the torque on motor M by a torque sensor (not shown) and the like, judges that the oil transfer is properly done to maintain a specified oil content if the torque variance range is within 10%, and takes necessary remedial actions judging that an abnormal circumstance has occurred such as excessive oil supply or oil shortage in the tank and take necessary remedial actions if the variance range is beyond 10%.

However, the initial oil content of oil holding layer 56 is set within the above-mentioned range by means of measuring the weight of supply roller 53 with oil holding layer 56 impregnated with oil 44 or other similar method. By taking such a step, the initial content of oil holding layer 56 can be set to 40–60%, and the supply of a specified amount of oil 44 begins at the specified timing when the number of sheet 10 which passed between fixing roller 20 and pressure roller 30 reaches a specified number.

As a result, the oil supply condition of this first embodiment is such that, as shown in FIG. 7, a certain amount of oil 44 is supplied intermittently for each specified number of sheets processed to maintain the oil content within a specified range of oil 44 in oil holding layer 56 does not become saturated.

The reason that a specific number of sheets is used as a control factor of controller 15 here in this first embodiment is because the maintenance of a copying machine is normally conducted based on the number of papers processed so that it makes sense to use it as a control factor.

According to an experiment, the amount of oil used for a single sheet 10 is between 10 and 15 mg, so that it requires 10–15 g of oil to process 1000 sheets.

Based on this finding, the quantity and timing of oil supply can be easily controlled by controller 15 using the number of processed sheets as a control factor assuming that the content of the oil held in oil holding layer 56 is 40–60%.

However, this invention is not limited to the use of such a control factor and other appropriate control factors can be sued as well. For example, since the number of processed sheets used as a control factor in this embodiment is the number of sheets applied to fixing roller 20 and coating roller 50, the number of revolutions of fixing roller 20 or the number of revolutions of coating roller 50 can be used a s control factor.

Figure 8:
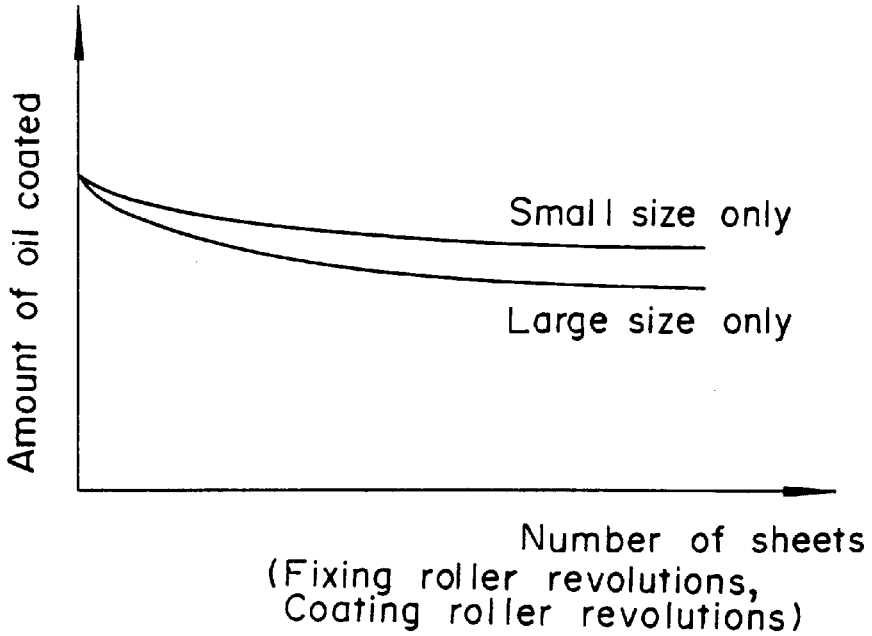
FIG. 8 is a graph showing the relations between the number of sheets and oil coating amount for different sheet sizes.

The information of the size of sheet 10 can also be used as a control factor. FIG. 8 shows the change in the amount of oil coated in case of a small size sheet 10 such as a B5 size and in case of a large size sheet 10 such as an A4 size. The amount of oil coated per each sheet decreases as the number of sheet processed increases, but such a tendency is more conspicuous when a larger size sheet 10 is used. This means that the size of sheet 10 can also be used as a control factor. The reason that the number of revolutions of fixing roller 20 and the number of revolutions of coating roller 50 are shown in a parenthesis in addition to the number of sheets processed on the horizontal axis is that the same result can be achieved by replacing the number of sheets processed with the number of revolutions of fixing roller 20 or the number of revolutions of coating roller 50.

It goes without saying that the number of revolutions of pressure roller 30 or supply roller 53 can be used in place of the number of revolutions of fixing roller 20 or coating roller 50.

It is also possible to use the paper feeding mode information as a control factor.

Figure 9:
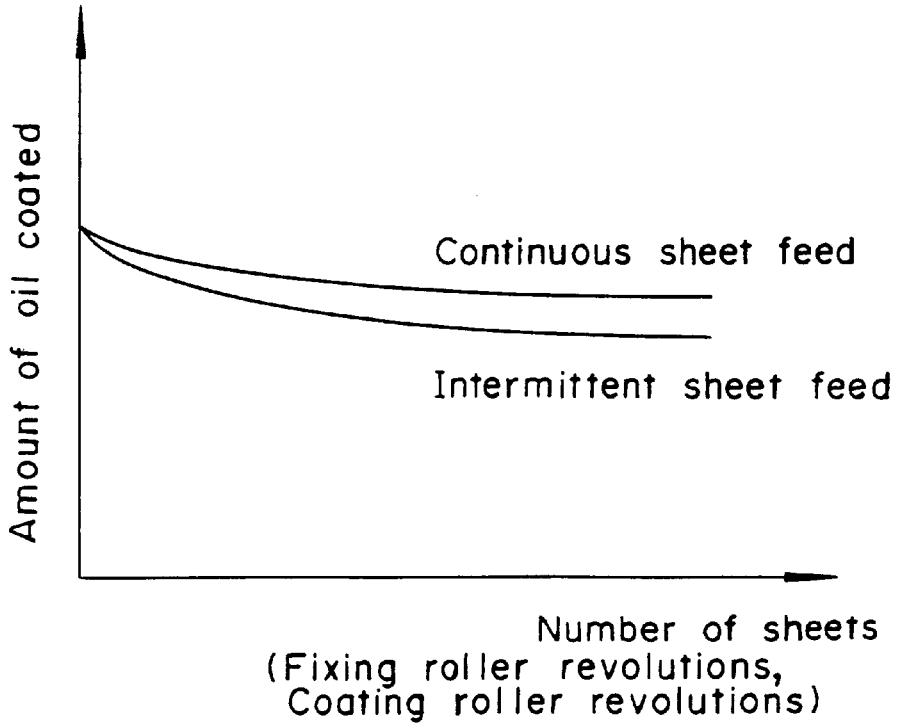
FIG. 9 is a graph showing the relations between the number of sheets and oil coating amount for different sheet feeding modes.

FIG. 9 shows the change in the amount of oil coated in case of the intermittent sheet feeding vs. the continuous sheet feeding. It shows again here that the amount of oil coated reduces as the number of sheets processed increases, and also that the tendency is more conspicuous in case of the intermittent sheet feeding, suggesting that the sheet feeding mode can also be used as a control factor, albeit via the number of sheets processed. Here again, the number of revolutions of fixing roller 20 and the number of revolutions of coating roller 50 are shown in parentheses in addition to the number of sheets processed on the horizontal axis, which means that the number of sheets processed can be replaced with the number of revolutions of fixing roller 20 and the number of revolutions of coating rollers 50 to achieve the same result.

The sheet feeding mode mentioned above not only means the intermittent sheet feeding and the continuous sheet feeding, but also the single side printing mode and the double side printing mode. In case of a double side printing, in particular, a sheet 10 which has passed once, passes again, and the oil quantity reduces in the second time. Because of this, it is meaningful to use the printing mode, i.e., the difference between the double side vs. single printing, as a control factor.

Moreover, the weight of coating roller 50 and supply roller 53 can be used as a control factor. It is because the weights of these rollers vary with the amount of oil coated.

Furthermore, it is also possible to use as the control factor a combination of multiple factors selected from the above-mentioned number of sheet passed through the fixing apparatus, the sheet feeding mode, the number of revolutions of the coating apparatus which comprises the coating roller, the weight of the coating roller, etc.

The operation of this embodiment of the invention will now be described.

In a copying machine and the like, unfixed toner images formed o a sheet 10 are fixed under pressure and heat between a fixing roller 20 and a pressure roller 30, wherein a portion of this unfixed toner is adhered to the surface of fixing roller 20 and can be retransferred on to next sheet 10, i.e., can cause offset phenomena. To prevent this problem, oil 44 is applied to the surface of fixing roller 20.

Oil 44 is conducted to oil coating device 41 by means of an oil transfer apparatus 46 and is applied to the surface of fixing roller 20 via a coating roller 50 driven by fixing roller 20.

Let us describe this process in further detail. Oil 44 is sucked out from an oil tank 45 by means of a pump 60 of an oil transfer apparatus 46, transferred to a supply nozzle 43 provided in a supply roller 53 tubes 61 and 62, and finally to be discharged from each discharge port 42 as droplets.

The droplets of oil 44 from this supply nozzle 43 are delivered in discrete droplets and spreads flat as it is absorbed by oil holding layer 56. Each of these discharge ports 42 of supply nozzle 43 has a uniform diameter opening and the holes are provided at specified intervals so that the amount of oil discharged from each discharge port 42 is uniform. Moreover, since supply roller 53 is driven by coating roller 50, when oil 44 is supplied in droplets evenly throughout the entire range of oil holding layer 56, squeezed out to a degree and spread out due to the pressured from coating roller SO, and transferred to coating roller 50 to be coated on fixing roller 20, fixing roller 20 becomes completely and evenly coated with the oil throughout its entire surface.

As a result, the toner attached to the surface of fixing roller 20 is removed by the interaction between oil 44 and cleaning roller 47.

However, when the apparatus stops its operation, oil 44 contained in oil holding layer 56 gathers at the lower area of holding layer 56 due to the gravity and may cause offset phenomena when it restarts its operation. To avoid this potential problem, the amount of oil in oil holding layer 56 is controlled to maintain oil holding layer 56 to operate always under an unsaturated condition. In other words, in this embodiment, the amount and timing of oil 44 supplied are controlled according to the information of the number of sheets 10 passed between fixing roller 20 and pressure roller 30.

FIG. 5 is a flow chart for the oil supply operation of this embodiment. In this embodiment, the number of sheets processed is counted by a sheet feeding counter (not shown) provided at a specified locations (Step 1), and a judgment is made whether the sheet feeding counter has reached a preset value (Step 2).

If the number of sheets processed has not reached the preset value, the control returns to the Step 1. If the preset value has be reached, as shown in FIGS. 6 and 7, it means that the oil in oil holding layer 56 has gradually reduced from the original content of 60% and has reached 40%, so that it has to be replenished.

Consequently, motor M is turned on (Step 3) and, as pump 60 operates, oil 44 is pressure-fed to oil supply layer 56. In other words, by adjusting the speed of motor M, the supply amount of oil 44 is controlled, and the timing of the start of motor M, i.e., the oil supply timing, is controlled based on the sheet feeding counter.

When the oil is pressure-fed, a torque is applied on motor M. When the torque change is judged to be below 10% (Step 4), it is assumed that the content of oil 44 of oil holding layer 56 has reached 60%, so that motor M is stopped and the sheet feeding counter is reset at Step 5 (Step 5).

If the torque change of motor M does not come down to below 10% despite the fact that the situation requires oil replenishing, it is assumed that an abnormal situation has occurred and a warning is sent out to prohibit the image forming operation (Step 6) and to stop the oil supply operation.

A situation where the torque change is not below 10% can occur when a specified amount of oil 44 cannot be supplied during the supply period of oil 44; for example, a high torque is generated on motor M, because the supply roller 53 is clogged up due to some reasons making it impossible to absorb oil 44, or an extremely low torque exists on motor M because oil 44 in the oil tank is emptied.

In such a case, controller 15 automatically issues the "prohibit image forming work" message and stops the operation at the same time. However, in some cases, it can be so constituted as to disregard the action of controller 15 by turning on enforcing switch 72 for forcibly supplying oil 44, or to reset the supply amount of oil 44 and the transfer timing counter by turning on enforcing switch 72.

By controlling the amount and the timing of the supply of oil 44 in such a way, the content of oil 44 in oil holding layer 56 varies within the range of 40–60%, and such a range of variation is acceptable for making oil coating apparatus 41 a practical unit.

Moreover, it is also possible to configure the unit as to reset the amount and timing of the supply of oil 44 when the coating apparatus is replaced as a result of the fact that supply roller 53 clogs up or oil 44 in the oil tank is emptied.

As described above, the releasing agent holding layer of this embodiment is maintained so that it is never saturated with the releasing agent, the embodiment prolongs the useful life of the releasing agent and makes the apparatus more compact and cost effective. It also provides a more uniform oil coating thus preventing image noises.

Figure 10:
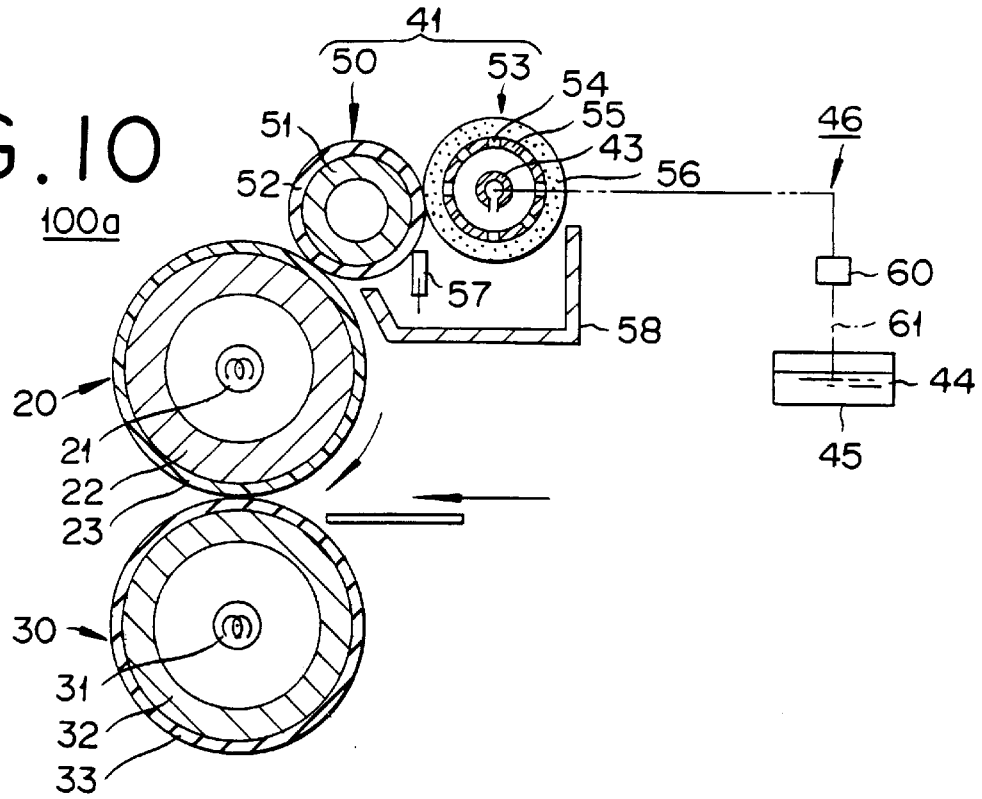
FIG. 10 is an outline schematic drawing of another version of the first embodiment.
Figure 11:
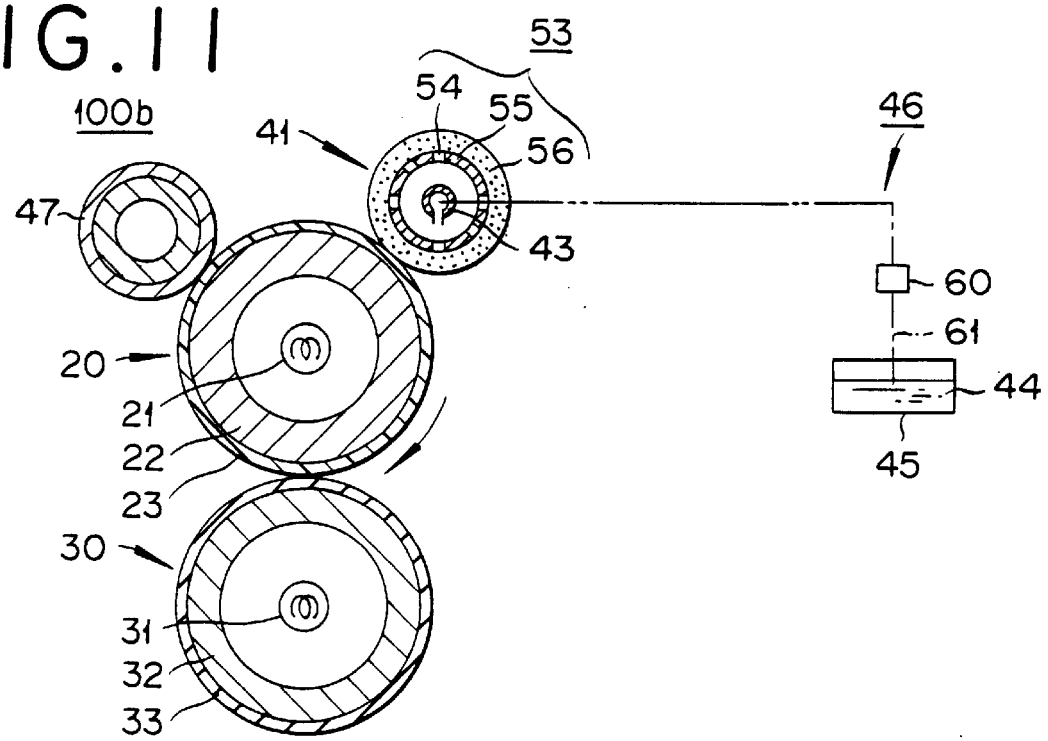
FIG. 11 is an outline schematic drawing of yet another version of the first embodiment.
Figure 12:
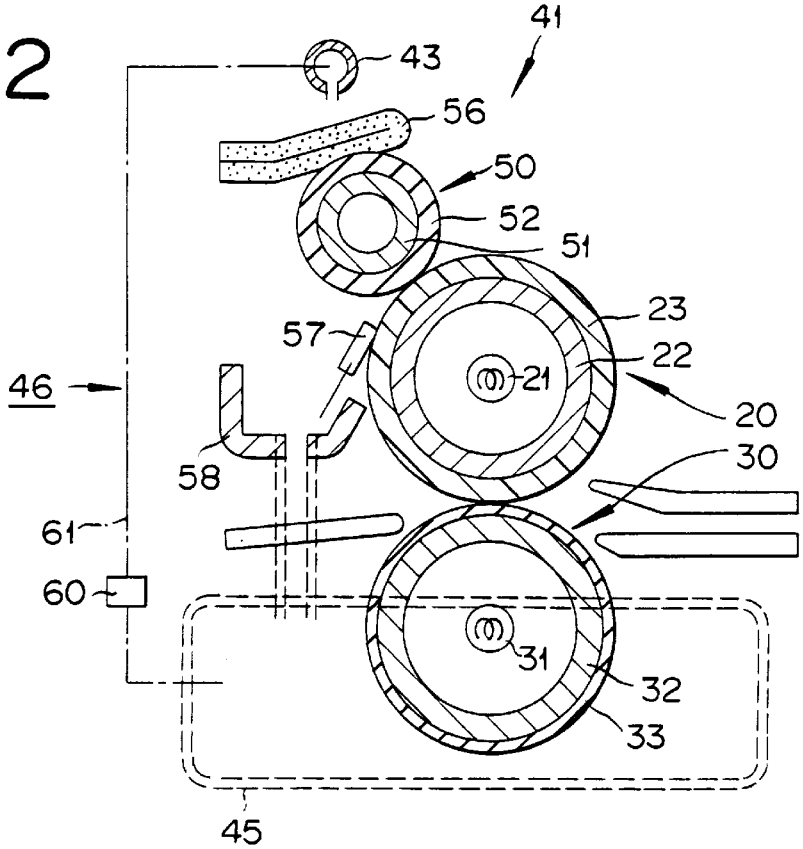
FIG. 12 is an outline schematic drawing of still another version of the first embodiment.

The controller can be built into systems such as shown in FIGS. 10, 11 and 12. In FIGS. 10, 11 and 12, members that are common with FIGS. 3 and 4 are identified by using the same symbols.

FIG. 10 is an outline schematic drawing of another version of the first embodiment.

The first embodiment has an advantage that it does not cause any oil leakage or dripping from oil holding layer 56, so that there is no need for providing an oil pan 58 beneath supply roller 53, thus making the apparatus's constitution simpler.

However, as a fail-safe means, it can have an oil pan 58 beneath supply roller 53 as shown in FIG. 10, or, in order to remove the oil that was left unapplied to fixing roller 20, an oil regulating blade 57 of a length approximately equal to the axial length of oil coating roller 50, and catch oil 44 removed by this oil regulating blade 57 with an oil pan 58. Oil 44 removed by oil regulating blade 57, which abuts on coating roller 50 is returned to an oil tank 45 via a collection route (not shown) after it is collected by oil pan 58.

FIG. 11 is an outline schematic drawing of yet another version of the first embodiment.

Since coating roller 50 is used as the coating layer of supply roller 53, oil coating apparatus 41 of the first embodiment uses two rollers. However, this invention does not necessarily require two rollers, and a single roller can do the job.

In this embodiment, supply roller 53 abuts directly on fixing roller 20 and coating roller 50 is not used. Even with such a simpler constitution, the oil can be transferred from oil holding layer 56 to fixing roller 20 without causing any offset because the oil content of oil holding layer 56 is maintained at a specified value.

FIG. 12 is an outline schematic drawing of still another version of the first embodiment.

In the aforementioned first embodiment and other versions, oil holding layer 56 was provided on the periphery of a roller. However, the invention does not necessarily require such a roller.

In the coating apparatus of this embodiment, an oil holding layer 56 is provided to abuts on coating roller 50 that is making contact with fixing roller 20 under pressure, and oil 44 drips from supply nozzle 43 to oil holding layer 56 to impregnate it. Oil holding layer 56 is made of a porous material such as sponge and felt.

Figure 13:
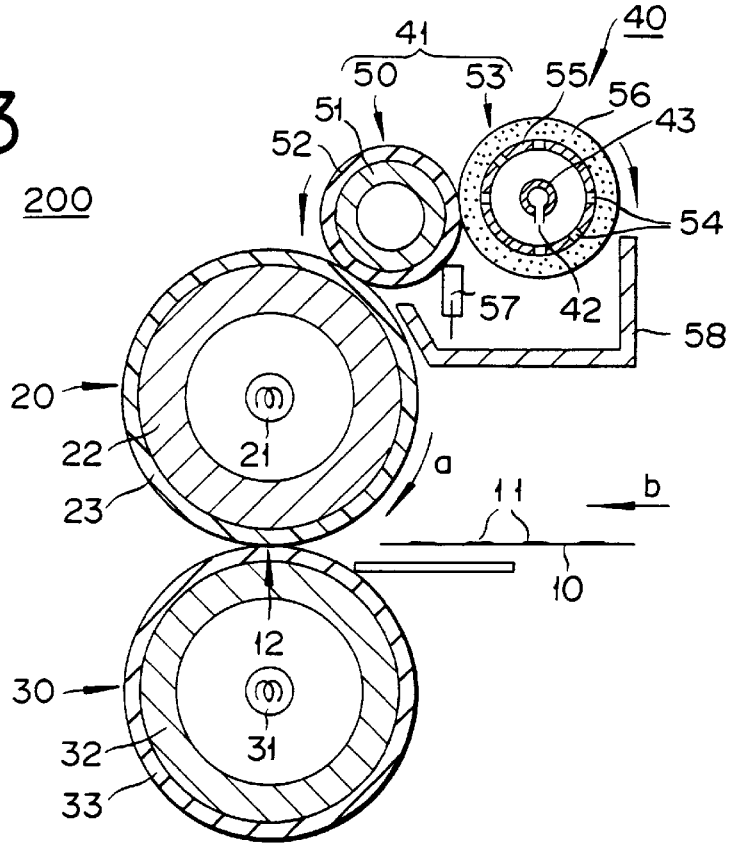
FIG. 13 is an outline schematic drawing of the second embodiment of this invention.

FIG. 13 is an outline schematic drawing of a fixing apparatus 200 representing the second embodiment of this invention. The members that are common with the aforementioned embodiments are identified using the same symbols and their descriptions are not repeated here.

Figures 14A, 14B:
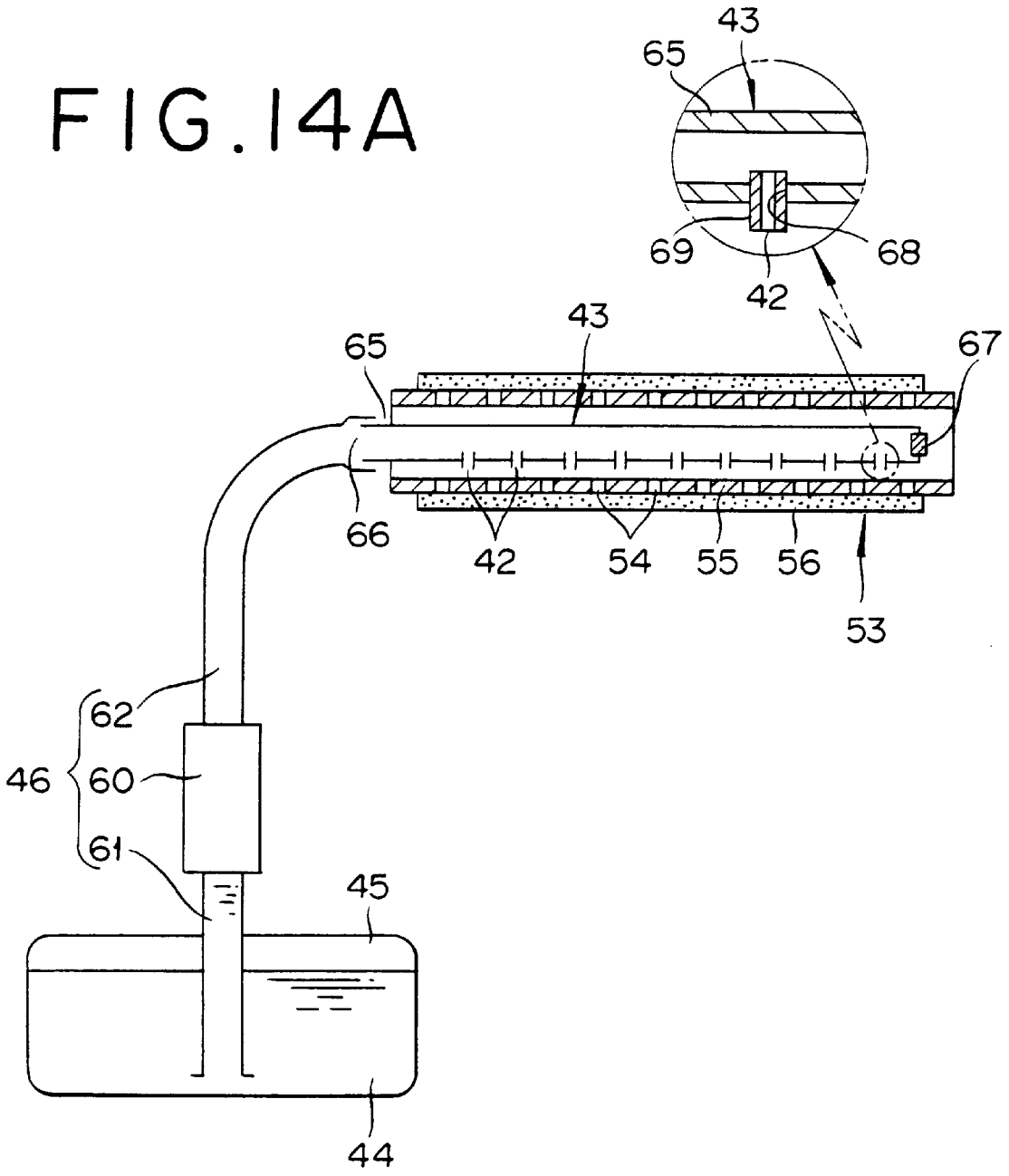
FIG. 14A is a schematic drawing, partially in cross section, of an oil coating mechanism.
FIG. 14B is an enlarged view of an oil discharge part.

As shown in FIGS. 13, 14A and 14B, in the fixing apparatus of the second embodiment, each of multiple holes 68 formed at specific intervals on a pipe 65 of a supply nozzle 43 is provided with a tube 69, which serves as droplet growth assisting member to let droplets drop immediately below each discharge port.

This tube 69 is inserted into and affixed in each discharge port 68, protruding outward from pipe 65. The length of tube that is inserted into pipe 65 can be about the thickness of pipe 65 or can be as much as to protrude intentionally into the bore of pipe 65. Depending on the difference in the protruding length of tube 69, there is a difference in the unintentionally leakage of oil 44, for example, the leakage of oil 44 can be prevented more effectively if pipe 65 is protruding into the bore of pipe 65 when the oil discharge is stopped.

The length of tube 69 is preferably less than 5 mm, and the inner diameter is set to 0.5–1.0 mm or so.

Figure 15A:
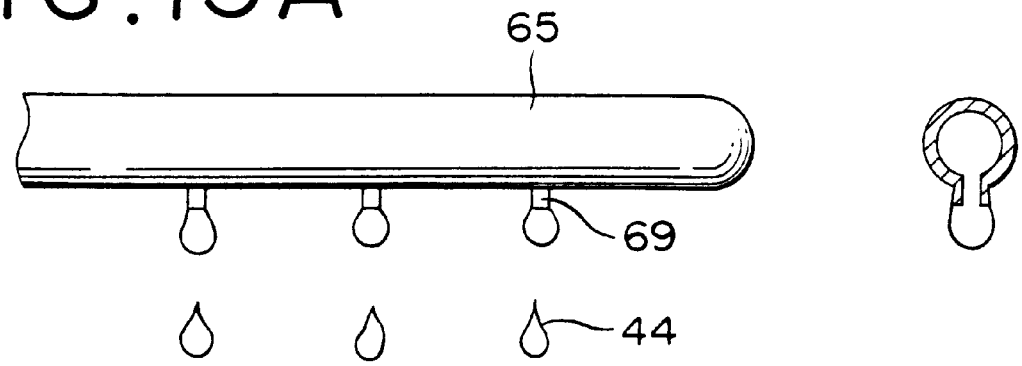
FIG. 15A and FIG. 15B are drawings which illustrate oil dripping actions.

FIG. 15A shows how oil 44 drips from tube 69, indicating that droplets grow at the tip of each tube 69 and drip at specified positions.

Figure 15B:
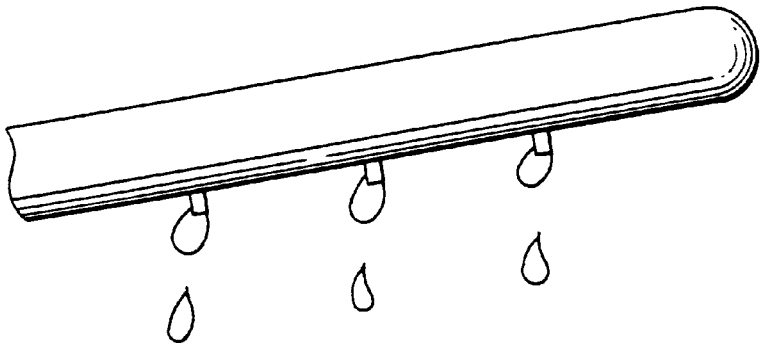

FIG. 15B shows a case where pipe 65 is tilted, showing that even with such a tilt of pipe 65 itself, droplets grow at the tip of each tube 69 provided on each discharge port 68 in a preferable manner. Thanks to these tubes 69, oil 44 exiting each discharge ports 68 is not attracted to the lower portion of the tilt but rather grow into droplets and the specified amount of oil drops in the specified position.

Oil 44 passes through the bore of tube 69 and forms a droplet at its open end until the droplet of oil 44 grows to a sufficient size to drop because of its own weight. The cross-sectional area of the open end of tube 69 determines the size of the droplet and the growth speed which result in the intended rate of dripping at the intended location.

Thus, it is possible to achieve the discharge of the releasing agent at the intended location irrespective of the tilt of the nozzle, hence providing a uniform releasing agent supply over the entire range in the axial direction of the releasing agent supply nozzle. Also, by minimizing the droplet's area of contact with the releasing agent nozzle, it is possible to control dripping of small droplets freely, and accomplish a finer releasing agent supply control. Thus, it is possible to provide a fixing apparatus that can prevent image noises.

Next, let us describe alternative examples of droplet growth assisting members according to this embodiment.

Figure 16A:
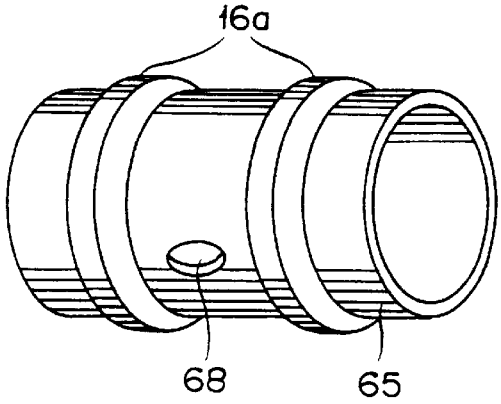
FIG. 16A and FIG. 16B are drawings which illustrate other versions of droplet growth assisting member.

An example shown in FIG. 16A shows an alternative design of the droplet growth assisting member having a dyke-like protrusion 16*a* instead of tube 69 in FIG. 14B in the vicinity of a discharge port 68. When oil 44 reaches dyke-like protrusion 16*a* after exiting discharge port 68, oil 44 gathers at the peak area of dyke-like protrusion 16*a* and the corner areas to cause droplets to grow. The size of the droplet and the speed can be controlled by the protruding height of dyke-like protrusion 16*a* from the outer circumference of pipe 65. By providing multiple dyke-like protrusions 16*a*, the intended droplet growth can be realized regardless of whether oil 44 exiting discharge port 68 flows toward right or left of the axial direction of pipe 65.

Figure 16B:
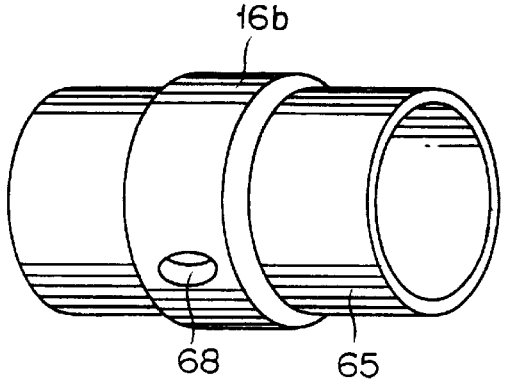

What is shown in FIG. 16B is a dyke-like protrusion 16*b*, which has a similar shape as the aforementioned dyke-like protrusion 16*a*, except that it has a discharge port 68 provided on the peak area thereof. In case of this dyke-like protrusion 16*a*, oil 44 pours out through discharge port 68 of the peak area, spreads out across the peak, and forms a growing droplet when it reaches the corner areas of dyke-like protrusion 16*b*. When a droplet reaches a certain size, it drops to provide a specified amount of oil 44 at a specified location.

The height of these dyke-like protrusions 16*a* and 16*b* above pipe 65 is preferably 2 mm or so, and the width is desirably 2 mm or so.

Figure 17A:
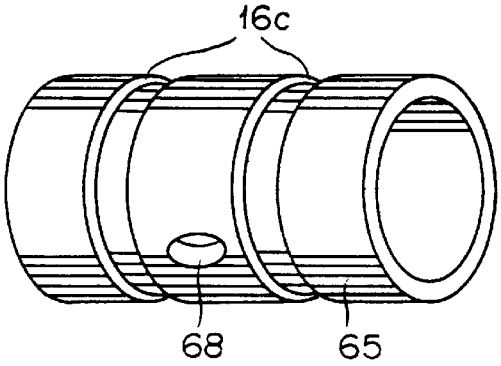
FIG. 17A and FIG. 17B are drawings which illustrate yet other versions of droplet growth assisting member.

The design shown in FIG. 17A is another alternative example of the droplet growth assisting member, wherein grooves 16*c* are provided on the periphery of pipe 65 in the vicinity of a discharge port 68. When oil 44 reaches groove 16*c* after exiting hole 68, oil 44 gathers at the bottom and the comers of groove 16*c* to cause droplets to grow. By controlling the width of groove 16*c* from the periphery of pipe 65, the size of the droplet and the growth speed can be controlled. Also, by providing multiple grooves 16*c*, the intended droplet growth can be achieved irrespective of whether oil 44 discharged from discharge port 68 flows left or right along the axial direction of pipe 65.

Figure 17B:
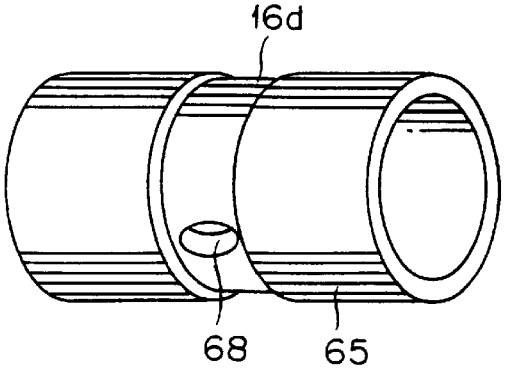

What is shown in FIG. 17B is a groove 16*d*, which has the same shape as groove 16*c* described above except that it has a discharge port 68 on the bottom. In case of this groove 16*d*, oil 44 exits discharge port 68 on the bottom and spreads through the bottom and it starts to form droplets when it reaches the comers of groove 16*d*. When the droplets reaches the specified size, it drops to the intended position thus accomplishing the supply of oil 44.

It is preferable that the depths of these grooves 16*c* and 16*d* from the periphery of pipe 65 are about 1 mm, and the widths are about 2 mm.

Figure 18A:
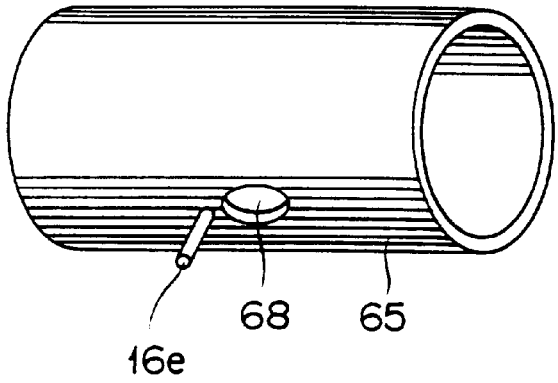
FIG. 18A, FIG. 18B and FIG. 18C are drawings for still other different versions of droplet growth assisting member.

What is shown in FIG. 18A is a design where another alternative example of the droplet growth assisting member, a rod-like protrusion 16*e*, is provided close to a discharge port 68 provided on the periphery of pipe 65. After exiting discharge port 68, oil 44 reaches rod-like protrusion 16*e* and flows toward the tip of rod-like protrusion 16*e*, the extension of rod-like protrusion 16*e* from the periphery of pipe 65, or the shape of the tip of rod-like protrusion 16*e*. Also, by providing multiple rod-like protrusions 16*e*, the intended droplet growth is obtainable even if oil 44 flows freely without any guidance from the surrounding of discharge port 68.

Figure 18B:
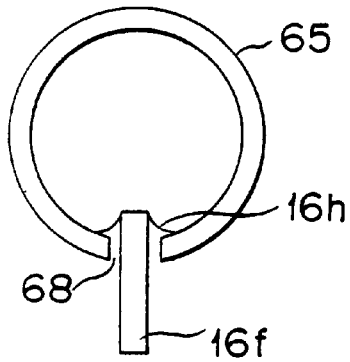

It is preferable that the length of rod-like protrusion 16*e* is about 3 mm and its thickness is about 1 mm, and it can be constituted that the shape of its tip is conical, needle-like, or flat FIG. 18B shows a cross-sectional view of a design wherein a pin 16*f*, which is inserted into a discharge port 68, is used instead of rod-like protrusion 16*e*. The thickness of pin 16*f* is chosen to be smaller than the opening diameter of discharge port 68 to create a small gap. Oil 44 can be discharged from the inside of pipe 65 because of this gap and oil 44 flows along pin 16*f* to reach its tip. There oil 44 forms a droplet and the droplet drops when it reaches the dropping weight. By selecting the thickness and the shaped of the tip of pin 16*f* properly, a proper size of droplets can be easily obtained. The length of the pin should preferably be about 5 mm.

At the rood of the inserted pin 16*f*, a claw 16*h* is provided to latch with the inner wall of pipe 65 to prevent the pin from falling off. In order to prevent pin 16*f* from sinking into the inside of pipe 65, a flange (not shown) may be provided in the middle of pin 16*f*.

Figure 18C:
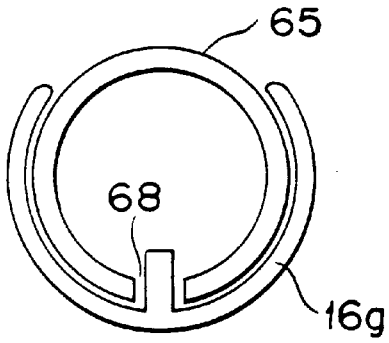

FIG. 18C shows a cross section of another example of the droplet growth assisting member, wherein a clip 16*g* approximating a C-ring is used. This clip 16*g* is generally formed in a C-shape, of which the inner arc area fits on the periphery of pipe 65. The middle point of this inner arc area has a protrusion and this protrusion is inserted into discharge port 68. This protrusion is made smaller than the diameter of the opening of discharge port 68, so that oil 44 can be freely discharged from the inside of pipe 65. Oil 44 flows along this protrusion and forms droplets at the tip of clip 16*g*. A droplet drops when it reaches a dropping weight.

The embodiments described above can be modified arbitrarily. For example, while dyke-like protrusions 16*a* and 16*b* as well as grooves 16*c* and 16*d* are described as being provided on the entire circumference of pipe 65, they can be provided only on the periphery in the vicinity of discharge port 68 to achieve a similar effect.

Figure 19:
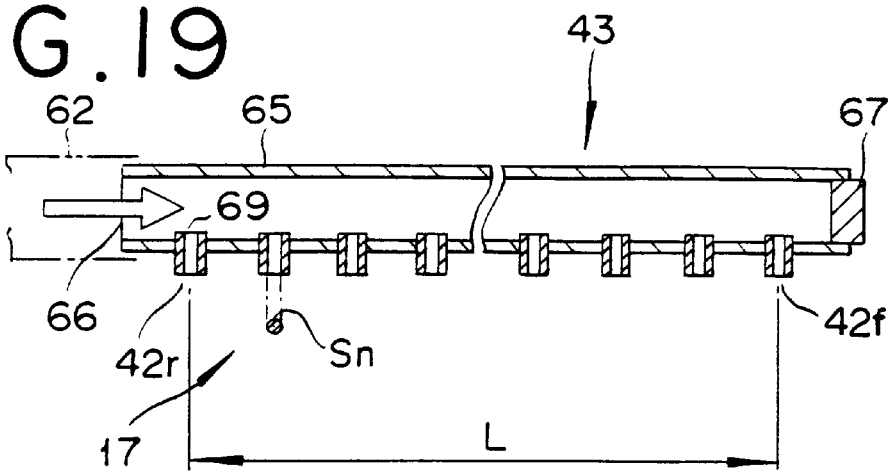
FIG. 19 is a schematic drawing of a nozzle used for explaining the formula (1) in the third embodiment of this invention.

FIG. 19 is a schematic drawing of a nozzle used for explaining the formula (1) in the third embodiment of this invention. The components that are common to those used in fixing apparatus 200 in the aforementioned embodiment are identified by the same symbols and their explanations are not repeated here.

Supply nozzle 43 in this third embodiment is equipped with an equalizing member which is to equalize the amount of oil coated on fixing roller 20 along the lengthwise direction of the roller by equalizing the amount of oil discharged from each of discharged from each of discharge ports 42.

The equalizing member used in this invention is intended to equalize the amount of oil discharged from each discharge port 42 by making the oil pressure acting on all discharge ports 42 approximately equal. It can be divided into the following five categories depending on specific configurations, i.e., (A) the configuration which defines the bore of the discharge ports, where they are located, tilting angles, etc.; (B) the configuration which includes a means of opening or closing the discharge port of the supply nozzle; (C) the configuration which has both ends of the supply nozzle opened; (D) the configuration wherein an oil supply port is provided within a range where the discharge ports are formed; and (E) the configuration wherein the total opening cross sectional area at each of the discharge locations varies, although the discharge holes themselves provided at those locations have approximately equal opening cross sectional areas. Specific designs of these equalizing members are described as follows.

First, let us explain an example of equalizing member 17 of the aforementioned case (A) wherein the discharge port diameter and others are specified.

This equalizing member 17 is configured to form a supply nozzle 43 satisfying the following formula (1):

$$10 \leqq L \cdot Sn \leqq 180 \quad (1)$$

where,

L: an effective discharge width of supply nozzle 43 (distance between two discharge ports 42 located on both ends), and Sn: opening cross-sectional area per each discharge hole 42.

The above formula (1) is to determine the upper limit from the standpoint of the uniformity of the amount of the oil discharged along the lengthwise direction of supply nozzle 43 and also to determine the lower limit from the standpoint of the amount of oil to be discharged for the prevention of the offset prevention.

As mentioned above, oil 44 is transported from supply port 66 at one end of pipe 65 through pipe 65 and discharged from multiple discharge ports 42. The effective discharge width L of supply nozzle 43 is the distance between discharge port 42 f, which is at the front end (the rightmost hole in the drawing) and 42 r, which is at the rear end (the leftmost hole in the drawing). The opening cross-sectional area Sn per each discharge port 42 is the opening cross section of tube pipe 69.

The condition ofsupply nozzle 43 used in the experiment is as follows:

Supply nozzle 43

Pipe: Ø6.0 mm stainless tube with a wall thickness of 0.5 mm

Discharge port: Stainless tube

Bore: Ø0.1 mm–Ø2.0 mm

Pitch: 12 mm

Effective discharge width L: 72–276 mm

Oil: Dimethyl silicon oil with kinematic viscosity 100 cSt

Pump: Tube pump

Figure 20:
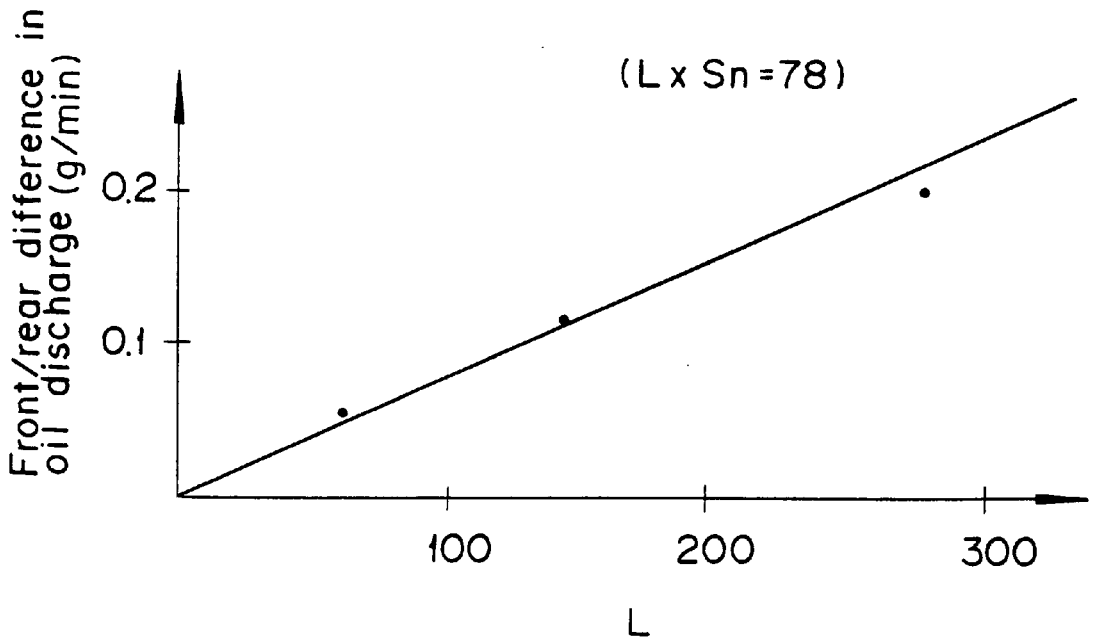
FIG. 20 is a graph showing the effects of the effective discharge span and the cross-sectional area of the opening of each hole on the difference between the oil quantities discharged from the foremost discharge port and from the rearmost discharge port (:Front/rear difference in oil discharge')

As a fluctuation of the oil pressure that applies on each discharge port 42 increases, the fluctuation of the amount of oil discharged from each discharge port 42 increases. It can be concluded that the factors that affect the fluctuation of the oil pressure include the distance from supply port 66 of pipe 65 to a particular discharge port 42 and the opening cross-sectional area of discharge port 42. FIG. 20 is a graph that shows the effects of the effective discharge width L and the opening cross-sectional area Sn per each discharge port 42 on the difference between the amount of oil discharged from the foremost discharge port 42*f* and the amount of oil discharged from the rearmost discharge port 42*r* (hereinafter called "front/rear difference in oil discharge"). It shows a case wherein the effective discharge width L is changed while selecting the opening cross-sectional area Sn to maintain the L•Sn constant (L•Sn=78). As is obvious from this graph, the two factors, i.e., the effective discharge width L and the opening cross-sectional area Sn, substantially affect the front/rear difference in oil discharge.

Figure 21:
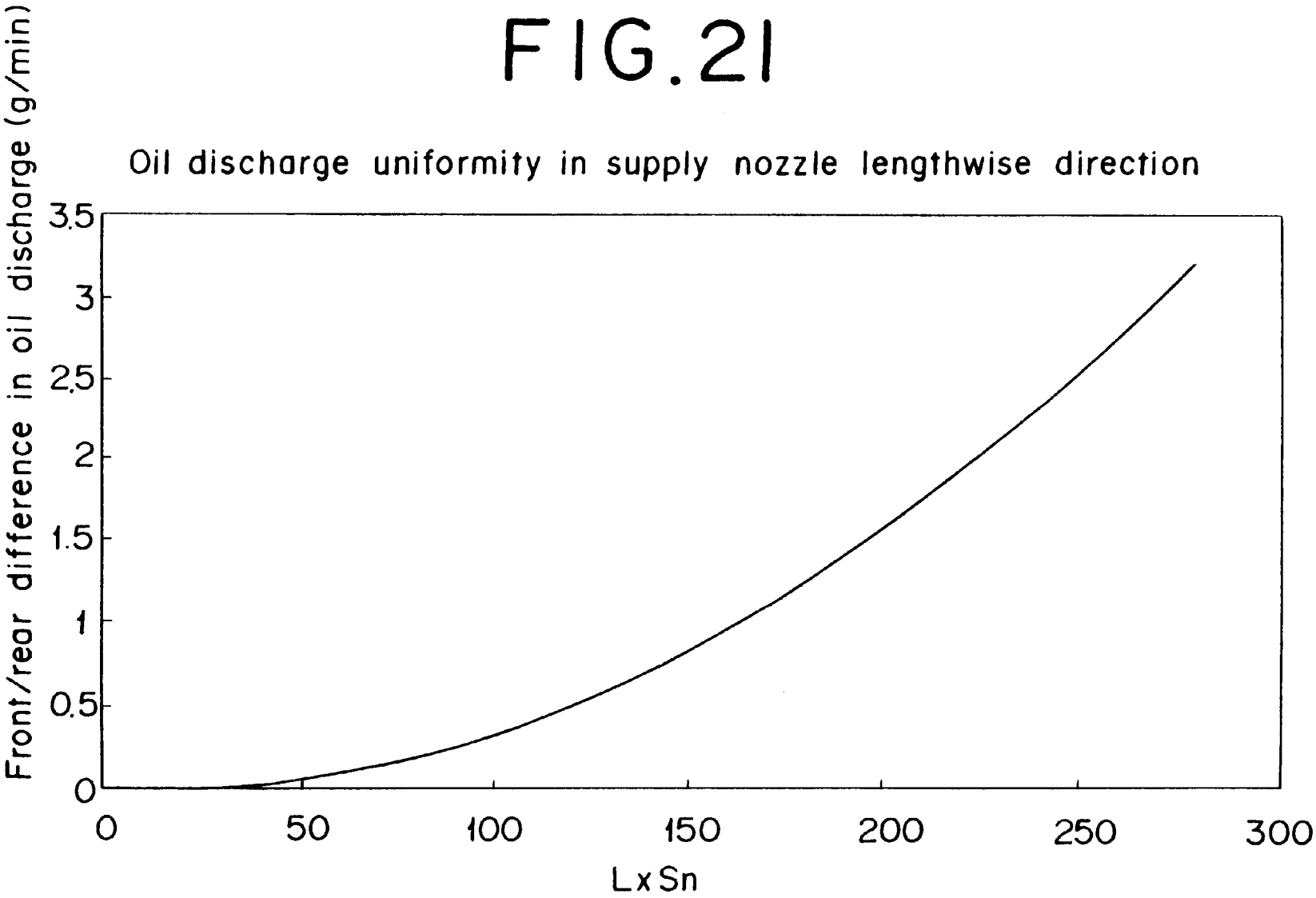
FIG. 21 is a graph showing the relation between LSn and fluctuation of foremost vs. rearmost hold oil discharge.

The relation between the L Sn and the front/rear difference in oil discharge in as shown in the following Table 2 and FIG. 21. Table shows the presence/absence of oil streaks and image luster unevenness. FIG. 21 is a graph showing the uniformity of the oil discharge along the lengthwise direction of supply nozzle 43, where the horizontal axis represents the L•Sn and the vertical axis represents the front/rear difference in oil discharge.

Table 2

| Front/rear difference In oil discharge (g/min) | Existence of oil streaks | Existence of image luster unevenness | L · Sn |
|---|---|---|---|
| 0.003 | -- | -- | 20 |
| 0.20 | -- | -- | 80 |
| 0.42 | -- | x | 110 |
| 1.30 | -- | x | 175 |
| 2.04 | x | x | 220 |
| 4.42 | x | x | 310 |

x: exist
--: not exist

From the above observation results, it was learned that the relation L•Sn≅180 must hold in order to prevent the occurrence of oil streaks. Although the image luster unevenness that occurred within this range are of the tolerable level from the practical standpoint, it is preferable to satisfy the relation L•Sn≅90 in order to eliminate this image luster unevenness completely.

Figure 22:
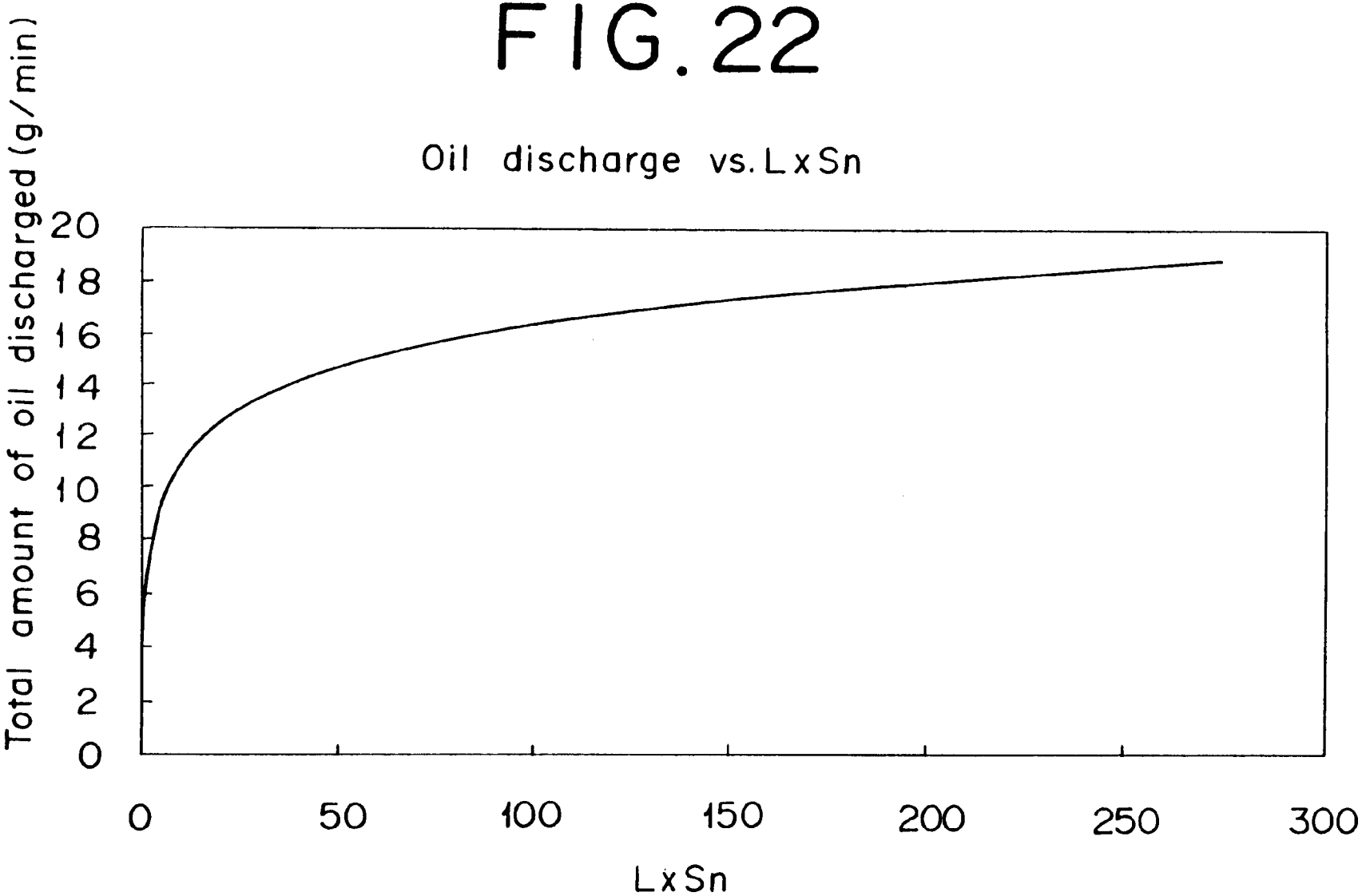
FIG. 22 is a graph showing the relations between LSn and the total oil discharge.

Next, let us show the relationship between L•Sn and the total amount of oil discharged in Table 3 below and FIG. 22. Table 3 shows the observation results on whether any offsets occurred when an excessive amount of oil was coated and if there was any oil leakage from oil pump 60.

TABLE 3

| Total oil discharge (g/min) | Existence of offset | Oil leakage from oil pump | L · Sn |
|---|---|---|---|
| 10.5 | x | x | 8.8 |
| 12.4 | slightly x | -- | 19.5 |
| 13.8 | -- | -- | 34.7 |
| 14.9 | -- | -- | 54.2 |

x: exist
--: not exist

From the above observation results, it was learned that the relation 10≅L•Sn must hold in order to prevent the occurrence of oil leakage from oil pump 60. Although the offsets generated slightly within this range are of the tolerable level from the practical standpoint, it is preferable to satisfy the relation 20≅L•Sn in order to eliminate this occurrence of offsets completely.

Consequently, it was learned that the total oil discharge required to maintain a uniform discharge of oil along the longitudinal direction of supply nozzle 43 and to prevent offsets, the following relation must hold:

$$10 \leqq L \cdot Sn \leqq 180 \quad (1)$$

or more preferably $$20 \leqq L \cdot Sn \leqq 90 \quad (1a)$$

by forming supply nozzle 43 as shown in the formula (1) or (1a), the oil will be coated evenly on fixing roller 20 along the axial direction and the image noise occurrence can be prevented.

Next, the effect of the total number of discharge pores 42 on the front/rear difference in oil discharge was studied. The result is shown in Table 4. L•Sn was set to 54.

TABLE 4

| | | Discharge port pitch (mm) | |
|---|---|---|---|
| | | 12 | 18 |
| a | Total oil discharge (g/min) | 14.9 | 14.4 |
| b | Oil discharge per discharge port (g/min) | 0.65 | 0.97 |
| c | Front/rear difference in oil discharge (g/min) | 0.08 | 0.12 |
| | Front/rear ratio c/b (%) | 12 | 12 |

As is obvious from the above, the front/rear ratio remains at 12% irrespective of the change in the total number of discharge ports 42 and the number of discharge ports 42 does not affect the front/rear difference in the oil discharge. Consequently, it was learned that supply nozzle 43 should be designed to satisfy the formula (1) or (1a) irrespective of the total number of discharge ports 42.

As such, this embodiment provides an excellent fixing apparatus that is compact, cost effective and capable of supplying releasing agents from the supply nozzle evenly and in a stable manner, preventing such image noises as oil streaks, offsets and image luster unevenness.

Figure 23:
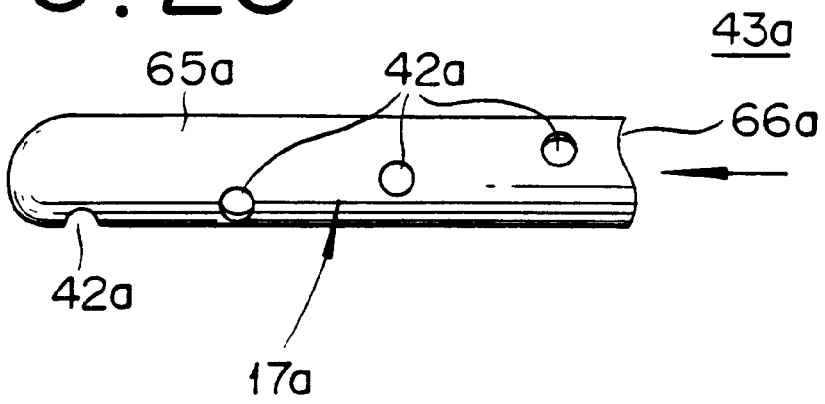
FIG. 23 is a schematic drawing of another version of an equalizing member.
Figure 24:
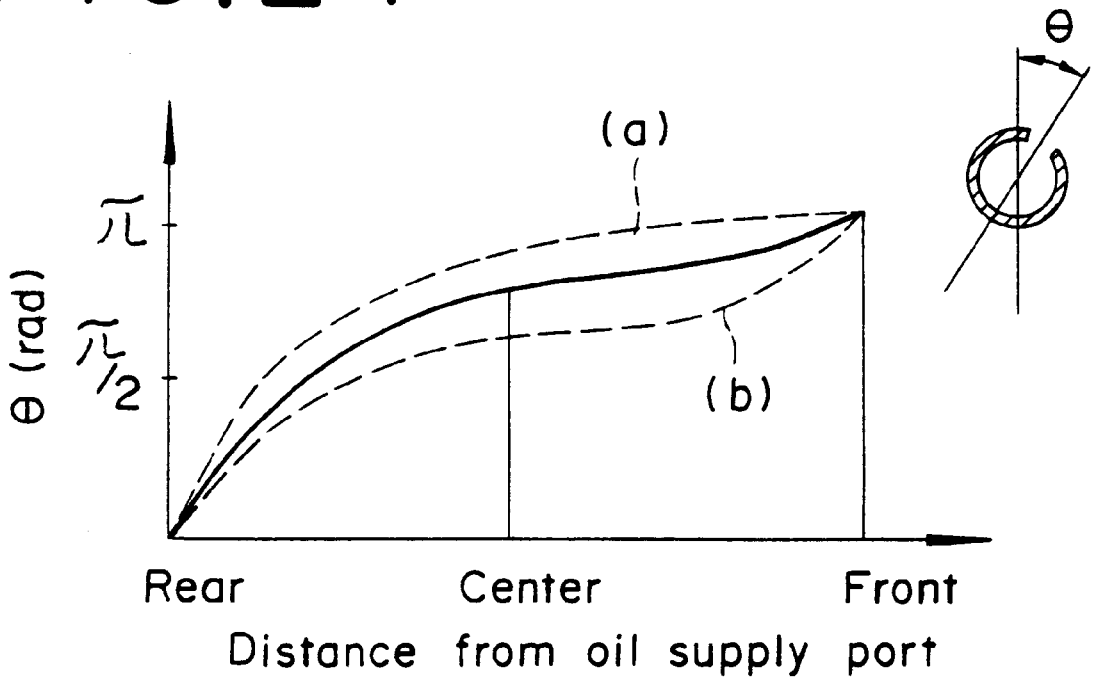
FIG. 24 is a graph showing the height of a discharge port relative to an oil supply roller.

FIG. 23 is a schematic drawing of another version of equalizing member. As shown in FIG. 23, the equalization member 17*a* of the case (A) can be constituted by arranging multiple discharge ports 42*a* in such a way that their heights relative to oil supply roller 53 as a coating apparatus vary along the longitudinal direction. Oil 44 delivered by oil transfer apparatus 46 to a supply nozzle 43*a* is transported from a supply port 66*a* provided at one end of a pipe 65*a* into pipe 65*a*. The height of discharge ports 42*a* relative to oil supply roller 53 gradually lowers, as shown in FIG. 23 as they move away from supply port 66*a* towards the front end. The solid line in FIG. 24 is drawn by interpolating the two curves expressed by two formulas:

$$\theta = a \cdot \ln x + b \quad (a)$$

$$\theta = (\pi / a)x + \sin(2\pi / a) \quad (b)$$

where a and b are constants, and x is a distance from the supply port.

Such am equalizing member 17*a*, by having discharge ports 42*a* formed in such a way that they lower their positions as they move toward the front end of supply nozzle 43*a*, the depth of the oil becomes deeper and compensates the pressure loss based on the distance from supply port 66*a* to each discharge port 42*a*, thus making the pressure acting on all discharge ports 42*a* approximately equal.

Figure 25:
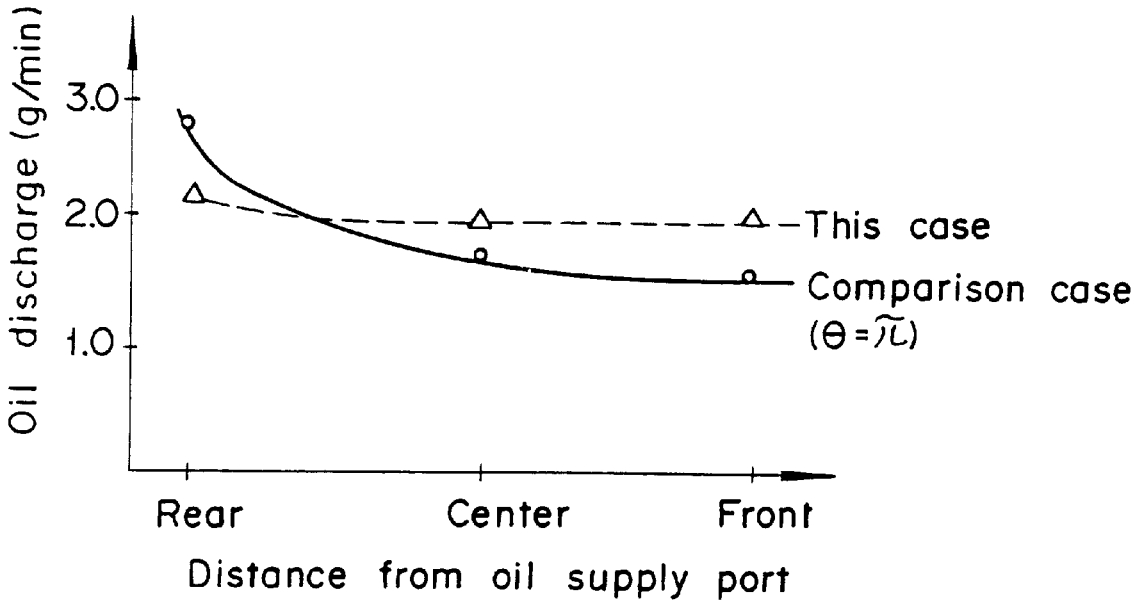
FIG. 25 is a graph showing the relations between the distance of an oil discharge port and the oil discharge at that position.

FIG. 25 is a graph showing the relationship between the distance of an oil discharge port 66*a* and the oil discharge at that position. This graph also shows a comparative example supply nozzle wherein all discharge ports are opening downward ( =”). As is clear from the graph, in contrast to the example wherein all discharge ports are opening downward, the amount of oil discharged from discharge ports are opening downward, the amount of oil discharged from discharge ports 42*a* at the rearmost, middle and foremost positions are approximately equal in case of equalizing member 17*a* with discharge ports 43*a*. As a result, the oil is uniformly applied on fixing roller 20 along the axial direction and prevents it from causing image noises.

Figure 26:
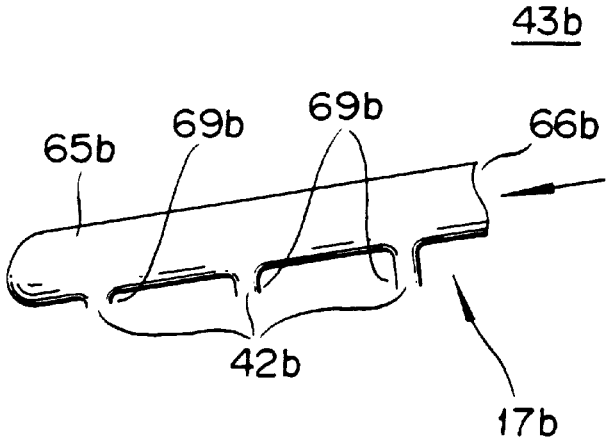
FIG. 26 is a schematic drawing showing yet another version of an equalizing member.

FIG. 26 is a schematic drawing showing yet another version of equalizing member. As shown in FIG. 26, equalizing member 17*b* of the case (A) can be constituted by simply tilting a supply nozzle 43*b*. Oil 44 delivered by oil transfer apparatus 46 to a supply nozzle 43*b* is transported from a supply port 66*b* provided at one end of a pipe 65*b* into pipe 65*b*. Pipe 65*b* of supply nozzle 43*b* is tilted along the lengthwise direction in such a way as to make the forward end lower. While pipe 65*b* itself is tilted, it is preferable to maintain the height of discharge ports 42*b* approximately equal relative to oil supply roller 53 by adjusting the lengths of tubes 69*b*.

With such an equalizing member 17*b*, by keeping the front side of supply nozzle 43*b* lower, the oil depth increases toward the front end of tube 69*b* and compensates the pressure loss due to the distance from supply port 66*b* to each of tubes 69*b*, thus equalizing the oil pressure at each discharge port 42*b*. Also, by shortening the length of tube pipe 69*b* toward the front end, the resistance of the tube decreases toward the front end, which also contributes in equalization of the oil pressure acting on each discharge port 42*b*.

Figure 27:
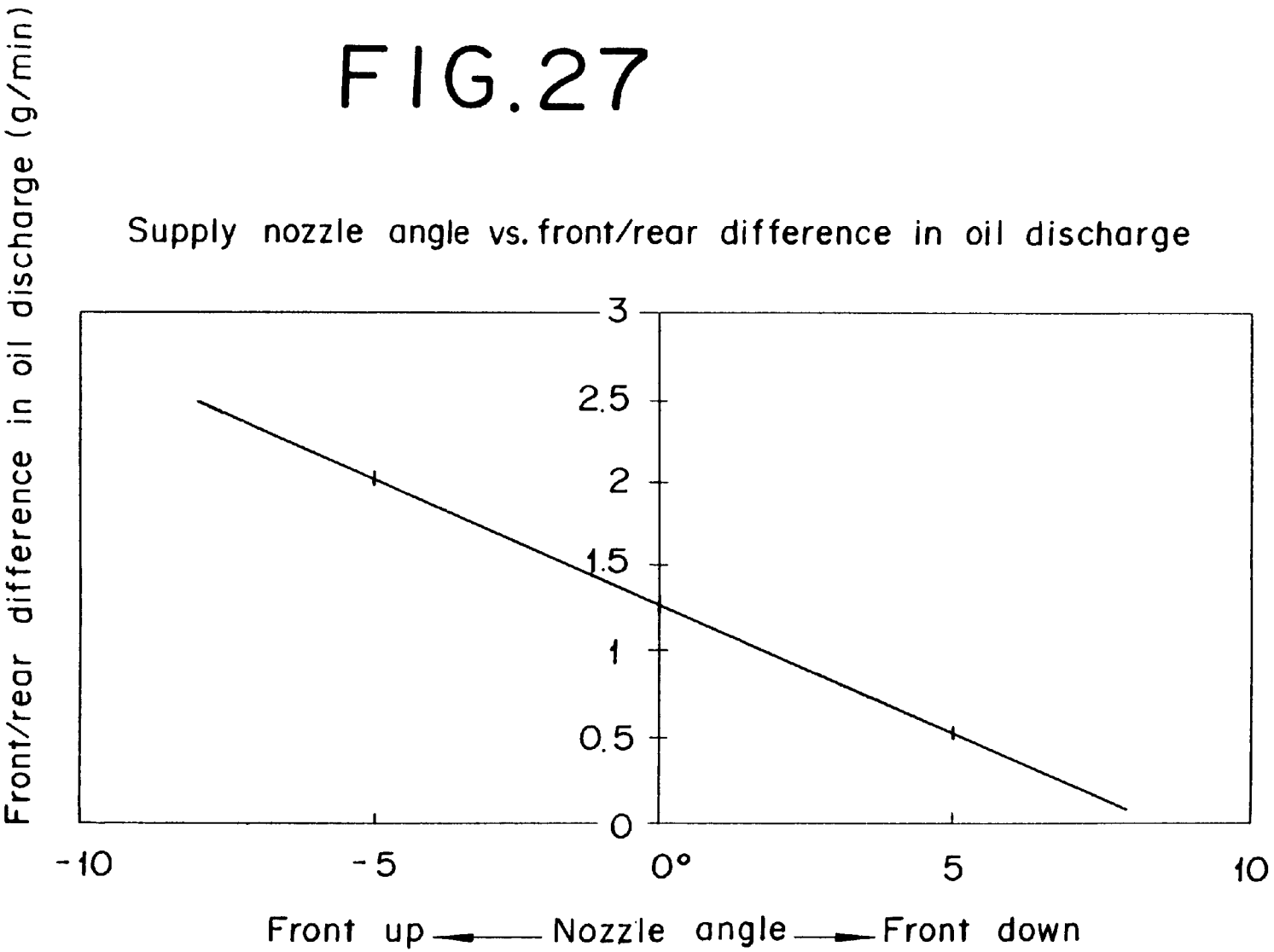
FIG. 27 is a graph showing the relations between the tilt angle of a supply nozzle and the front/rear difference in oil discharge.

FIG. 27 is a graph showing the relationship between the tilt angle of a supply nozzle 43*b* and the front/rear difference in oil discharge. As shown in the figure, by making supply nozzle 43*b* tilt down toward its forward end from the horizontal position with a tilt angle of 3–5 degrees, the fluctuation of the oil discharge was able to be maintained in a relatively small range of 0.5–1.0 g/min. Therefore, the quantity of oil coated on fixing roller 20 was maintained uniformly along the axial direction thus succeeding in preventing oil streaks and suppressing image luster unevenness with a tolerable range from the practical standpoint (refer to the aforementioned Table 2).

Next, let us describe another example of the equalizing member, the aforementioned case (B), wherein a means of opening and closing a discharge port 42*c* of a supply nozzle 43*c* is provided.

Figure 28:
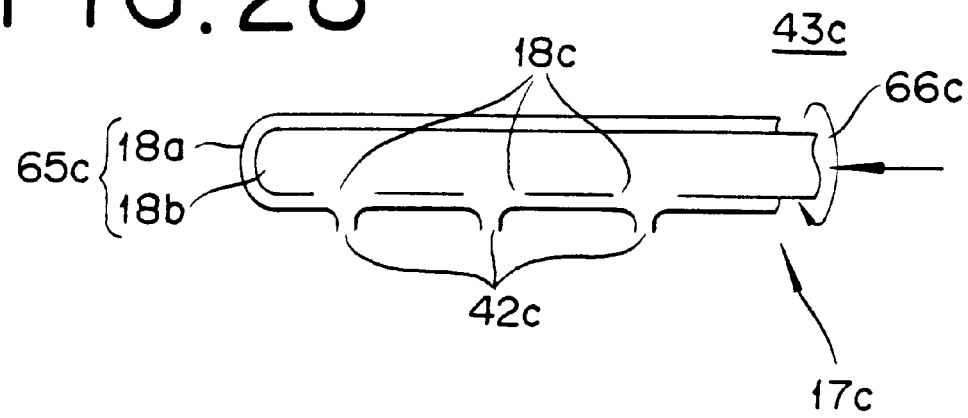
FIGS. 28 through 33 are schematic drawings of various other version of the equalizing member.

FIG. 28 is another alternative design of the equalizing member. As shown in FIG. 28, equalizing member 17*c* comprises multiple discharge ports 42*c*. With a pipe 65*c* of supply nozzle 43*c* constituted as a double-wall structure, a discharge port opening/closing apparatus opens and closes discharge port 42*c* by means of a relative motion of the double-walled structure. In more detail, pipe 65*c* of supply nozzle 43*c* comprises a double-walled structure consisting of an outer pipe 18*a*, which forms discharge port 42*c*, and an inner pipe 18*b* that slides inside said outer pipe 18*a*. Inner pipe 18*b* has a communicating port 18*c* formed thereon at a location which corresponds to discharge port 42*c*, and oil 44 is transferred from supply nozzle 43*c* by oil transfer apparatus 46 into inner pipe 18*b* through supply port 66*c* provided at one end is of inner pipe 18*b*. While outer pipe 18*a* is provided in a non-rotating condition, inner pipe 18*b* is freely rotatable. By rotating and translating inner pipe 18*b*, communicating ort 18*c* communicates with discharge port 42*c* to open discharge port 42*c*, allowing the oil to be discharged through communicating hole 18*c* and discharge port 42*c*. When inner pipe 18*b* rotates and translates from this position, the wall of the inner pipe 18*b* closes discharge port 42*c*.

Inner pipe 18*b* is controlled of its motion to open discharge port 42*c* just when the oil pressure inside inner pipe 18*b* reaches a specified pressure. This timing is determined by setting a certain time period after the start of oil pump 60, or by detecting that the oil pressure has reached a certain preset pressure by a sensor.

With such an equalizing member 17*c*, discharge ports 42*c* open after the oil pressure inside inner pipe 18*b* has reached a specific pressure, so that the oil pressure acting on each discharge port 42*c* becomes approximately constant and the front/rear difference in oil discharge will be kept minimum. As a result, the oil is uniformly applied on fixing roller 20 along the axial direction and prevents it from causing image noises.

Next, let us describe another example of the equalizing member, the aforementioned case (c), wherein both ends of supply nozzle 43 d are opened.

Figure 29:
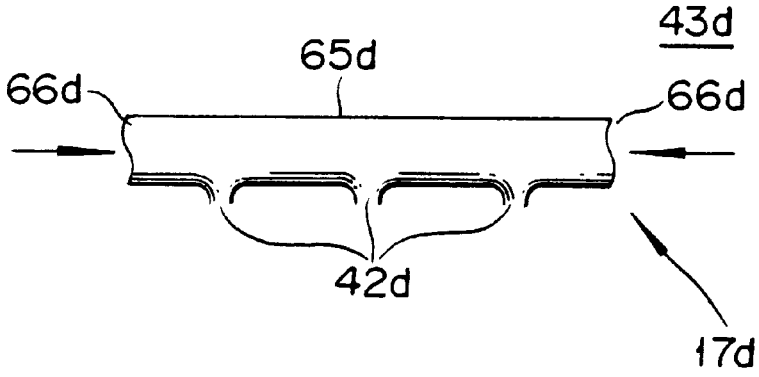

FIG. 29 is a schematic drawing of another example of the equalizing member. As shown in FIG. 29, this equalizing member 17*d* is so constituted that the oil is supplied to supply nozzle 43*d* from several places. More specifically, both ends of pipe 65*d* are opened to form supply ports 66*d* and oil 44 delivered to supply nozzle 43*d* by oil transfer apparatus 46 is transferred through both ends of pipe 65*d* into pipe 65*d*.

With such an equalizing member 17*d*, supplying the oil into supply nozzle 43 from multiple ports, the distance from supply ports 66*d* on both ends to discharge ports 42*d* are relatively short and the pressure losses are kept minimum, so that the front/rear difference in oil discharge is small. As a result, the oil is uniformly applied on fixing roller 20 along the axial direction and prevents it from causing image noises.

Figure 30:
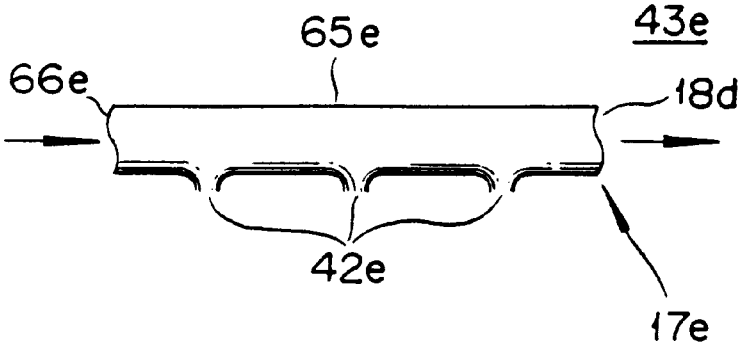

FIG. 30 is a schematic drawing of yet another example of the equalizing member. As shown in FIG. 30, an equalizing member 17*e* of the case (C) is so constituted that the oil is supplied to the inside of a supply nozzle 43*e* through one end of said supply nozzle 43*e* and collected at the other end. Both ends of pipe 65*e* are opened, of which one end serves as a supply port 66*e* and the other end serves as a discharge port 18*d*. Oil 44 delivered to supply nozzle 43*e* by oil transfer apparatus 46 is transferred from supply port 66*e* provided at one end of pipe 65*e* into pipe 65*e*, discharged from discharge port 18*d* and collected by a tank 45.

With such an equalizing member 17*e*, since the oil is supplied from one end of pipe 65*e* and collected from the other end, the oil flows evenly through pipe 65*e* and the oil pressure at each discharge point 42*e* becomes approximately constant, so that the front/rear difference in oil discharge becomes small. As a result, the oil is uniformly applied on fixing roller 20 along the axial direction and prevents it from causing image noises.

Next, let us describe yet another variation of the equalizing member, the aforementioned case (D), wherein an oil supply port 66 f is provided within a range where discharge ports 42*f* are formed.

Figure 31:
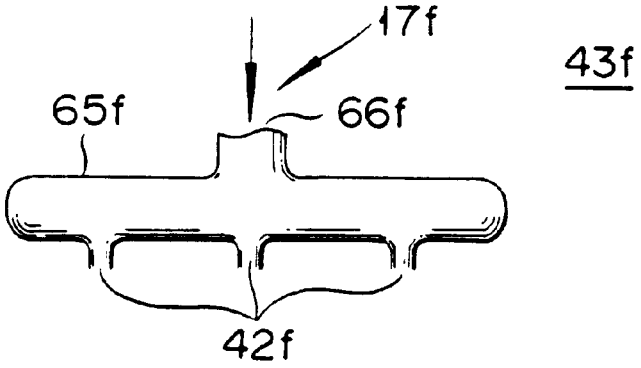

FIG. 31 is a schematic drawing of yet another example of the equalizing member. As shown in FIG. 31, an equalizing member 17*f* is so constituted that the oil is supplied to the inside of a supply nozzle 43*f* in the middle of its lengthwise extension. Both ends of pipe 65*f* are closed, and a supply port 66*f* is located approximately at the center of pipe 65*f*. Oil 44 delivered to supply nozzle 43*f* by oil transfer apparatus 46 is transferred from supply port 66*f* provided at approximately at the center of pipe 65*f* into pipe 65*f*, and spreads out to both sides thereof.

With such an equalizing member 17*f*, introducing the oil at approximately the center of pipe 43*f*, the distance from supply port 66*f* to discharge ports 42*f* at both ends are relatively short and the oil pressure at each discharge port 42*f* is approximately constant, so that the front/rear difference in oil discharge becomes small. As a result, the oil is uniformly applied on fixing roller 20 along the axial direction and prevents is from causing image noises.

Figure 32:
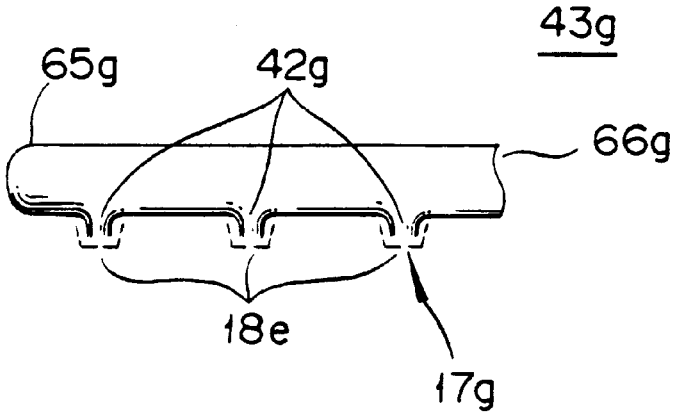

Next, let us describe yet another variation of the equalizing member, the aforementioned case (E), wherein the total opening cross sectional area at each discharge location varies, although each discharge port 42*g* has an approximately constant opening cross-sectional area FIG. 32 is a schematic drawing of yet another example of the equalizing member. As shown in FIG. 32, an equalizing member 17*g* is so constituted that the effective opening cross-sectional area that essentially affects at each discharge port 42*g* the oil discharge is adjusted by means of adjusting the porosity of the porous material 18*e* attached to each of multiple discharge ports 42*g*. More specifically, a filter 18*e* made of sponge and web is attached to each of discharge ports 42*g* and the porosity of each of filters 18*e* is so arranged that it varies along the lengthwise direction. Oil 44 delivered to supply nozzle 43*g* by oil transfer apparatus 46 is transferred from supply port 66*g* provided at one end of pipe 65*g* into pipe 65*g*. The porosity of filter 118*e* is arranged to increase gradually from supply port 66*g* side to the front end.

With such an equalizing member 17*g*, due to filters 18*e* with varying porosity attached to each of discharge ports 42*g* having approximately constant opening cross-sectional areas to adjust the total opening cross-sectional areas to adjust the total opening cross-sectional area, it is possible to provide a higher resistance at the rear end where the inner pressure is relatively larger and a low resistance at the front end where the inner pressure is relatively small due to the flow resistance, thus reducing the variations of the oil pressure acting on discharge ports 42*g* even though the oil is supplied from one end of pipe 65*g* and minimizing the front/rear difference in oil discharge. As a result, the oil is uniformly applied on fixing roller 20 along the axial direction and prevents it from causing image noises.

Figure 33:
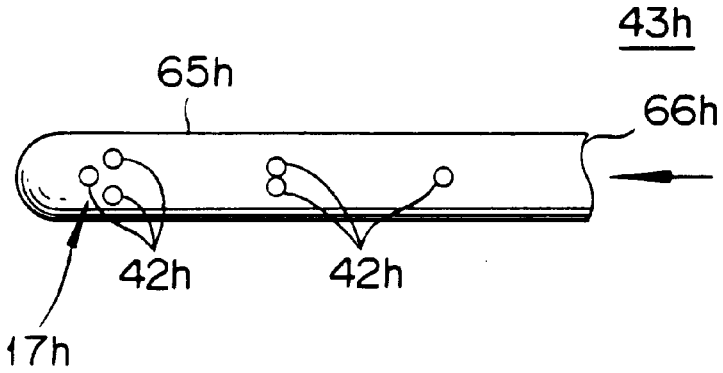

FIG. 33 is a schematic drawing of yet another example of the equalizing member. As shown in FIG. 33, an equalizing member 17*h* of the aforementioned case (E) can be so constituted as to change the density of forming discharge ports 42*h* along the lengthwise direction. Oil 44 delivered to supply nozzle 43 h by oil transfer apparatus 46 is transferred from supply port 66*h* provided at one end of pipe 65*h* into the inside of pipe 65*h*. The number of discharge ports 442*h* in one location varies from small to large as the location moves from supply port 66*h* to the front end, thus increasing the density of ports. For example, as shown in the drawing conceptually, only one discharge port 42*h* at the rear end discharge location, two discharge ports at the middle discharge location and three discharge ports are provided at the front end discharge location. Since the cross-sectional area of each discharge port 42*h* is approximately the same, a hole forming means such as a drill can be used, so that the forming process is simpler compared to a case of changing the opening cross-sectional are of the discharge port itself.

With such an equalizing member 17*h*, due to the fact that the total opening cross-section is varied at each discharge location by means of changing the forming density of discharge ports 42*h* of approximately equal opening cross-sectional areas, it is possible to increase the resistance at the rear end discharge location where the inner pressure is higher, and reduce the resistance at the front end discharge location where the inner pressure is lower, thus reducing the variations of the oil pressures acting on discharge ports 42*h* even though the oil is supplied from one end of pipe 65*h* and minimizing the front/rear difference in oil discharge. As a result, the oil is uniformly applied on fixing roller 20 along the axial direction and prevents it from causing image noises.

Figure 34:
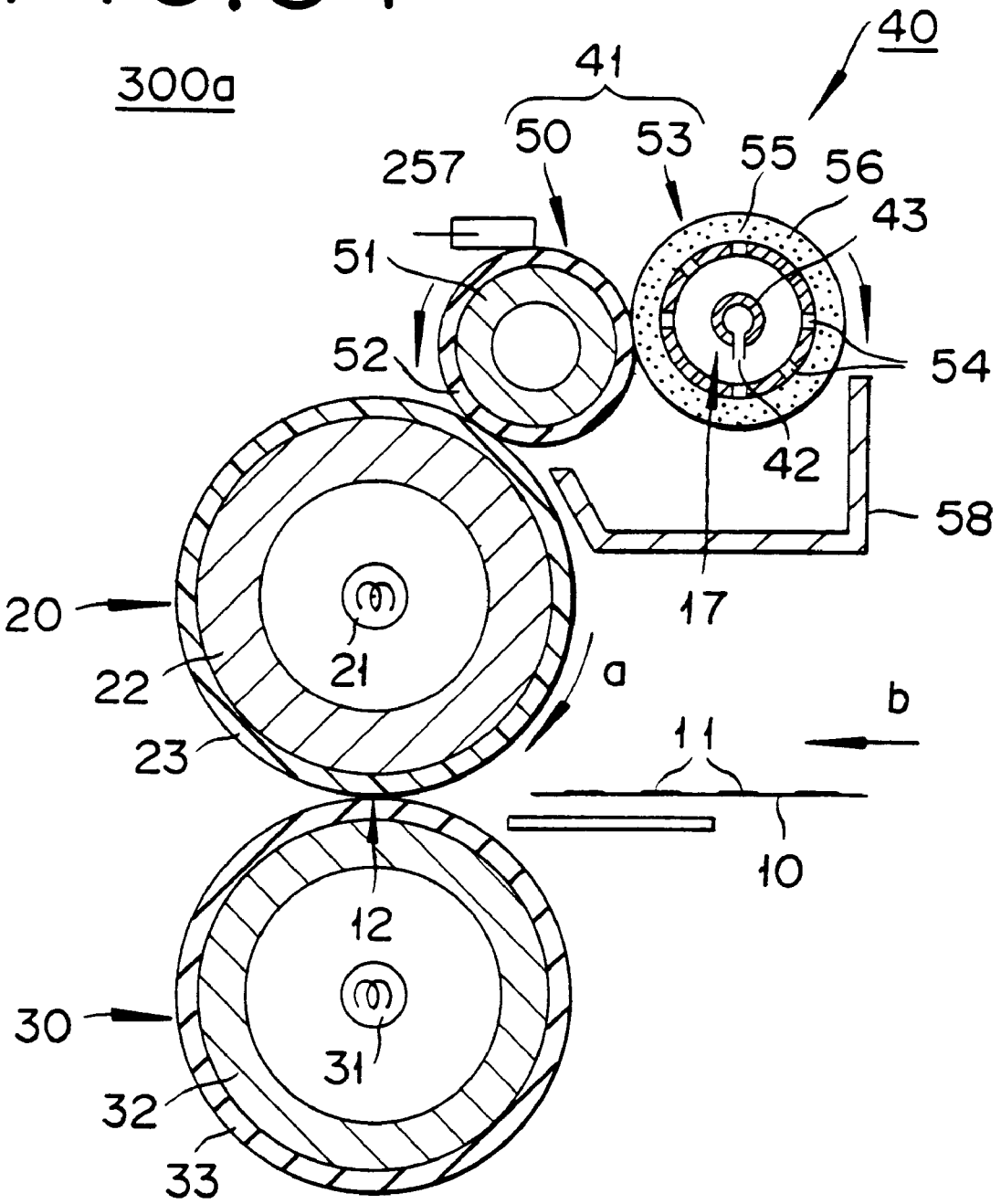
FIG. 34 is an outline schematic drawing of another version of the third embodiment.

FIG. 34 is an outline schematic drawing of another version of the third embodiment.

Similar to the third embodiment, this fixing apparatus 300 a also has a supply nozzle 43 comprising multiple discharge ports 42 having approximately equal opening cross-sectional areas and one of the aforementioned equalizing member. On the other hand, it is different from the third embodiment in that an oil regulating blade 257 of oil coating mechanism 40 is placed in a different position. As for other constitutions, it is similar to the third embodiment, so that their descriptions are not repeated here.

Oil restricting blade 257 abuts on oil coating roller 50 and its abutting position is on the downstream side of the contact area between oil supply roller 53 and oil coating roller 50 along the rotating direction and the upstream side of the contacting area between oil coating roller 50 and fixing roller 20 along the rotating direction. Therefore, releasing agent layer 23 of fixing roller 20 is coated with oil 44 by oil coating roller 50 after the excessive portion of oil 44 on oil coating roller 50 has been removed by oil regulating blade 257.

With such a constitution, the amount of oil applied on fixing roller 20 spreads along the axial direction uniformly and effectively prevents image noises, because oil 44 is uniformly distributed on oil coating roller 50 thanks to abutting oil regulating blade 257.

Figure 35:
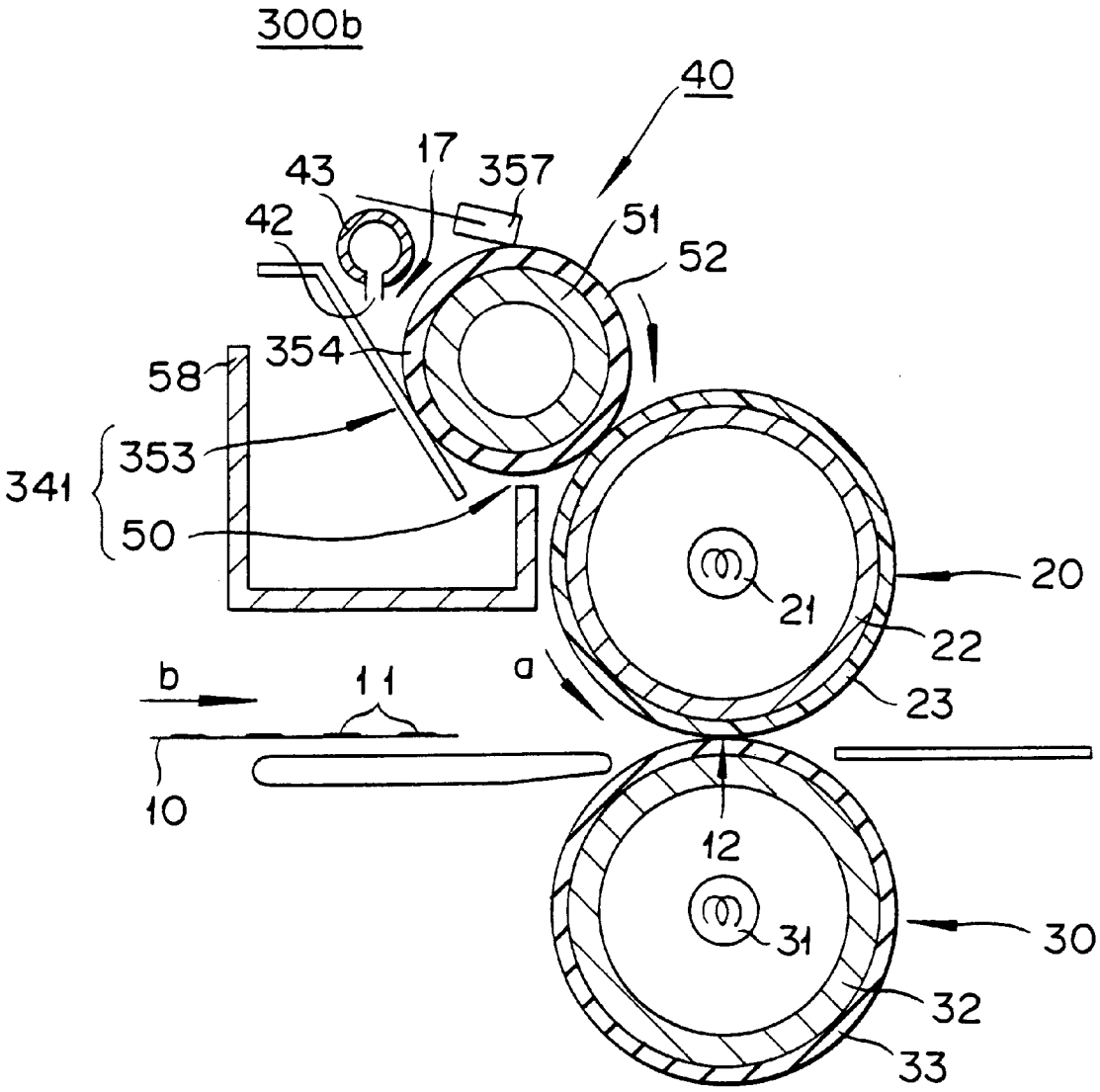
FIG. 35 is an outline schematic drawing of yet another version of the third embodiment.

FIG. 35 is an outline schematic drawing of yet another version of the third embodiment.

Similar to the aforementioned embodiments, fixing apparatus 300 b also has a supply nozzle 43 comprising multiple discharge ports 42 having approximately equal opening cross-sectional areas and one of the aforementioned equalizing member. It is also similar to the aforementioned fixing apparatus 300*a* in that it is equipped with an oil regulating blade 357 to remove the excessive portion of oil 44 on oil coating roller 50. On the other hand, it is different from the third embodiment as well as modified fixing apparatus 300*a* in that a modified coating apparatus 341 is used in oil coating mechanism 40. As for other constitutions, it is similar to the affixing apparatus of the third embodiment, etc., so that their descriptions are not repeated here.

Coating apparatus 341 of fixing apparatus 300*b* is equipped with an oil coating roller 50 that is in contact with fixing roller 20 under pressure and a measuring blade 353 to catch oil 44 dripping from supply nozzle 43. Coating apparatus 341 is not equipped with a member to be impregnated with oil 44 such as oil impregnation material 56 in the aforementioned third embodiment, etc., but rather constituted to transfer the oil to oil coating roller 50 using the oil dripping from supply nozzle 43 and the oil diffusion on a measuring blade 353. Measuring blade 353 is in contact with oil coating roller 50 in an angle under pressure to guide the oil it receives to oil coating roller 50. In order to make a certain amount of oil to be collected in an approximately triangular area 354 formed between measuring blade 353 and oil coating roller 50, a communicating hole (not shown) is provided at an appropriated location of measuring blade 353 and plate-like dyke members (not shown) are provided on both ends in the longitudinal direction. Oil 44 overflowing from measuring blade 353 is received by an oil pan 58 to be returned to oil tank 45.

Oil 44 dripping at a constant rate along the lengthwise direction from each discharging port 42 of supply nozzle 43 is received by measuring blade 353 and flows down toward area 354 while spreading in the lengthwise direction. Oil 44 area 354 is also transferred to coating roller 50 while it is spreading out, and is applied on fixing roller 20 after the excessive portion of oil 44 is removed by an oil regulating blade 357.

Figure 36:
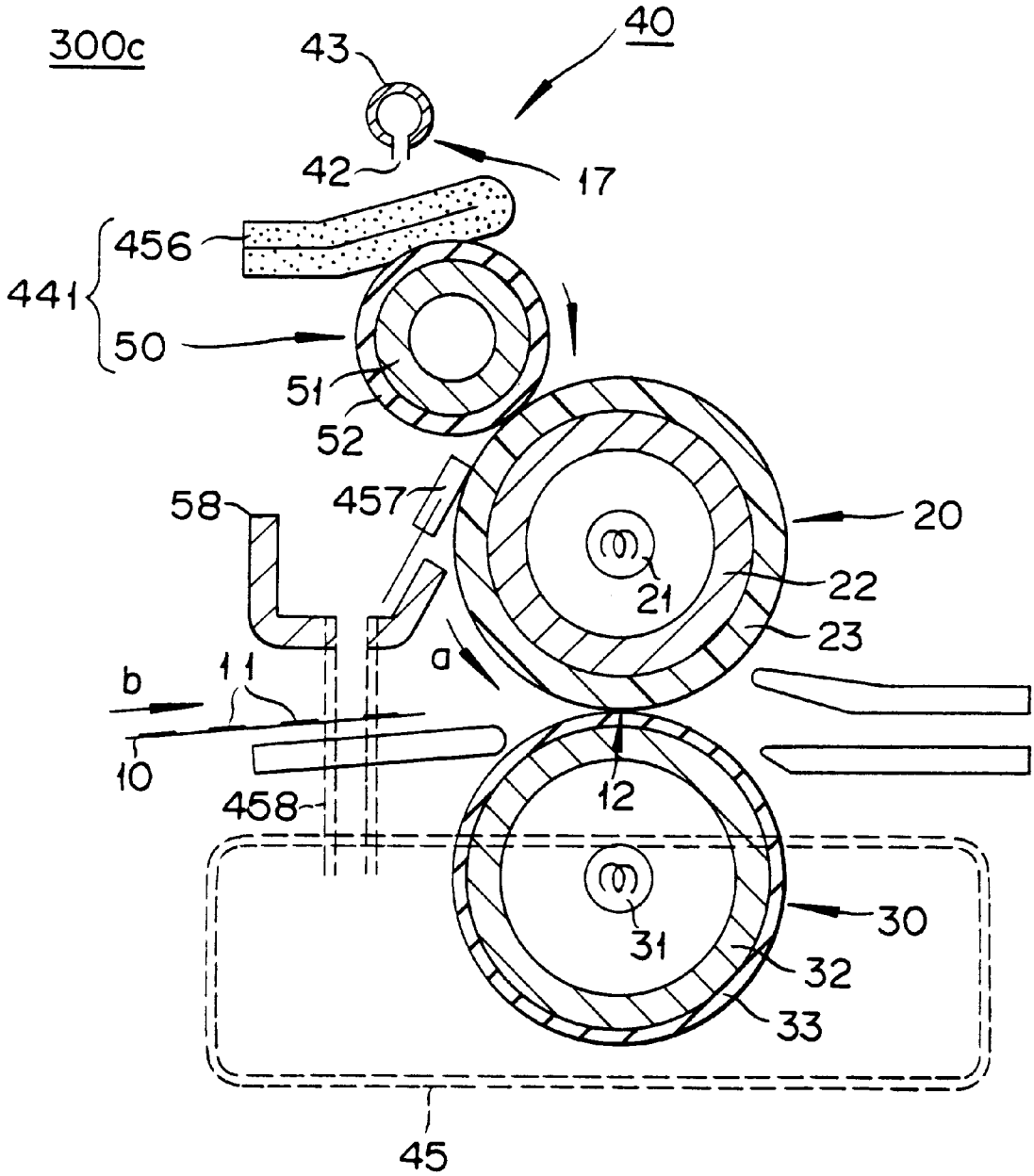
FIG. 36 is an outline schematic drawing of still another version of the third embodiment.

With such a constitution, the amount of oil applied on fixing roller 20 spreads along the axial direction uniformly and effectively prevents image noises, because the oil 44 is uniformly distributed on oil coating roller 50 thanks to the oil diffusion on measuring blade 353 in the longitudinal direction and in area 354 as well as to oil regulating blade 357's abutment FIG. 36 is an outline schematic drawing of still another version of the third embodiment.

Similar to the aforementioned fixing apparatus of the third embodiment and its variation fixing apparatuses 300*a* and 300*b*, this fixing apparatus 300*c* also has a supply nozzle 43 comprising multiple discharge ports 42 having approximately equal opening cross-sectional areas and one of the aforementioned equalizing member. On the other hand, it is different from the third embodiment as well as the modified fixing apparatuses in that a modified coating apparatus 441 is used in oil coating mechanism 40. Its oil regulating blade 457 of oil coating mechanism 40 is positioned differently. As for other constitutions, it is similar to the affixing apparatus of the third embodiment, etc., so that their descriptions are not repeated here.

Coating apparatus 441 of fixing apparatus 300*c* comprises an oil coating roller 50 which is in contact with fixing roller 20 under pressure, and an oil impregnation material 456 that is impregnated with oil 44 dripped fromsupply nozzle 43 and abuts on oil coating roller 50. Oil impregnation material 456 is made of porous material such as sponge and felt and abuts on oil coating roller 50 without rotating.

Oil regulating blade 457 abuts on fixing roller 20 in order to remove the excessive portion of oil 44 coated on fixing roller 20 by oil coating roller 50. Oil 44 removed from fixing roller 20 is received by an oil pan 58 and returned to oil tank 45 via a collecting route 458.

Oil 44 dripping at a constant rate along the lengthwise direction from discharge ports 42 of supply nozzle 43 impregnates oil impregnation material 456, and flows along the underside of it to rotating oil coating roller 50, where it is applied to fixing roller 20. The excessive portion of o oil 44 on fixing roller 20 is removed by an oil regulating blade 457 at the location upstream of nipping area 12.

With such a constitution, the amount of oil applied on fixing roller 20 spreads along the axial direction uniformly and effectively prevents image noises with the help of the abutting oil regulating blade 457.

Figure 37:
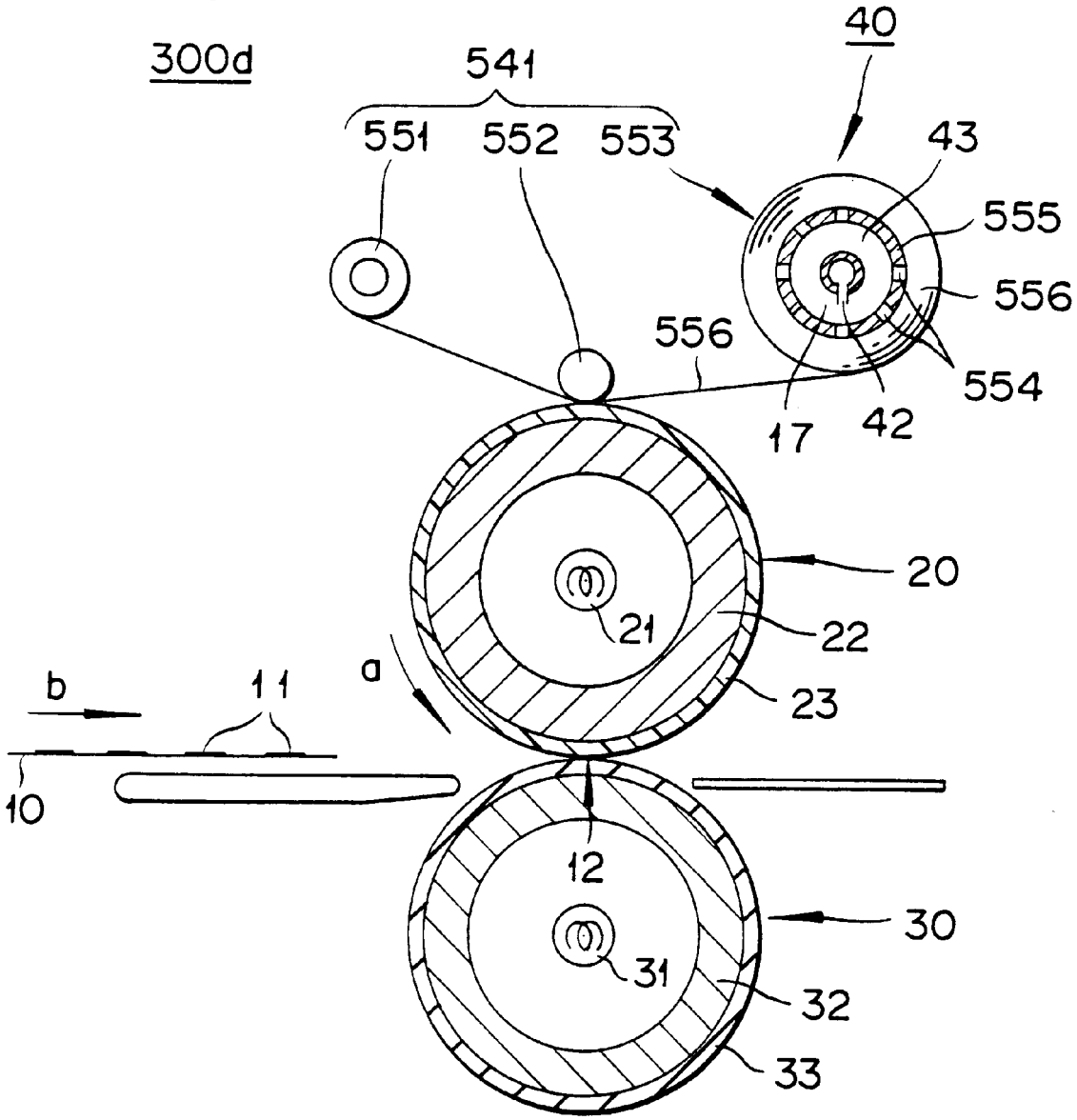
FIG. 37 is an outline schematic drawing of still another version of the third embodiment.

FIG. 37 is an outline schematic drawing of still another version of the third embodiment Similar to the aforementioned fixing apparatus of the third embodiment and its variation fixing apparatuses 300*a* through 300*c*, this fixing apparatus 300*d* also has a supply nozzle 43 comprising multiple discharge ports 42 having approximately equal opening cross-sectional areas and one of the aforementioned equalizing member. on the other hand, it is different from the third embodiment as well as the modified fixing apparatuses in that a modified coating apparatus 541 used in oil coating mechanism 40. As for the constitutions, it is similar to the affixing apparatus of the third embodiment, etc., so that their descriptions are not repeated her.

Coating apparatus 541 of this fixing apparatus 300*d* comprises an oil supply roller 553, on which a long oil impregnation material 556 is wound, a take-up roller 551 which takes up oil impregnation material 556 reeled out from oil supply roller 553, and a pressure roller 552 which pressures oil impregnation material 556, stretched taut between oil supply roller 553 and take-up roller 551 against fixing roller 20. Supply nozzle 43 is placed unrotatably on the axis of oil supply roller 553. Oil impregnation material 556 is made of porous material such as sponge and felt and is wound to be freely reeled out on the periphery of a metal core 555, on which multiple through holes 554 are formed.

Oil 44 dripping at a constant rate along the lengthwise direction from discharge ports 42 of supply nozzle 43 moves through through-holes 554 of metal core 555 and impregnates impregnation material 556. Oil impregnation material 556 is reeled out from oil supply roller 553, which is slidingly in contact with rotating fixing roller 20, and is taken up by take-up roller 551. Oil impregnation material 556 is pressed to contact with fixing roller 20 by pressure roller 552 and coats fixing roller 20 with the impregnated oil.

With such a constitution, the amount of oil applied on fixing roller 20 spreads along the axial direction uniformly and effectively prevents image noises. Oil impregnation material 556 performs a function of cleaning the periphery of fixing roller 20 as well as a function of coating the roller with the oil.

Figure 38:
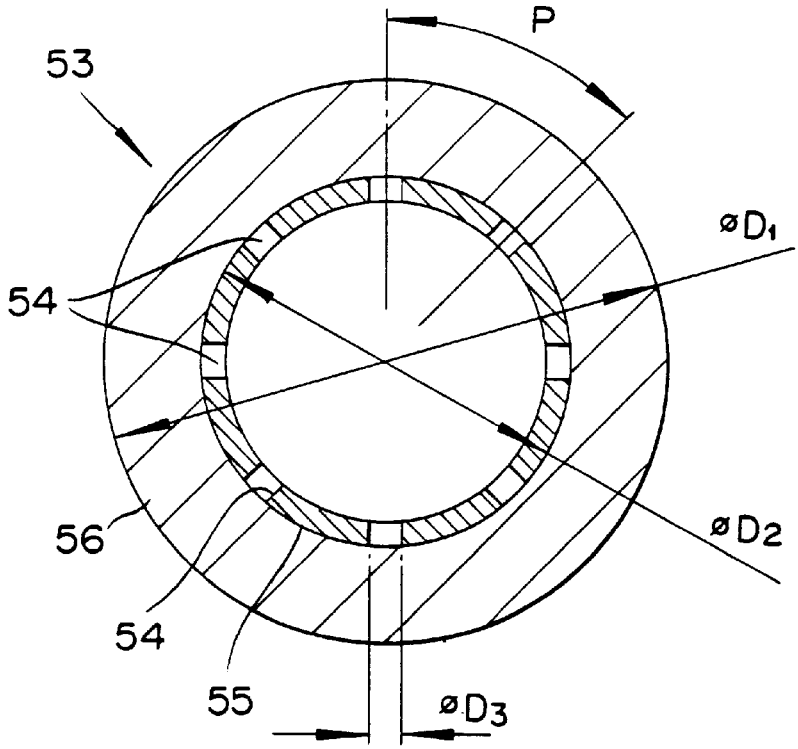
FIG. 38 is an enlarged cross-sectional drawing of the oil supply roller of the fourth embodiment.

FIG. 38 is an enlarged cross-sectional drawing of the oil supply roller of the fourth embodiment. As for components that are similar to those used in fixing apparatus 200 of the aforementioned embodiment, the descriptions are not repeated here.

In the fourth embodiment of the invention, adjacent through holes formed on the periphery of the metal core are placed at a certain distance apart, the distance based on the outer diameter of the oil supply roller 53 and the outer diameter of its metal core 55, so that the oil discharged evenly will eventually be coated on fixing roller 20 evenly.

More specifically, as shown in FIG. 38, assuming that the outer diameter of oil supply roller 53 is D1 (mm), the outer diameter of metal core 55 is D2 (mm) and the distance between adjacent through holes 54 on metal core 55 (hereinafter called "hole pitch") is P (mm), the relation is as follows:

$$0.6<D1\cdot(D1-D2)/(D2\cdot P)<6 \quad (2)$$

or, more preferably, $$1.2<D1\cdot(D1-D2)/(D2\cdot P)<6 \quad (3)$$

The above formulas (2) and (3) are empirical formulas, wherein the lower limit is determined from the standpoint of preventing offset phenomena or image luster unevenness caused by he area which lack sufficient coating with the oil as a result of the hold pitch P of through holes 54 being too large for the shape of oil supply roller 53, thus making it impossible for the oil to diffuse sufficiently. On the other hand, the upper limit was determined from the standpoint of preventing offset phenomena or image luster unevenness caused by the areas which lack sufficient coating with the oil as a result of the hole pitch P of through holes 54 being too small for the shape of oil supply roller 53, thus causing impregnation of oil impregnation material 56 with the oil in limited areas only and making it impossible for the oil to spread across the entire surface of oil supply roller 53.

Table 5 shows the result of the experiment if and under what conditions offset phenomena or image luster unevenness occurs by changing the outer diameter of oil supply roller 53, the outer diameter of metal core 55 and the hole pitch of through-holes 54.

The experiment conditions are:

Type of copies and speed: Full color 30 sheets per minute

Oil impregnation material 56: NOMEX paper (by DuPont)

Metal core 55: Aluminum hollow pipe
(wall thickness: 1 mm, bore of through holes 54: 0.8 mm)

Kinetic viscosity of the oil: 300 cSt

TABLE 5

| Supply roller outer diameter p1 (mm) | Metal core outer diameter D2 (mm) | Hole pitch P (mm) | Offset | Luster noise | D1 · (D1−D2)/(D2 · P) |
|---|---|---|---|---|---|
| 20 | 10 | 4 | | x | 5.0 |
| 20 | 10 | 8 | -- | -- | 2.5 |
| 20 | 10 | 16 | -- | -- | 1.25 |
| 20 | 10 | 32 | -- | x | 0.63 |
| 20 | 10 | 48 | x | x | 0.42 |
| 30 | 12 | 8 | | x | 5.63 |
| 30 | 12 | 16 | -- | -- | 2.82 |
| 30 | 12 | 32 | -- | -- | 1.41 |
| 30 | 12 | 48 | -- | x | 0.94 |
| 30 | 12 | 64 | -- | x | 0.70 |
| 30 | 12 | 80 | x | x | 0.56 |

x: exist
--: not exist

As is evident from Table 5, offset phenomena and image luster unevenness tend to be caused when the hole pitch P of through holes 54 is too large or too small. Also, offset phenomena, etc., can be prevented more easily if the shape of oil supply roller 53 is small when the hole pitch P is small (e.g., 8 mm), or if the shape of roller 53 is large when the hole pitch P is large (e.g., 32 mm, 48 mm), assuming the hole P is constant in both cases. Image luster unevenness here means unevenness of the luster of the image surface caused by the partial existence/absence (or too much/little amount) of the oil.

An analysis of the above results suggest that the smaller the hole pitch P of through-holes 54, and the smaller the outer diameter of metal core 55, the larger the oil impregnation per unit angle when the oil passes through through-holes 54 of metal core 555. Also, the larger the cross-sectional area of oil impregnation material 56 perpendicular to the axis (approximately proportional to D1·(D−D2) ), the easier the oil diffusion to the surface of oil impregnation material 56.

Figure 39:
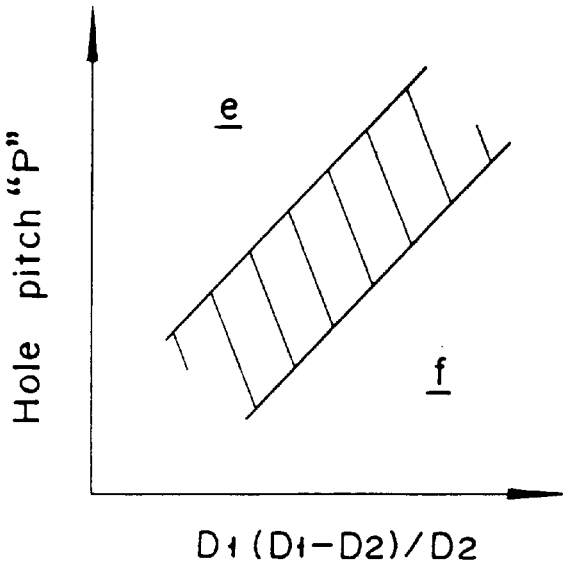
FIG. 39 is a diagram for describing the effects of various quantities on the oil coating status on a fixing roller surface.
Figure 40A:
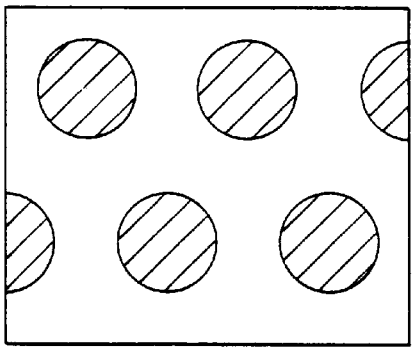
FIG. 40 is a drawing showing the oil coating condition on a fixing roller surface.
Figure 40B:
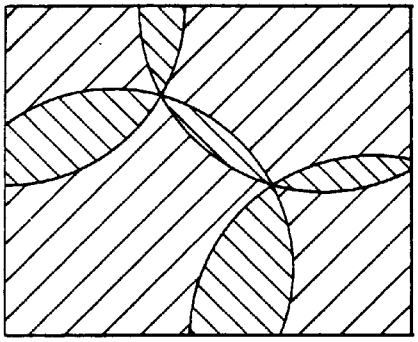

Therefore, as shown in FIG. 39 qualitatively, the oil coating condition on the surface of fixing roller 20 on the surface of oil supply roller 53, or fixing roller 20 on the downstream side thereof and corresponds thereto, is emptier when the hole pitch P is larger and fuller when the hole pitch P is smaller. On the other hands, it is fuller when the value of D1·(D1−D2)/D2 is larger, and emptier when the value is smaller. In other words, the region identified by "e" in FIG. 39 represents a condition where the oil coating condition is emptier and spotty (FIG. 40A), while the region identified by "f" in FIG. 39 represents a condition where the oil coating condition is fuller and overlapping (FIG. 40B). The desirable, uniform areas are indicated by the hatched areas in between those extreme conditions.

In FIG. 40B, the areas indicated with denser hatching are where excessive oil exists that can cause oil streaks in the sheet. The reason that offset phenomena and image luster unevenness occur in the "f" area of FIG. 39 which causes the oil coating condition of FIG. 40B is that oil impregnation material 56 is impregnated only in localized areas, not the entire surface of oil supply roller 53, thus causing uncoated areas in other parts of the roller surface. Another disadvantage is that the mechanical strength will be reduced by having too many through holes 54.

Based on the above analysis, the D1·(D1−D2)/(D2·P) value can be pointed out as a factor of unevenness regarding the oil coating condition on fixing roller 20. Table 5 shows the result of the calculation of this value, and indicates that the D1·(D1−D2)/(D2·P) value clearly corresponds with offset phenomena and image luster unevenness.

In other words, it is possible to secure a desire oil coating uniformity for the fixing roller by setting the D1·(D1−D2)/(D2·P) value to satisfy formula (2). By doing so, it is impossible to provide an excellent releasing capability on the surface of the fixing roller, while reducing the chance of contamination by odd particles and maintaining a stable, uniform coating results for a long period of service. Consequently, it is possible to prevent the offset phenomenon of toner transferring on the fixing roller, and obtain a good image quality. Also, it prevents localized excessiveness of the oil when the oil coating amount is increased and reduces the chance of causing oil streaks on the sheet.

By setting the D1·(D1−D2)/(D2·P) value to satisfy formula (3), it is possible to eliminate the image luster unevenness of the tolerable level in the vicinities of the upper or lower limits offormula (2).

A fixing apparatus according to another alternative of the fourth embodiment of the invention is different form the aforementioned fourth embodiment in that the hole diameter of through-holes 54 formed on metal core 55 of oil supply roller 53 is selected based on the kinematic viscosity of the oil applied to fixing roller 20. Since other components are similar to those used in said forth embodiment, their descriptions will not be repeated here.

More specifically, assuming that the kinematic viscosity of the oil at 25_C is S (cSt) and the hole diameter of through hole 54 is D3 (mm), the following relation must be held (see FIG. 38):

$$0.05<D3/(1m/S)<0.5 \quad (4)$$

preferably, $$0.10<D3/(1n(S))<10.3 \quad (5)$$

The above formulas (4) and (5) were determined empirically, wherein the lower limit was determined, as explained later in more details, from the standpoint of preventing the reduction of the amount of oil coated on fixing roller 20 due to delay of oil impregnation of oil impregnation material 56. On the other hand, the upper limit was determined from the standpoint of preventing the localized heavy impregnation that causes unevenness of impregnation.

Table 6 shows the result of an experiment conducted to see if any offset or image noises (roughness, luster unevenness, etc.) can be generated by changing the kinematic viscosity S of the oil, the hole diameter D3 of through-holes 54.

Experiment conditions are:

Type of copies and speed: Full color, 30 sheets per minute

Oil impregnation material 56: NOMEX paper (by DuPont

Metal core 55: Aluminum hollow pipe (outer diameter: 15 mm wall thickness: 1 mm)

TABLE 6

| Item oil kinematic viscosity S (cSt) | Offset x: exist —: not exist | | Image noise (Roughness) x: exist —: not exist | | Image noise (luster unevenness) x: exist —: not exist | | D3/(1n(S)) | |
|---|---|---|---|---|---|---|---|---|
| Hole Diameter D3 (mm) | 50 | 500 | 50 | 500 | 50 | 500 | 50 | 500 |
| 0.2 | | x | x | x | — | — | 0.05 | 0.03 |
| 0.3 | — | x | x | x | — | — | 0.08 | 0.05 |
| 0.4 | — | — | — | x | — | — | 0.10 | 0.06 |
| 0.6 | — | — | — | x | — | — | 0.15 | 0.10 |
| 1.0 | — | — | — | — | — | — | 0.26 | 0.16 |
| 1.4 | — | — | — | — | x | — | 0.36 | 0.23 |
| 1.8 | — | — | — | — | x | — | 0.46 | 0.29 |
| 2.4 | x | — | — | — | x | x | 0.61 | 0.39 |
| 3.0 | x | — | — | — | x | x | 0.77 | 0.48 |
| 3.6 | x | x | — | — | x | x | 0/92 | 0.58 |

As can be seen from Table 6, offset phenomena and image noises tend to occur if the hole diameter D3 of through-holes 54 is either too large or too small. Also, offset phenomena, etc., can be prevented more easily if the kinematic viscosity is small when the hole diameter D3 is small, or if the kinematic viscosity is large when the hole diameter D3 is large, assuming the hole diameter D3 is constant in both cases. Image roughness here means a poor luster of the image surface caused by insufficient amount of oil.

Figure 41:
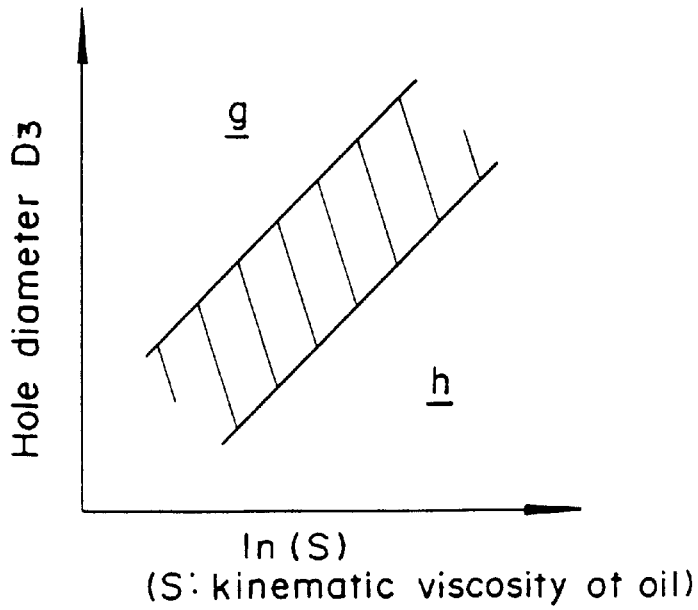
FIG. 41 is a diagram for describing the effects of various quantities on the degree of oil impregnation related to the oil coating condition.
Figure 42:
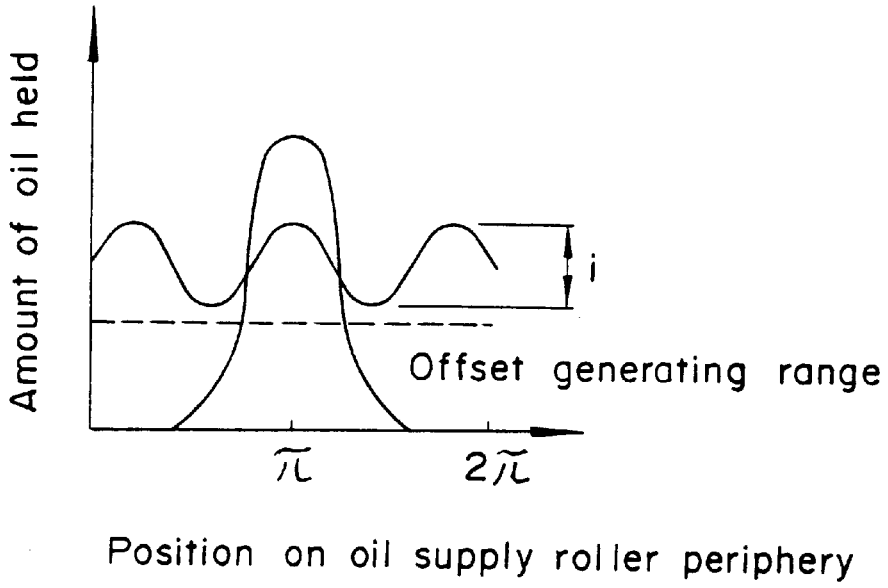
FIG. 42 is a diagram showing the oil holding quantity on the surface of an oil impregnation material.

In analyzing the above result, the relationship between the kinematic viscosity S of the oil and the change of the hole diameter D3 of through-holes 54 was studied by a graph qualitative shown in FIG. 41, wherein the vertical axis represents D3 and the horizontal axis represents the natural logarithm of S, i.e., In (S). The region identified by "g" in FIG. 41 tends to be unevenly impregnated with the oil because of localized impregnation. This is believed to be caused either by the hole diameter D3 of through-holes 54 being too large or by the kinetic viscosity being too small, either of which results in the oil being provided to oil impregnation material 56, not from the entire inner surface of metal core 55, but by through-holes 54, causing localized concentrations in the circumferential direction as shown in FIG. 42 in relation to the oil holding amount of oil impregnation material 56. The size of the amplitude (variation) indicated by "I" in FIG. 42 is the cause of the luster unevenness. Also, if an extremely localized oil impregnation occurs, as shown in FIG. 442, the oil holding amount may become lower than the offset generating limit in some areas and offset phenomena may actually occur.

Figure 43:
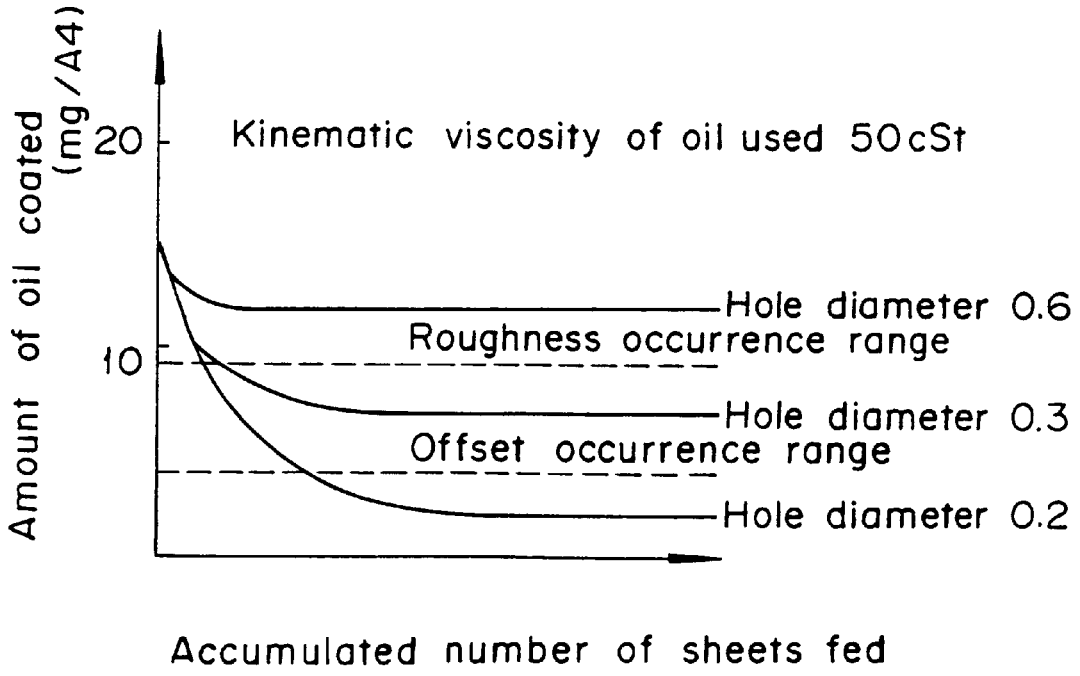
FIG. 43 is a diagram showing the change of oil quantity applied on a fixing roller when oil impregnation in an impregnating material is slow.

On the other hand, the region indicated by "h" in FIG. 41 tends to cause a reduction of the amount of oil coated on fixing roller 20 because of the delay of infiltration of the oil into impregnation material 56. This is believed to be caused by either the hold diameter D3 of through-holes 54 being too small or the kinematic viscosity "S" of the oil being too large, either of which makes the oil to take too long to reach the surface of oil impregnation material 56 after it is supplied inside metal core 55 as shown in FIG. 43. In other words, when the sheets are fed continuously, the sheets are fed to the coating process while the oil has not yet reached the surface of oil impregnation material 56, in which case the oil coating amount ends up less than required. It causes rough images or offset phenomena Moreover, it may even cause leakage from the ends of oil supply roller 53 as the infiltration of the oil into oil impregnation material 56 is delayed. Furthermore, as shown in FIG. 43, the oil impregnation amount of oil impregnation material 56 changes chronologically, which results in an undesirable chronological change of the amount of oil coated on the fixing roller.

The hatched area between the regions "g" and "h" in FIG. 41 represents the oil infiltration range that provides desirable uniform oil coating.

Based on the above analysis, the D3/(1n (S) ) value can be pointed out as a factor of unevenness regarding the oil coating condition on fixing roller 20. Table 6 shows the result of the calculation of this value, and indicates that the D3/(1n (S) ) value clearly corresponds with offset phenomena and image luster unevenness.

In other words, by selecting the D3/(1n (S) ) value to satisfy the formula (4), a suitable condition of the infiltration of the oil into oil supply roller 53 can be established, thus securing a desired oil coating uniformity for fixing roller 20. By doing so, it is possible to provide an excellent releasing capability on the surface of fixing roller 20, while reducing the chance of contamination by odd particles and maintaining a stable, uniform coating results for a long period of service. Consequently, it is possible to prevent the offset phenomenon of toner transferring on the fixing roller, and obtain a good image quality. Also, it prevents localized excessiveness of he oil when the oil coating amount is increased and reduces the chance of causing oil streaks on the sheet.

By setting the D3/(1 n (S) ) value to satisfy the formula (5), it is possible to eliminate the image noises (roughness, luster unevenness, etc.) of the tolerable level in the vicinities of the upper or lower limits of formula (4).

A fixing apparatus according to another alternative of the fourth embodiment of the invention is different from the aforementioned fourth embodiment and its alternatives in that the shape of the through holes formed on metal core 55 of oil supply roller 53 is such that the dimension in the circumferential direction is longer than the dimension parallel to the axis of the metal core. Since other components are similar to those used in said fourth embodiment and its alternatives, their descriptions will not be repeated here.

Figure 44A:
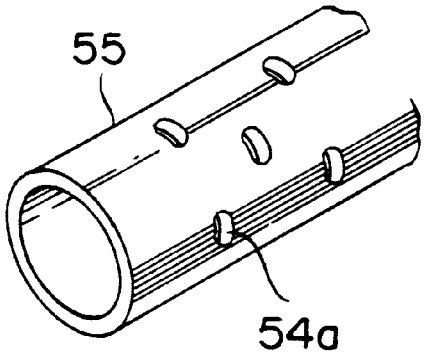
FIG. 44A is a perspective drawing of a metal core according to this invention.
Figure 44C:
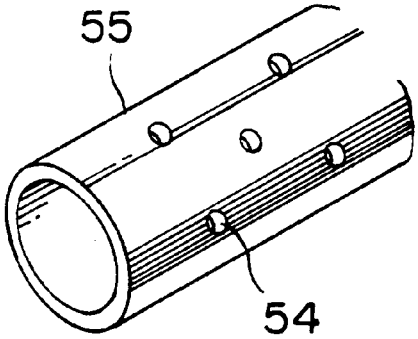
FIG. 44C is a perspective drawing of a conventional metal core and FIG. 44D is a drawing indicating oil diffusion on the surface of an oil supply roller equipped with a conventional metal core.
Figure 44B:
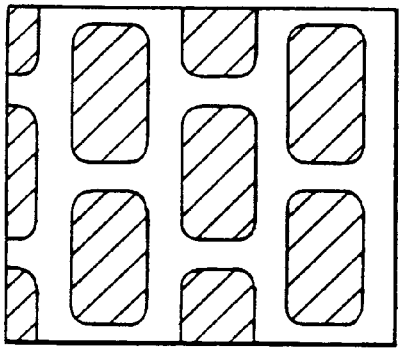
FIG. 44B is a drawing indicating oil diffusion on the surface of an oil supply roller equipped with a metal core according to this invention.
Figure 44D:
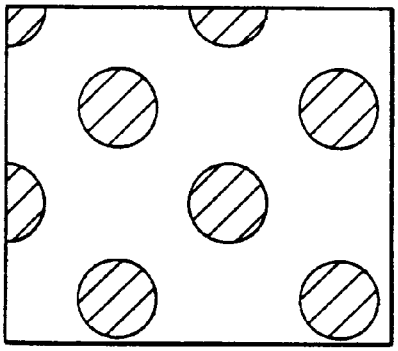

FIG. 44A is a perspective drawing of a metal core according to this invention, FIG. 44B is a drawing indicating oil diffusion on the surface of an oil supply roller equipped with a metal core according to this invention, FIG. 44C is a perspective drawing of a conventional metal core, and FIG. 44D is a drawing indicating oil diffusion on the surface of an oil supply roller equipped with a conventional metal core.

If the through holes are circular holes as shown in FIG. 44C, the oil coating pattern becomes spotty as shown in FIG. 44D when the oil coating amount is small. Under such a condition, the uncoated area can be eliminated by increasing the amount of oil supplied to the inside of metal core 55, but the oil supplied by adjacent through holes 54 tends to overlap each other (FIG. 40B). Therefore, it often causes localized oil concentration areas, which result in oil streaks on the sheets.

On the other hand, by forming the shape of though-holes in such a way that the dimension in the circumferential direction is longer than the dimension parallel to the axis of metal core 55, as shown in FIG. 44A, the amount of oil supplied to the inside of metal core 55 can be gradually increased to increase the coated areas gradually from the condition of discrete spots such as shown in FIG. 44B to eliminated uncoated areas, minimizing the overlapping areas between adjacent through-holes 54*a*. As a result, it can obtain the uniformity of oil coating on the fixing roller, thus preventing offset phenomena and reducing oil streaks on the sheet. By minimizing the oil overlapping, oil impregnation material 56 is more effectively and quickly impregnated, thus making the unit more responsive.

FIG. 45 is a schematic drawing, partially in cross section, of an oil coating mechanism of the fifth embodiment of this invention. The components that are similar to those used in fixing apparatus 200 of the aforementioned embodiment are identified with the same symbols and their descriptions are not repeated here.

Figures 45A, 45B:
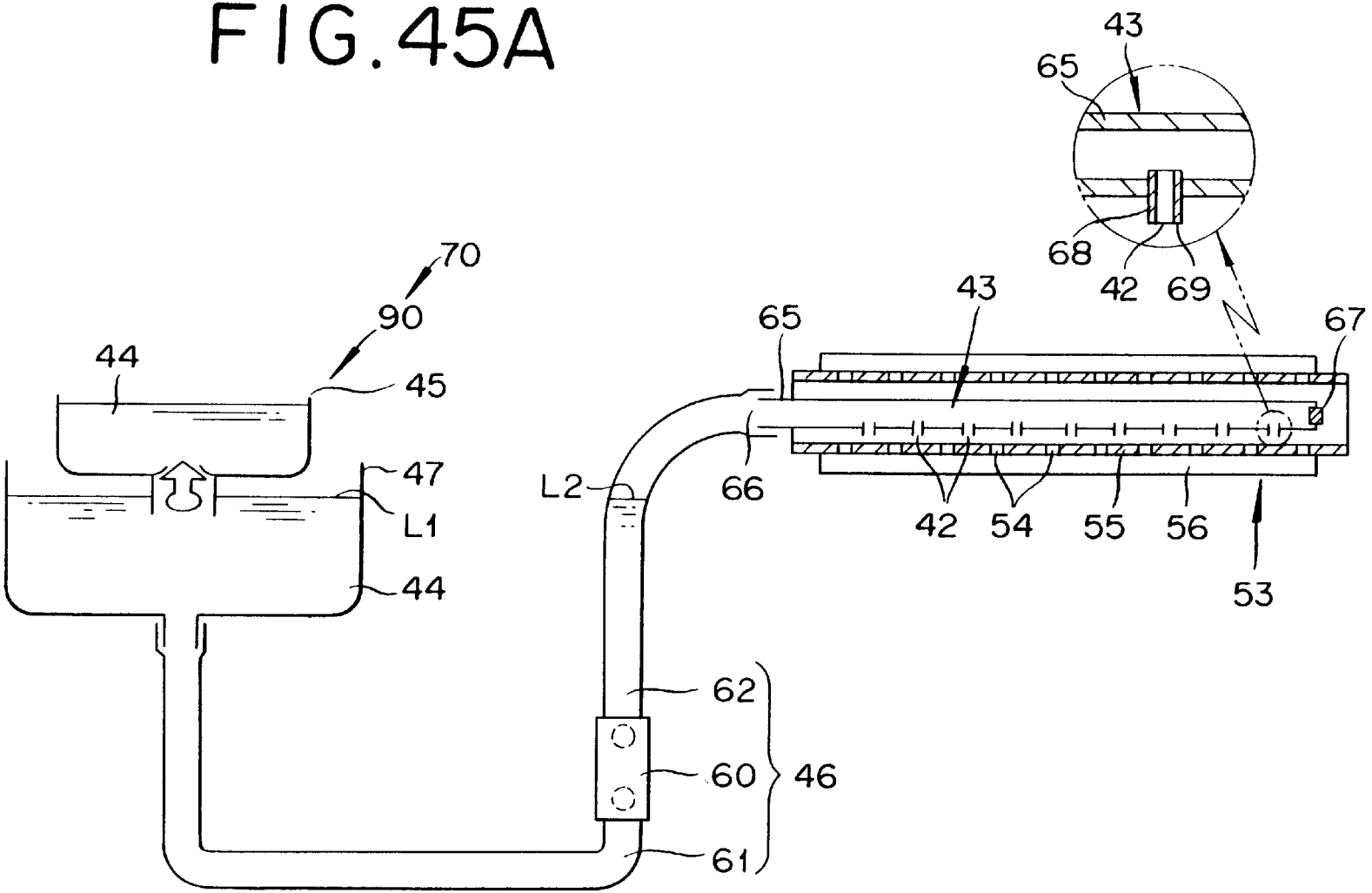
FIG. 45A is a schematic drawing, partially in cross section, of an oil coating mechanism of the fifth embodiment of this invention.
FIG. 45B is an enlarged drawing of an oil discharge part.

Oil coating mechanism 40 comprises a coating apparatus 41 which extends along the axial direction of fixing roller 20 and coats fixing roller 20 with the oil, and a supply nozzle 43 which supplies the oil to coating apparatus 41 through multiple discharge ports 42. As shown in FIGS. 45A and 45B, oil coating mechanism 40 further comprises an oil tank 45 which holds or stores the oil and an auxiliary oil tank 47, tubes 61 and 62 which transfer oil 44 in auxiliary tank 47 to supply nozzle 43, and an oil pump 60 which is provided between tubes 61 and 62 and transfers the oil intermittently by switching on and off. Supply nozzle 43 corresponds to the releasing supply apparatus, oil tank 45 and auxiliary oil tank 47 correspond to the tank unit, tubes 61 and 62 correspond to the transfer route, and oil pump 60 corresponds to the pump unit Oil coating mechanism 40 is equipped with a quantifying apparatus 70 which maintains the quantity of oil transfer constant when the oil is intermittently transferred by oil pump 60. Tubes 61 and 62 and oil pump 60 constitute an oil transfer apparatus 46 which delivers oil 44 store in tanks 45 and 47 to supply nozzle 43.

Figure 46:
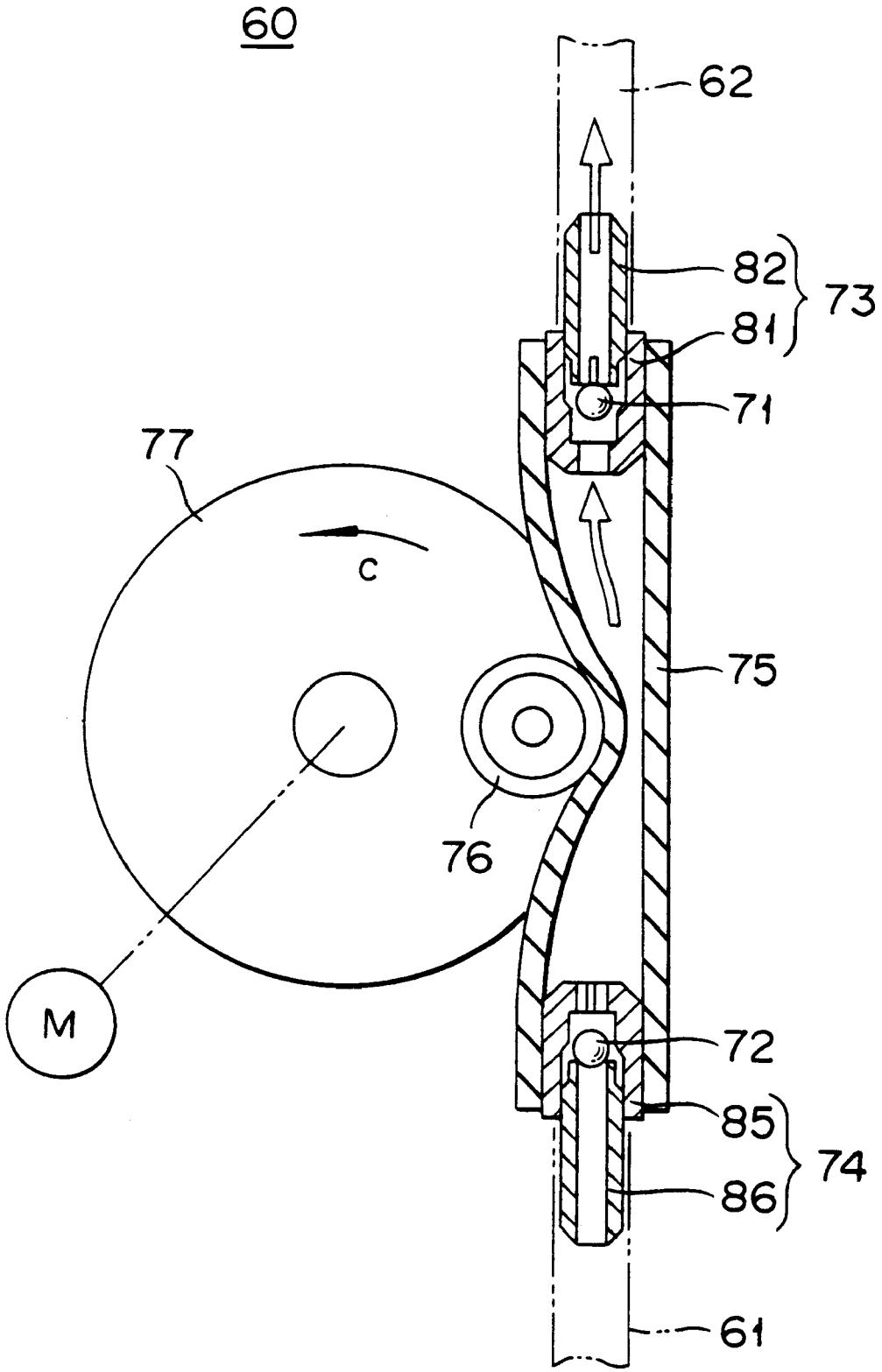
FIG. 46 is a cross section showing an oil pump having two ball valves.

Oil pump 60 comprises, as shown in FIG. 46, a pair of pipe members 73 and 74 containing ball valves 71 and 72, respectively, a flexible rubber tube 75 connecting two pipe members 73 and 74 which are arranged one on top of the other, a pressuring roller 76 which presses rubber tube 75, a circular disc 77 to which pressuring roller 76 is attached on the periphery thereof, and a motor M which drives disc 77. Rubber tube 75 is made of a material with an excellent restoring capability such as urethane rubber. Disc 77 is provided in such a way as to make it rotate in the direction of an arrow "c" so that the point that pressuring roller 76 presses rubber tube 75 moves upward. Oil pump 60 functions in such a way that pressuring roller 76 elastically deforms rubber tube 75 to push out the oil in rubber tube 75 into tube 62; as the pressure is relieved and rubber tube 75 restores its original shape, oil 44 is sucked up from auxiliary oil tank 47.

Figure 47:
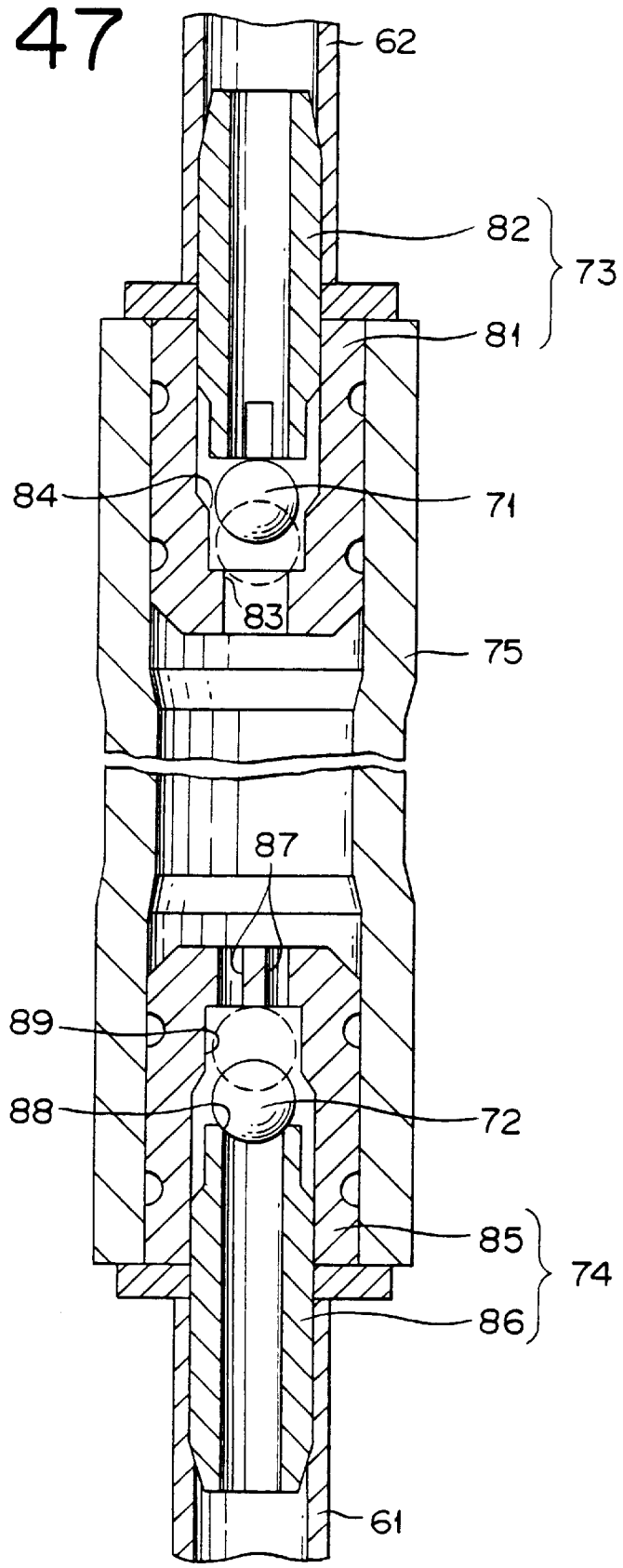
FIG. 47 is a cross section showing an essential part of the oil pump shown in FIG. 46.

FIG. 47 is an enlarged view of pipe members 73 and 74. Upper pipe member 73 comprises a first connecting pipe 81, to which to top end of rubber tube 75 is fitted, and a second connecting pipe 82, to which the bottom end of tube 62 is fitted. Second connecting pipe 82 is fitted to first connecting pipe 81. An oil passage is formed in each of connecting pipes 81 and 82 and a ball valve 71 is stored in such a way that it can move up and down in a valve chamber 84 formed by a valve port 83 which opens at first connecting pipe 81 and the bottom end of second connecting pipe 82. Lower pipe member 74 comprises similarly a first connecting pipe 85, to which the bottom end of rubber tube 75 is fitted, and a second connecting pipe 86, to which the top end of tube 61 is fitted. Second connecting pipe 86 is fitted to first connecting pipe 85. An oil passage is formed in each of connecting pipes 85 and 86 and a ball valve 7 is stored in such a way that it can move up and down in a valve chamber 89 formed by a communicating port 87 opened at first connecting pipe 85 and valve port 88 opened the top end of second connecting pipe 86.

Ball valve 71 of upper pipe member 73 is lifted up by the oil flow to open V valve port 83 of first connecting pipe 81 when the oil inside rubber tube 75 is pushed out into tube 62, and is pushed down by its own weight and the oil suction force to close valve port 83 when the oil inside auxiliary tank 47 is sucked up. On the other hand, when the oil in rubber tube 75 is purged in to tube 62, ball valve 72 of lower pipe member 74 is pushed down by its own weight and the oil purging force to close valve port 88, and is lifted up by the oil flow to open valve 88 when the oil is sucked from auxiliary tank 47.

Above-mentioned oil pump 60 is simply composed with two ball valves 71 and 72 placed on each end of flexible tube 75, and can be manufactured inexpensively. However, since there are no devices such as springs to energize ball valves 71 and 72, the forces to close valve ports 83 and 88 are relatively weak, and the capability to stop the back-flow of the oil is relatively weak.

Oil 44 in auxiliary oil tank 47 is delivered into pipe 65 by means of oil transfer apparatus 46 through supply port 66 and discharged as droplets from each discharge ports 42. Also, since discharge ports 42 of supply nozzle 43 are provided at a specified pitch, oil 44 is not supplied as a plane but as spots.

Since oil pump 60 used here has a relatively weak capacity to resist the back-flow, the oil level in tube 62 tends to fluctuate when oil pump 60 is stopped, and may change the amount of oil delivered when the oil is transferred intermittently. Therefore, oil coating apparatus 40 is provided with a quantifying apparatus.

The quantifying apparatus of this invention is divided as follows in terms of its specific constitutions: (A) a constitution to maintain the oil level in the transfer passage at a specified height when the pump unit is stopped; (B) a constitution capable of controlling the timing of the pump unit stoppage based on the timing when the oil level in the transfer passage reaches a specified position when the pump is used intermittently considering the fact that the oil level lowers when the pump unit is stopped; and (C) a constitution wherein the pump unit is designed in such a way as not to be affected by air reversing from the supply nozzle when the pump unit is stopped. Examples of these constitutions are described below.

An example of the aforementioned case (A) of quantifying apparatus 70 which maintains the oil level to a specified height is as follows.

Figure 48:
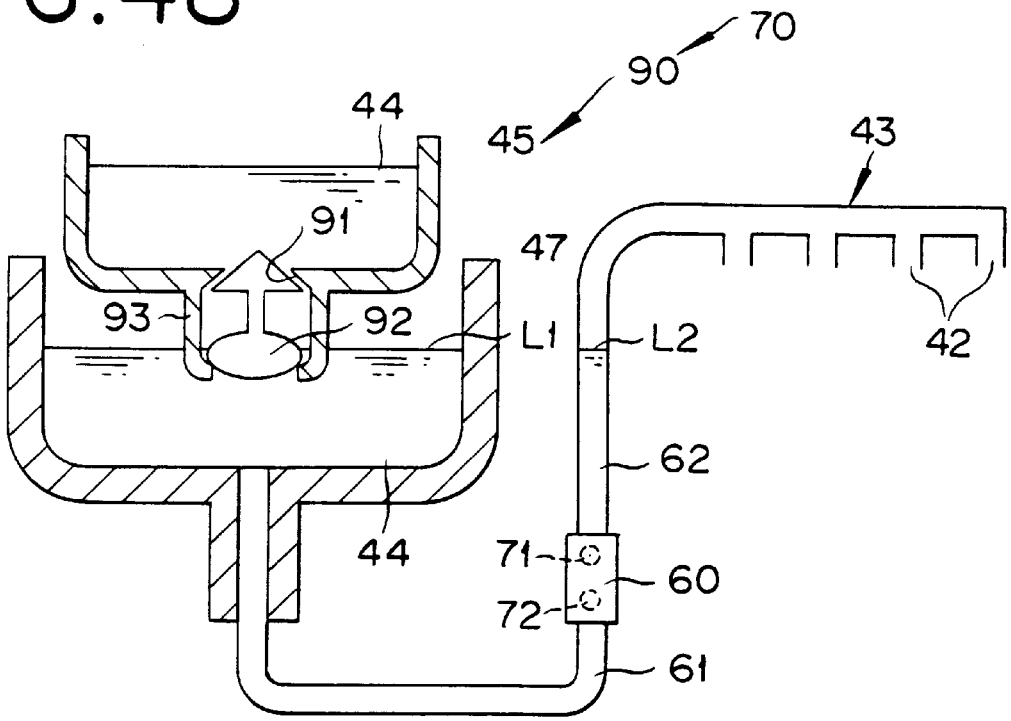
FIG. 48 is a schematic drawing showing an example of quantifying apparatus comprising a liquid level holding member.

As shown in FIGS. 45A and FIG. 48, quantifying apparatus 70 comprises an oil level holding member 90 which holds the oil level in tubes 61 and 62 to a specified height when oil pump 60 is stopped.

Oil level holding member 90 comprises an oil tank 45, at the bottom surface of which is formed a valve port 91, an auxiliary oil tank 47, which is connected to tube 61 at the bottom thereof and is placed beneath oil tank 45 and a float valve 92, which floats on the oil in auxiliary oil tank 47 and opens/closes valve port 91 of oil tank 45. A guide cylinder 93 is formed around valve port 91 of oil tank 45 to guide the up/down movement of float valve 92. Oil tank 45 is fixed at a specific position above auxiliary oil tank 47 so that the distance between tanks 45 and 47 is maintained constant. Oil tank 45 and auxiliary tank 47 are fixed n the frame of a fixing apparatus (not shown) and the like in a raised position so that the oil level of auxiliary tank 47 is a slightly higher than discharge ports 42 of supply nozzle 43.

When oil pump 60 is operated to transfer the oil toward supply nozzle 43, the oil level in auxiliary oil tank 47 lowers, float valve 92 lowers to open valve port 91, and the oil inside oil tank 45 flows to auxiliary oil tank 47. When oil pump 60 stops, the oil level in auxiliary tank 47 gradually rises due to the oil flow coming down from oil tank 45 and, as a result, float valve 92 gradually rises. As float valve 92 rises, it closes valve port 91 again to stop replenishment of auxiliary tank 47 with the oil from oil tank 45.

Since ball valves 71 and 72 of oil pump 60 cannot stop the back-flow of oil completely, the oil that did not discharged through discharge ports 42 and remained in supply nozzle 43 or the oil in tube 62 flows backward through oil pump 60 in the gravity direction. Because of such a back-flow, the oil level in auxiliary oil tank 47 rises slightly, while the oil level in tube 62 lowers, until eventually the heights of oil levels L1 and L2 reach an equilibrium as shown in FIG. 48. Once they reach an equilibrium, the heights of oil levels L1 and L2 in auxiliary tank 47 and tube 62 do not change anymore.

When it is decided that it is necessary to supply the oil to oil supply roller 53 based on the number of rotations of fixing roller 20, oil pump 60 is turned on and the oil is transferred again to supply nozzle 43. Since oil level L2 in tube 62 is maintained at a specified height, executing the push out cycles of oil pump 60 for the predetermined number of times will cause the specified quantity of oil to be transferred to supply nozzle 43.

Since oil level L2 in tube 62 is maintained at the specified height when oil pump 60 is stopped by means of oil level holding member 90, even a very small amount of oil can be intermittently transferred in a stable manner by simply executing a required number of cycles of oil pump 60, even if oil pump 60 is operated intermittently. Thus, the quantity of oil coated on fixing roller 20 using this quantifying apparatus remains constant, so that image noises such as offset, oil streaks and image luster unevenness can be prevented.

Next, let us describe a quantifying apparatus 70*a* using a modified oil level holding member 90*a*.

Figure 49:
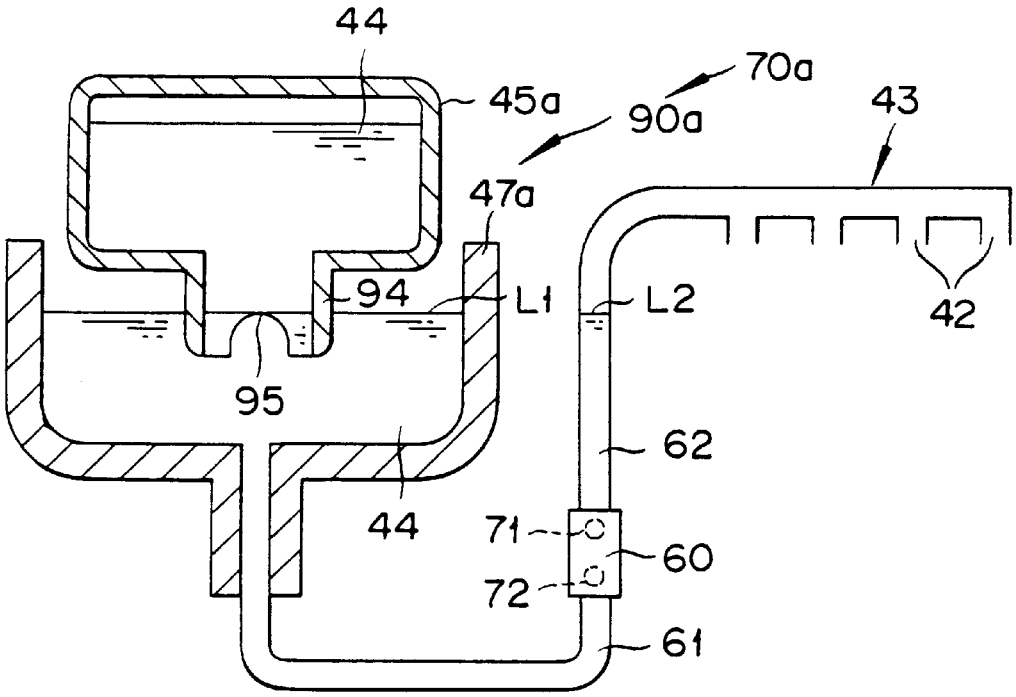
FIG. 49–51 are other examples of the quantifying apparatus each comprising a liquid level holding member.

As shown in FIG. 49, an oil level holding member 90*a* is different from quantifying apparatus 70 described above in that its oil tank 45*a* is modified. Oil tank 45*a* has a supply cylinder 94 at the bottom of a sealed container, and a notch 95 is formed on one part of the wall of supply cylinder 94. Supply cylinder 94 is immersed in oil 44 inside an auxiliary oil tank 47*a* Since other constitutions are the same as the above described quantifying apparatus 70, their descriptions will not be repeated here.

When oil pump 60 is operated to transfer the oil to supply nozzle 43, the oil level in auxiliary tank 47*a* lowers. If the oil level becomes lower than notch 95 of oil tank 45*a*, air will be introduced through notch 95 into oil tank 45*a*, so that the oil in oil tank 45*a* flows down into auxiliary oil tank 47*a*. When oil pump 60 stops, the oil level in auxiliary oil tank 47*a* gradually rises due to the oil coming down from oil tank 45*a*, and notch 95 will be closed by the oil in auxiliary tank 47*a*. When this condition occurs, air will no longer be introduced into oil tank 45*a* and the replenishment of auxiliary oil tank 47*a* with the oil from oil tank 45*a* stops.

With such a level holding member 90*a*, when oil pump 60 is stopped, the oil level in auxiliary oil tank 47*a* rises slightly because of such a back-flow, while the oil level in tube 62 lowers, until eventually the heights of oil levels L1 and L2 reach an equilibrium as shown in FIG. 48. Once they reach an equilibrium, the heights of oil levels L1 and L2 in auxiliary oil tank 47*a* and tube 62 do not change anymore.

Since the oil level in tube 62 is maintained at the specified height when oil pump 60 is topped by means of oil level holding member 90*a*, even a very small amount of oil can be intermittently transferred in a stable manner by simply executing a required number of cycles even if pump 60 is operated intermittently. Thus, the quantity of oil coated on fixing roller 20 using this quantifying apparatus remains constant, so that image noises such as offset, oil streaks, image luster unevenness can be prevented.

Next, let us describe a quantifying apparatus 70*b* using a modified oil level holding member 90*b*.

Figure 50:
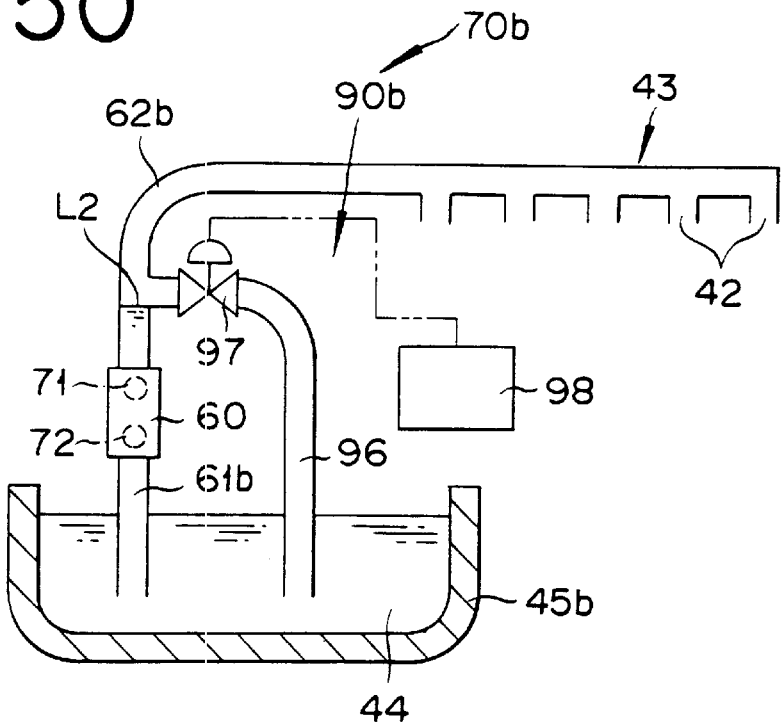

As shown in FIG. 50, an oil level holding member 90*b* is different from quantifying apparatuses 70 and 70*a* described above in that it is not equipped with an auxiliary tank, that an oil tank 45*b* is positioned relatively lower, and that it is equipped with a collecting passage that forcibly collects the oil in a tube 62*b*. The lower end of a tube 61*b* is immersed in oil 44 in low-positioned oil tank 45*b*. A collection tube 96 which bypasses oil pump 60 is connected to the middle of tube 62*b*. Collection tube 96 is equipped with an on-off valve 97 which can be a solenoid valve to open or close tube 96. When oil pump 60 stops, on-off valve 97 is opened to allow the oil remaining in supply nozzle 43 and tube 62*b* to return to oil tank 45*b* through collection tube 96 bypassing oil pump 60.

The control signal to open/close on-off valve 97 is generated by a controller 98 comprising a CPU in charge of the control of the fixing motion of the fixing apparatus. The timing for opening or closing on-off valve 97 can be set arbitrarily, for example, to have on-off valve 97 opened for a specified length of time just before oil pump 60 is operated. The specified length of time is a sufficient time to collect the oil remaining in supply nozzle 43 and tube 62*b* in oil tank 45*b*.

When oil pump 60 stops, the oil level in tube 62*b* lowers gradually due to back-flow of the oil, but on-off valve 97 is opened just before oil pump 60 is operated again. As a result, the height of oil level L2 in tube 62*b* is at the level where v collection tube 96 is branching off from tube 62*b* when oil pump 60 is operated again.

Therefore, since oil level L2 in tube 62*b*, when oil pump 60 starts operating, is maintained at a specific height by means of level holding member 90*b*, even a very small amount of oil can be transferred in a stable manner by simply executing a required number of cycles of oil pump 60, even if oil pump 60 is operated intermittently. Thus, the quantity of oil coated on fixing roller 20 using this quantifying apparatus remains constant, so that image noises such as offset, oil streaks and image luster unevenness can be prevented.

Next, let us describe a quantifying apparatus 70*c* using a modified oil level holding member 90*c*.

Figure 51:
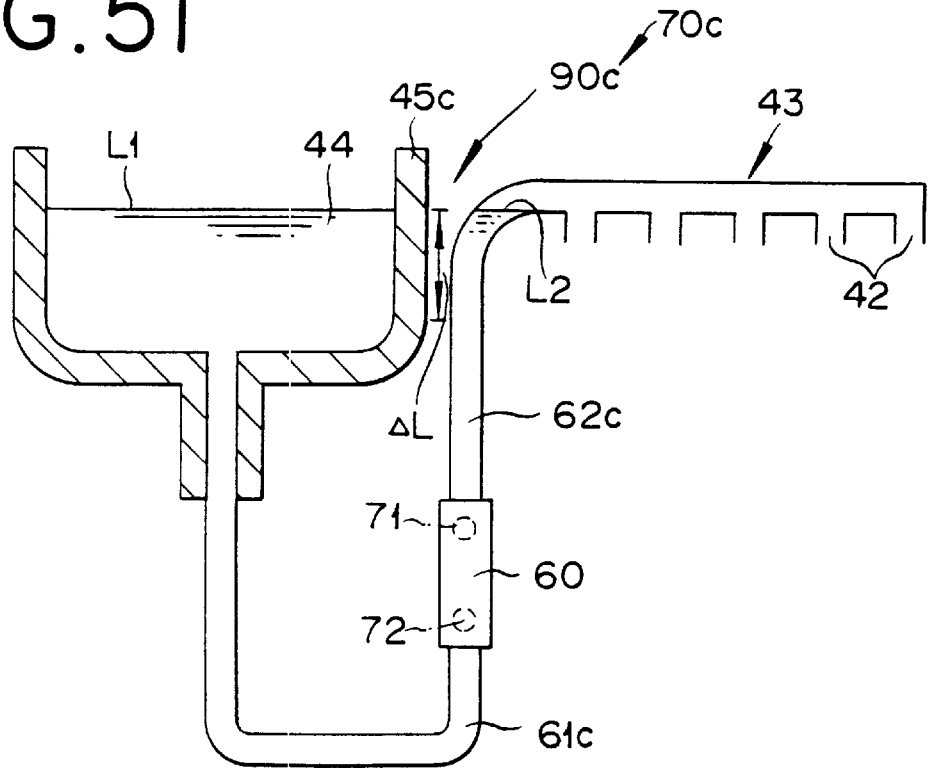

As shown in FIG. 51, an oil level holding member 90*c* is different from quantifying apparatuses 70, 70*a* and 70*b* described above in that it is capable of maintaining the oil level at approximately the same height as supply nozzle 43 when oil pump 60 stops with a simplest constitution using neither an auxiliary tank nor collection tube. Oil level holding member 90*c* is constituted in such a way than an oil tank 45*c* is fixed on the frame of a fixing apparatus (not shown) and the like in a raised position so that level L1 of the oil initially filled into oil tank 45*c* is about the same height as supply nozzle 43. The height of supply nozzle 43 here means more specifically the height of the upper edge of tube 69 inserted into communicating hole 68 of supply nozzle 43. In this oil level holding member 90*c*, oil pump 60 must be located lower than oil tank 45*c* and a tube 61*c* is connected to the bottom of oil tank 45*c*.

With such a level holding member 90*c*, when oil pump 60 is stopped, the oil level in the oil tank rises slightly because of a back-flow of the oil, while the oil level in tube 62*c* lowers, until eventually the heights of oil levels L1 and L2 reach an equilibrium as shown in the drawing. Once they reach an equilibrium, the heights of oil levels L1 and L2 in the oil tank and tube 62*c* do not change anymore.

Since this oil level holding member 90*c*, different from qualifying apparatuses 70 and 70*a* described above, is constituted in such a way as not to replenish the oil of oil tank 45*c* automatically, the oil levels in oil tank 45*c* and tube 62*c* drop lower compared to the initial filling time. However, since oil tank 45*c* is raised higher as much as possible, the amount of lowering of the oil level can be made relatively small. For example, if the difference between the initial oil level in oil tank 45*c* and the oil level during the oil replenishment of oil tank 45*c* is ΔL, the change of oil Level L2 in tube 62*b* is within ΔL. From the standpoint of minimizing the change ΔL of oil level L2, oil tank 45*c* preferably has a silhouette of a low height and a wide bottom.

Consequently, oil level holding member 90*c* holds oil level L2 in tube 62*c* within a relatively limited range ΔL when oil pump 60 stops, so that even a very small amount of oil can be intermittently transferred in a stable many by simply executing a required number of cycles even if pump 60 is operated intermittently. Also, the transfer amount error can be minimized as the change ΔL of oil level L2 is kept small. Thus, the quantity of oil coated on fixing roller 20 using this quantifying apparatus remains constant, so that image noises such as offset, oil streaks and image luster unevenness can be prevented.

Next, let us describe a quantifying apparatus 70*d* of the aforementioned case (B).

Figure 52:
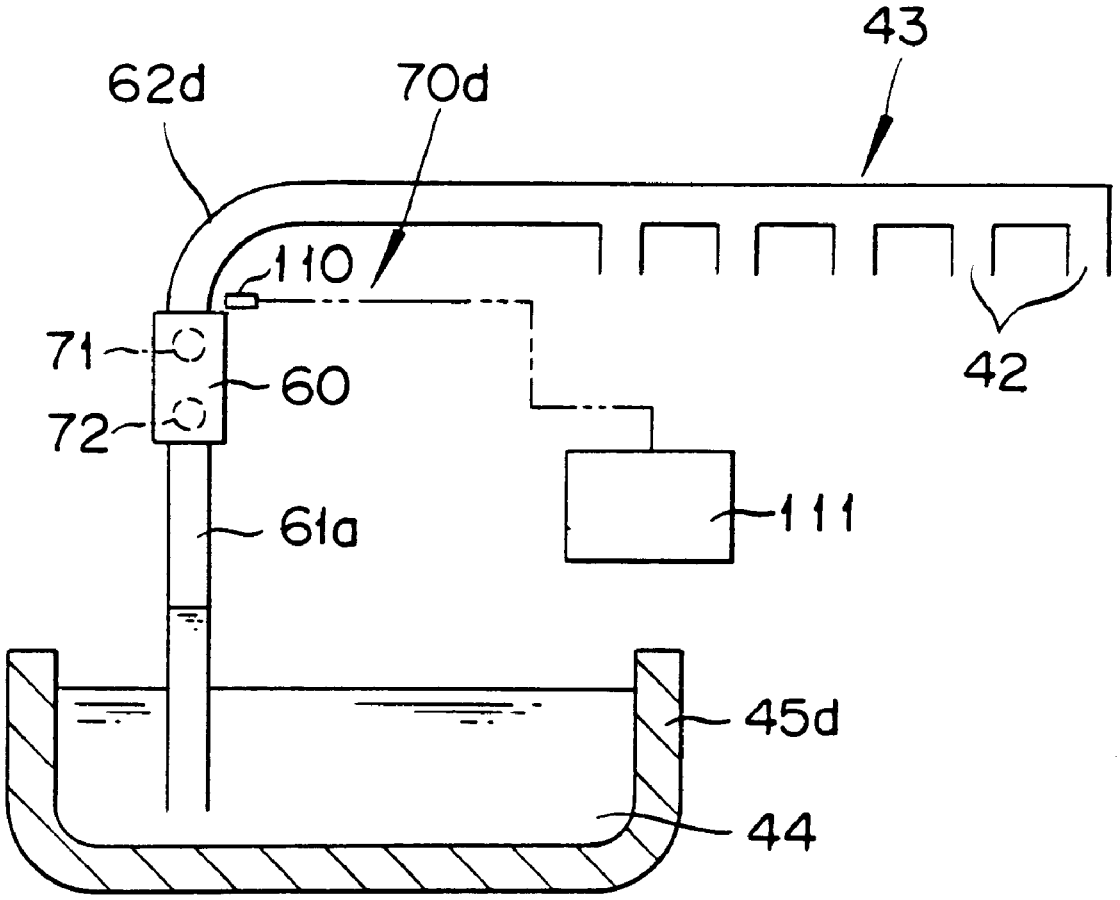
FIG. 52 is a schematic drawing of an example quantifying apparatus constituted in such a way as to control the stopping of an oil pump based on the timing of liquid level in transfer passage reaching a specified position.

As shown in FIG. 52, quantifying apparatus 70*d* comprises an oil level detector 110 which is provided between transfer passages 61*d* and 62*d* and detects oil level of the transfer passages, and a controller 111 which controls the stopping of oil pump 60 on the timing of the oil level detection by oil level detector 110 after oil pump 60 has been restarted.

More specifically, oil level sensor 110 (same as an oil level detector) for detecting the oil level in tube 62*d* is provided in the vicinity of oil pump 60. Oil level sensor 110 can be a conventional infrared oil level sensor. Oil level sensor 110 can be located, as long as it is on the transfer passage, in oil pump 60 or on tube 61*d* side. However, if oil pump 60 is stopped for a long period of time, then oil back-flow may progress to such a stage as to cause the air sucked in through supply nozzle 43 to reach oil pump 60. If any air exists in rubber tube 75 of oil pump 60, operating pressuring roller 76 may not push out the oil readily and it may require more pumping cycles compared to a case where rubber tube 75 is completely filled with the oil. The required number of pumping cycles is not predictable either. Considering such a possibility, it is preferable to arrange oil level sensor 110 to detect the oil level in tube 62*d* on the down stream side of oil pump 60.

The detection signal from oil level sensor 110 is entered into controller 111 comprising a CPU which controls the fixing operation of the fixing apparatus. Controller 111 controls the operation of oil pump 60 as follows based on the detection signal fromoil level sensor 110.

Figure 53:
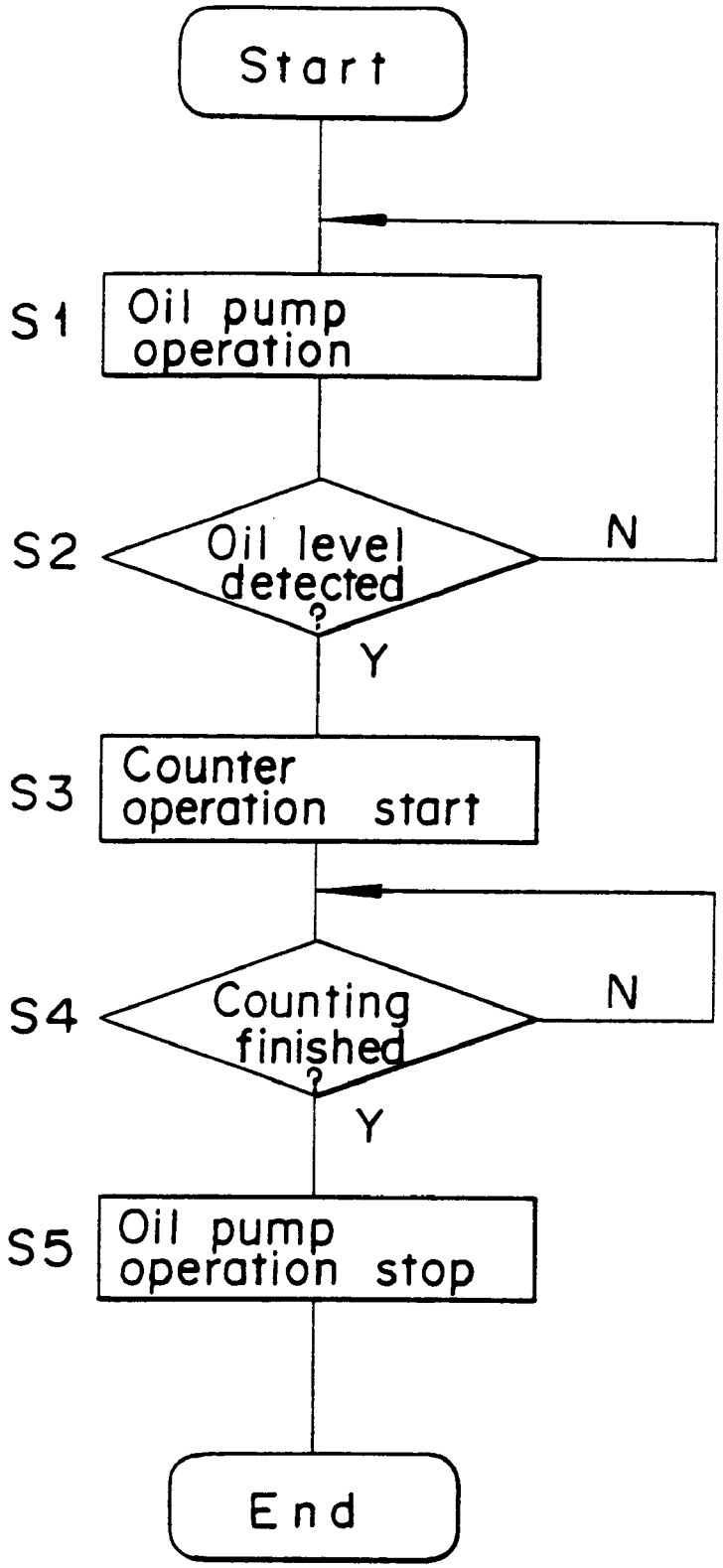
FIG. 53 is a flow chart for describing control operations of the quantifying apparatus shown in FIG. 52.

FIG. 53 is a flow chart for describing the control of oil pump 60.

When controller 111 determines based on the number of revolutions of fixing roller 20 that it has become necessary to replenish the oil of oil supply roller 53, it operates oil pump 60 and transfers the oil again to supply nozzle 43 (Step 1). Next, controller 111 makes a judgment whether oil level sensor 110 has detected the oil level or not (Step 2). If the oil level is detected, then it resets the counter and counts the number of pumping cycles of oil pump 60 (Step 3).

When it reaches a specified number of counts (Step 4), it stops oil pump 60 (Step 5).

Since it operates oil pump 60 again, and stops oil pump 60 based on the timing of the detection of the oil level by oil level sensor 110, any small amount of oil can be intermittently transferred in a stable manner by simply executing a required number of cycles even if the pump 60 is operated intermittently. Thus, the quantity of oil coated on fixing roller 20 using this quantifying apparatus remains constant, so that image noises such as offset, oil streaks and image luster unevenness can be prevented.

Although the case of controlling the number of pumping cycles of oil pump 60 is described in the above, the invention is not limited to it, but can be realized by controlling the time period of the pumping action, or the frequently of the pumping actions can be controlled to achieve the same object.

Next, let us describe a quantifying apparatus 70*e* of the aforementioned case (C).

As described before, in case of oil pump 60 (refer to FIG. 46, etc.) wherein rubber tube 75 is compressed to push out the oil, air drawn through supply nozzle 43 may back-flow as far as to rubber tube 75, and the oil cannot be readily pushed out and require extra pumping cycles compared to a case where rubber tube 75 is filled with the oil. The required number of pumping cycles is not predictable either. The present alternative design is a quantifying apparatus intended to solve the problem by modifying the pump unit so that the unit will not be affected by the air flowing backward from supply nozzle 43 provided at the end of the transfer passage when the pump stops.

Figure 54:
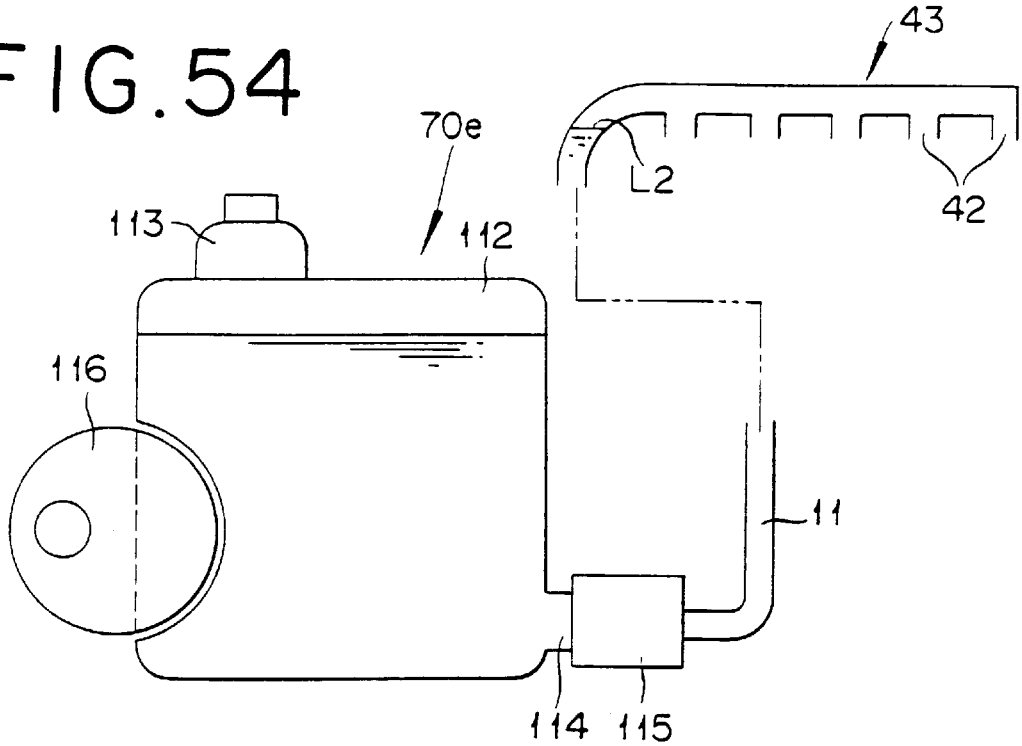
FIG. 54 is a schematic drawing showing an example quantifying an apparatus having a pump unit constituted so as not to be affected by air flowing backward from a supply nozzle when its operation is stopped.

More specifically, as shown in FIG. 54, the oil coating mechanism comprises a bag member 112 made of a plastic material with an excellent restorability, an air inlet valve 113 provided at bag member 112 to introduce air to bag member 112, an oil outlet valve 115 to allow the oil in bag member 112 to flow out, a freely rotatable cam 116 to press the side of bag member 112 from the outside, and a tube 117 to connect supply nozzle 43 to oil outlet valve 115.

When cam 116 rotates and presses the side of bag member 112, air inlet valve 113 closes, oil outlet valve 115 opens and bag member 112 deforms elastically at the same time, thus causing the oil inside bag member 112 to be pushed out into tube 117. When cam 116 stops pressing, air inlet valve 113 opens, oil outlet valve 115 closes and bag member 112 restores its original shape, causing the air to flow into bag member 112 to adjust the inner pressure of bag 112. Since oil outlet valve 115 functions as a check valve, the oil contained inside tube 117 does not flow backward, so that oil level L2 in tube 117 will be maintained at a specified height. As a result, air will not flow backward through supply nozzle 43 when cam 116 stops.

With a pump unit constituted as such, the oil pump and the oil tank are constituted as a single structural member, wherein bag member 112 functions also as an oil tank, bag member 112 and cam 116 function as a oil pump. While cam 116 is the member that really provides a pumping action in this pump unit, cam 116 is pressing bag member 112 filled with the oil and cam 116 can be said to be essentially embedded in the oil via a bag member 112. Even if bag member 112 is placed at a relatively high position and the back-flow prevention capability of oil outlet valve 115 is insufficient, so that air has back-flowed into bag 112 through supply nozzle 43, the air stays on top of the oil in the bag and is impossible to exist in the area where cam 116 presses. Thus, the pump unit shown in the drawing is constituted in such a way that a specified amount of oil can be pushed out from bag 112 by simply rotating cam 116*a* required number of times, without being affected by the air back-flowed through supply nozzle 43.

If the back-flow prevention capability of oil outlet valve 115 is insufficient, it is preferable to combine with such a device as the aforementioned quantifying apparatus 70*d* (refer to FIG. 52) in order to transfer a specified amount of oil.

Consequently, as quantifying apparatus 70*e* is constituted in such a way as to be essentially immersed in the oil in the oil tank so that it will not be affected by the air back-flowing from supply nozzle 43, it is capable of transferring even a very small amount of oil intermittently in a stable manner by simply executing a required number of revolutions of cam 116, even if cam 116, i.e., the oil pump, is intermittently operated. Thus, the quantity of oil coated on fixing roller 20 using this quantifying apparatus remains constant, so that image noises such as offset, oil streaks and image luster unevenness can be prevented.

Next, let us describe a quantifying apparatus 70*f* with a modified pump constitution.

In this alternative example using a modified pump unit, quantifying apparatus 70*f* is constituted, similar to quantifying apparatus 70*e*, in such a way as to eliminate the effect of the air back-flowing from supply nozzle 43 when the pump unit stops.

Figure 55:
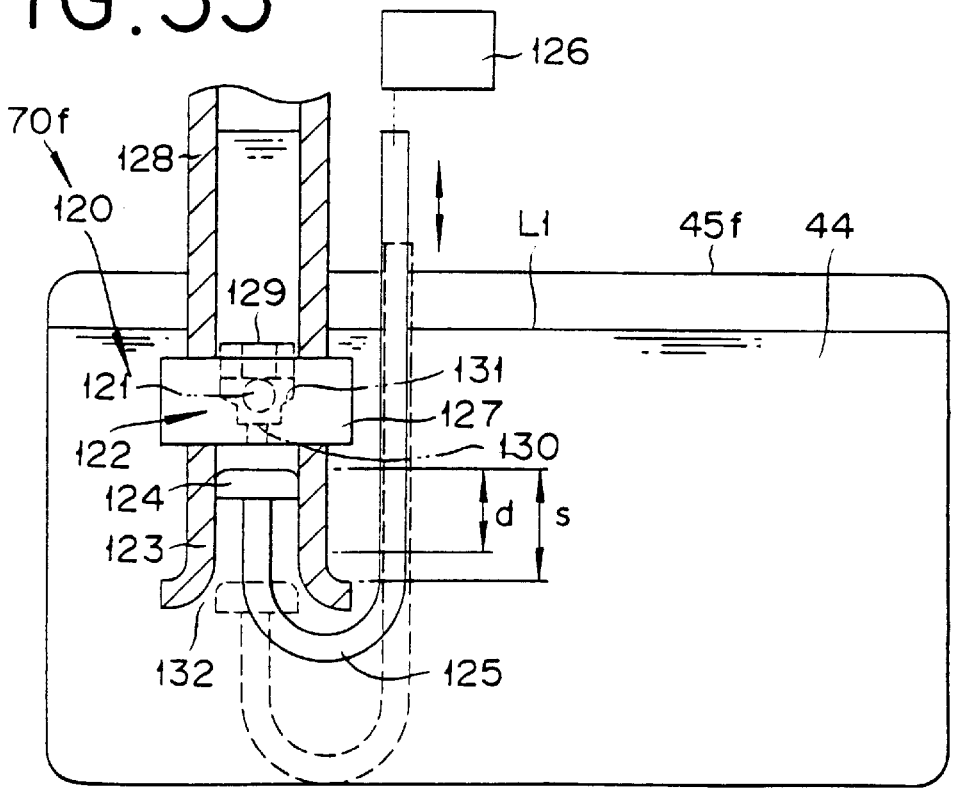
FIG. 55 and 56 are schematic drawings of alternative examples quantifying apparatuses each having a pump unit constituted so as not to be affected by air flowing backward form a supply nozzle when its operation is stopped.

More specifically, as shown in FIG. 55, oil pump 120 comprises a valve member 122 including a ball valve 121, a cylinder 123 connected to the bottom of valve 122, a piston rod 124 which moves up and down in cylinder 123, a piston rod 125 connected to piston 124 and a drive unit 126 which moves piston rod 125 back and forth. Valve member 122, v cylinder 123, piston 124 and a part of piston rod 125 are immersed in oil 44 inside oil tank 45 *f*.

Valve member 122 is constituted approximately like the aforementioned pipe member 73 shown in FIG. 47, and comprises a first connection pipe 127, to which the upper end of cylinder 123 is connected, and a second connection pipe 129, to which the lower end of tube 128 is connected. Second connection pipe 129 is inserted into first connection pipe 127. An oil passage is formed in both connection pipes 127 and 129, and a ball valve 121 is placed moveably up and down in a valve chamber 131 formed between valve opening 130 opened in first connection pipe 127 and the lower end of second connection pipe 129. The bottom end of cylinder 123 is expansively and outwardly opened, and an oil suction port 132 is formed between it and piston 124, which moved to the lower limit position. Piston rod 125 extends downwardly from the lower end of piston 124 and makes a U-turn to extend upward. Piston rod 125 moves up and down driven by drive unit 126, comprising a cam and a solenoid valve, and piston 124 moves up and down with it. The vertical stroke of piston 124 is expressed by a code S in the drawing. The amount of oil pumped is determined by the distance "d" piston 124 travels from the position where it closes oil suction port 132 to its upper limit position.

Oil pump 120 operates as follows. When drive unit 126 operates and piston 124 moves upward, ball valve 121 moves upward due to the oil flow to open valve port 130 of first connection pipe 127, allowing the oil in cylinder 123 to be pushed into tube 128. On the other hand, when piston 124 moves down to open suction port 132, the oil is sucked into cylinder 123 through oil suction port 132. Ball valve 121 is closing valve port 130 due to its own weight and the negative pressure generated in cylinder 123 by the downward motion of piston 124.

Oil pump 120 thus always maintains valve member 122 including ball valve 121 in oil 44, so that the air back-flowed through supply nozzle 43 does not go below oil level L1 of the oil tank even if ball valve 121's back-flow stopping capability is not complete and cannot exist within the stroke range of piston 124. Oil pump 120, therefore, is constituted in such a way that a specified amount of oil can be discharged by simply reciprocating piston 124 a specified number of times without ever being affected by the air back-flowed through supply nozzle 43.

If the back-flow prevention capability of valve member 122 is insufficient, it is preferable to combine with such a device as the aforementioned quantifying apparatus 70*d* (refer to FIG. 52) in order to transfer a specified amount of oil.

Consequently, since quantifying apparatus 70*f* is constituted in such a way as to eliminate the effect of the air back-flowing from supply nozzle 43, it is capable of transferring even a very small amount of oil intermittently in a stable manner by simply executing the reciprocating operations of piston 124 a required number of times, even if the oil pump 120 is intermittently operated. Thus, the quantity of oil coated on fixing roller 20 using this quantifying apparatus remains constant, so that image noises such as offset, oil streaks and image luster unevenness can be prevented.

Next, let us describe a quantifying apparatus 70*g* with a modified pump constitution.

In this alternative example using a modified pump unit, quantifying apparatus 70*g* is constituted, similar to quantifying apparatuses 70*e* and 70*f*, in such a way as to eliminate the effect of the air back-flowing from supply nozzle 43 when the pump unit stops.

Figure 56:
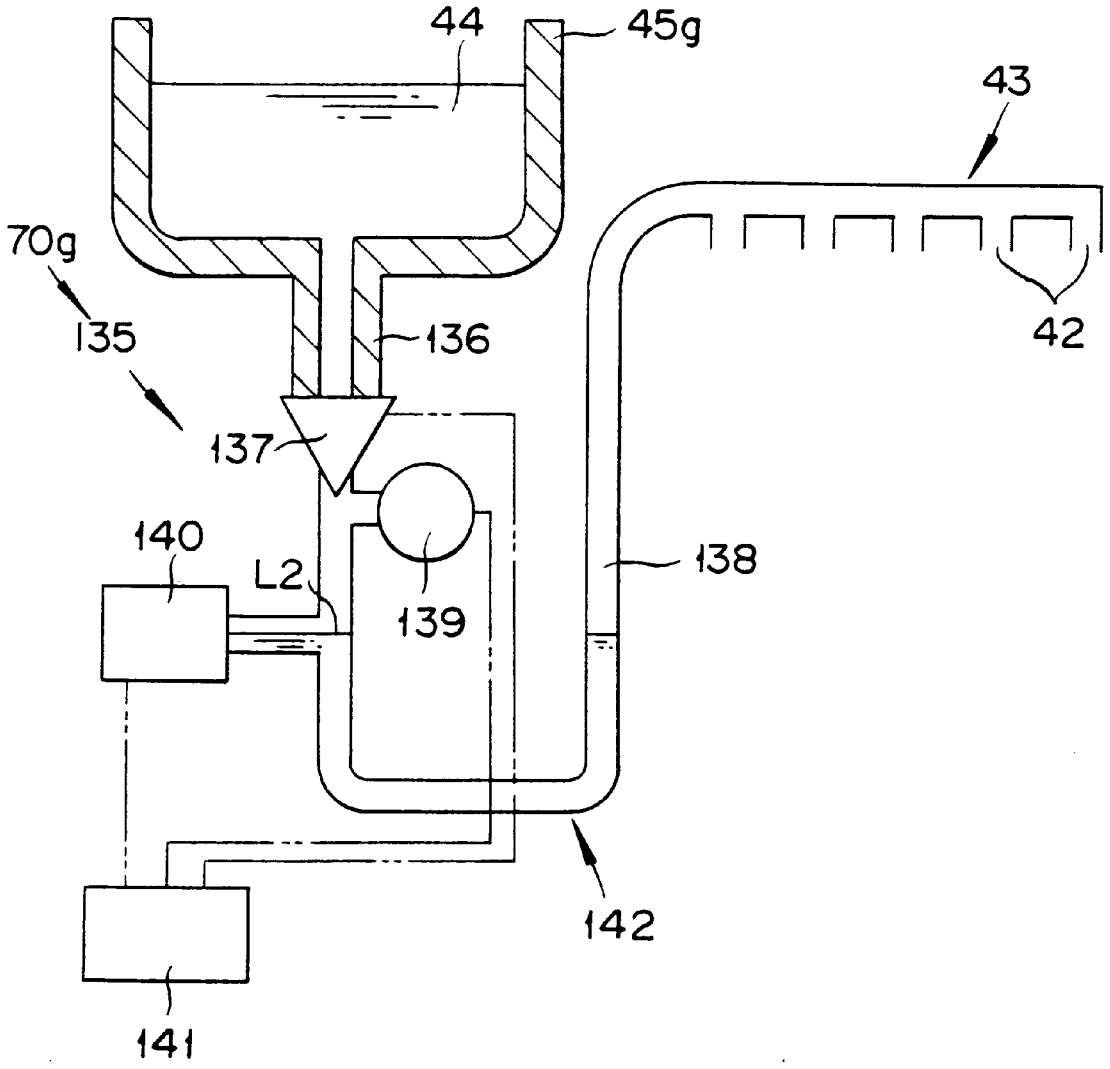

More specifically, as shown in FIG. 56, the oil supply system of the oil coating mechanism comprises an oil tank 45*g*, supply nozzle 43, an on-off valve 137 provided at an oil outlet port 136 formed at the bottom of oil tank 45*g*, a tube 138 which connects on-off valve 137 to supply nozzle 43, an air pump 139 which supplies air into tube 138 at the most upstream position of tube 138, an oil level sensor 140 (same as an oil level detector) provided in the middle of tube 138 to detect oil level L2 in tube 138 and a controller 141 to control on-off valve 137 and an air pump 139. On-off valve 137 functions as a valve member to control the transfer of oil 44 in oil tank 45*g* to tube 138. A portion of tube 138 forms a U-shaped holding part 142 that temporarily holds the oil. Air pump 139 supplies air to tube 138 to cause the oil contained in holding part 142 to be discharged from supply nozzle 43. Air pump 139 and on-off valve 137 constitute the pump unit.

Oil level sensor 140 can be a conventional infrared oil level sensor and the detection signal from oil level sensor 140 is entered into a controller 141 comprising a CPU which controls the fixing operation of the fixing apparatus. Controller 141 controls the operations of the on-off valve 137 and air pump 139 based on the detection signal from oil level sensor 140 as follows.

At a proper timing after air pump 139 caused the oil in tube 138 to be discharged from supply nozzle 43, controller 141 opens on-off valve 137. When on-off valve 137 opens, the oil in oil tank 45*g* flows down into tube 138 through an outlet port 136. When oil level sensor 140 detects oil level L2, controller 141 closes on-off valve 137. Consequently, a specified amount of oil accumulates in holding part 142 of tube 138 as shown in the drawing. When controller 141 determines that it is necessary to replenish the oil of oil supply roller 53 based on the number of revolutions of fixing roller 20, it supplies the air of a specified pressure into tube 138 by actuating air pump 139. The oil accumulated in holding part 142 of tube 138 is transferred toward supply nozzle 43 pushed by the supplied air and is discharged through discharge ports 42. 10 Air pump 139 stops after operating a specified time. The specified time is a time sufficient to discharge the oil accumulated in holding part 142 completely.

The pump unit constituted as described above is constituted in such a way as to push out the oil by means of the air supplied by air pump 139, it cannot be affected in any way by the air flowing in from supply nozzle 43, even if the latter reaches air pump 139.

Consequently, quantifying apparatus 70*g*, which is constituted not to be affected by the air flowing in from supply nozzle 43, is capable of transferring even a very small amount of oil intermittently in a stable manner by simply operating air pump 139 for a specified period of time, even if pump unit 135 is intermittently operated. Thus, the quantity of oil coated on fixing roller 20 using this quantifying apparatus remains constant, so that image noises such as offset, oil streaks and image luster unevenness can be prevented.

Figure 57:
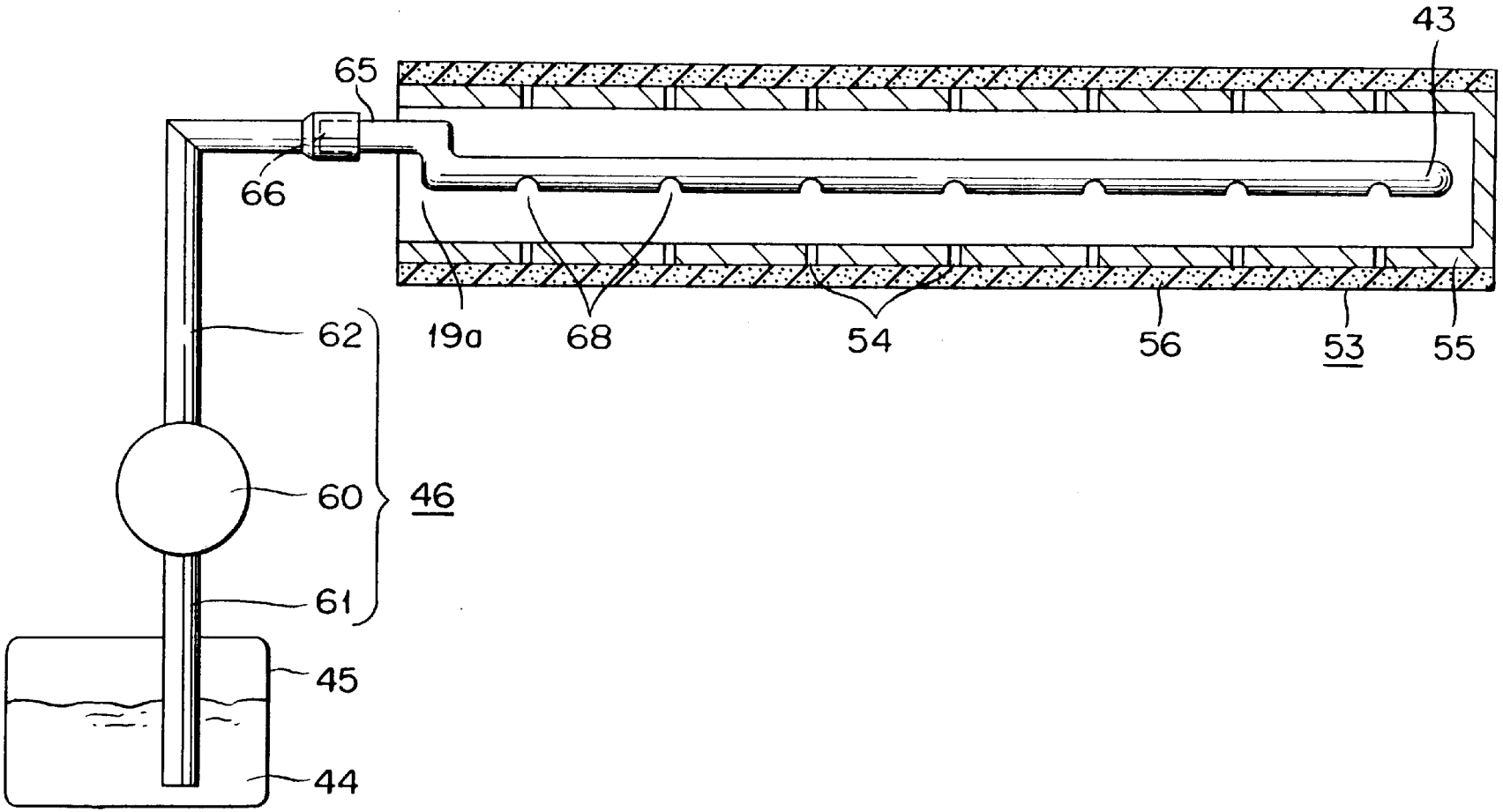
FIG. 57 is an outline schematic drawing showing a releasing agent leakage prevention member which prevents leakage flowing down along the outer surface of a supply nozzle of the sixth embodiment of this invention and its oil flow route.

FIG. 57 is an outline schematic drawing showing a releasing agent leakage prevention member that prevents leakage flowing down along the outer surface of a supply nozzle of the sixth embodiment of this invention and its oil flow route. The components that are similar to those used in fixing apparatus 200 of the aforementioned embodiment are identified with the same symbols and their descriptions are not repeated here.

As shown in FIG. 57, supply nozzle 43 of this sixth embodiment incorporates a cranking step 19*a* at the base of supply port 66 as a releasing agent leakage prevention member to prevent he releasing agent, after having been discharged from the discharge ports of the supply nozzle, from flowing down along the outer surface of the supply nozzle. This cranking step 19*a* is located within oil supply roller 53.

Figure 58:
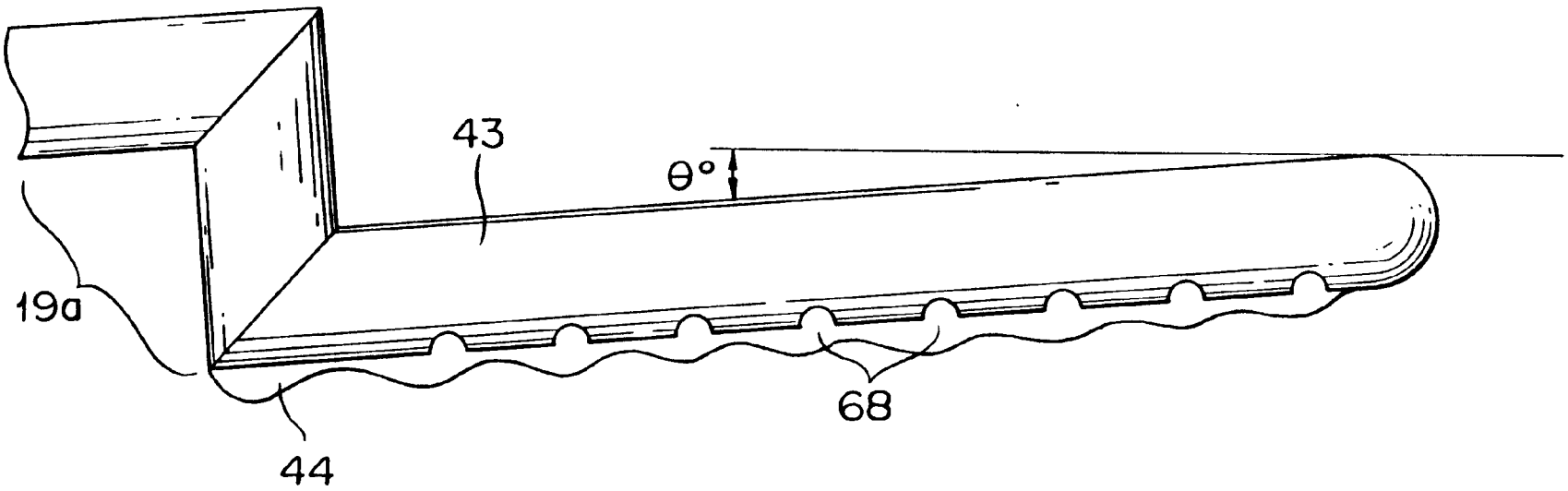
FIG. 58 is a drawing for describing the effect of a releasing agent leakage prevention member.

When oil 44 is discharged from discharge ports 68 provided on the surface of supply nozzle 43, oil 44 forms droplets to drop, even if the entire fixing apparatus, or supply nozzle 43, titles relative to the horizontal direction by 0° as shown in FIG. 58 for some reasons. However, the oil flows along the outer surface of supply nozzle 43 downwardly contrary to a case where the nozzle is horizontal.

The downward flow of oil 44 eventually reaches cranking step 19*a* and stops there as it cannot go any further. Since oil 44 cannot flow any further downward from this cranking step 19*a*, no oil leakage to the outside of the fixing apparatus occurs.

Thus, by having a releasing agent leakage prevention member, it is possible to prevent excessive oil from intruding into unspecified areas for from causing unexpected leakage.

Figure 59A:
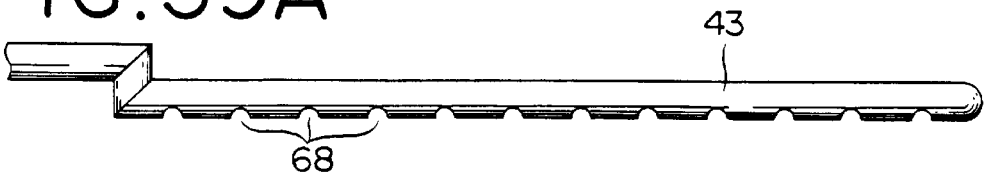
FIGS. 59A, 59B, 59C are outline schematic drawings showing other examples of the releasing agent leakage prevention member shown in FIG. 57.
Figure 59B:
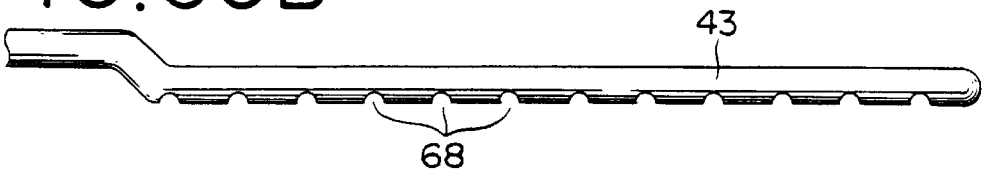
Figure 59C:
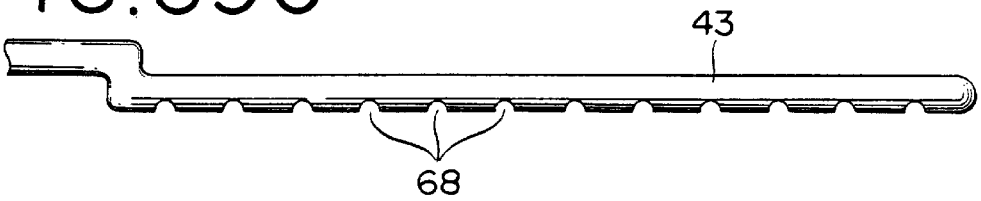

The angle of bend angle of this cranking step 19*a* does not have to be a right angle as shown in FIG. 59A, but can be other angles such as shown in FIG. 59B or a shape with rounded comers as shown in FIG. 59C to reduce the flow resistance.

Figure 60:
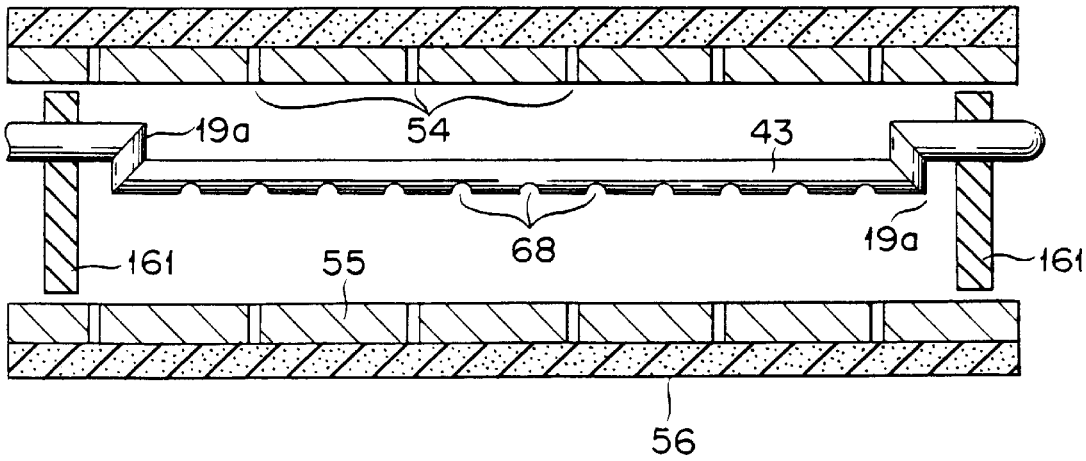
FIG. 60 is an outline schematic drawing showing still another example of the releasing agent leakage prevention member shown in FIG. 57.

An example shown in FIG. 60 has a cranking step 19*a* at the front end as well in addition to the one at the base of oil supply nozzle 43. By having a cranking step 19*a* at both ends of supply nozzle 43, the oil flow along the outside of supply nozzles 43 causing outside leakage can be prevented no matter which side of the drawing it tilts. This arrangement shown in FIG. 60 is particularly effective for a metal core 55 having open ends on both sides. By supporting both ends of supply nozzle 43 with a supporting member 161, it can be positioned in a preferable position of the inside of metal core 55.

Figure 61:
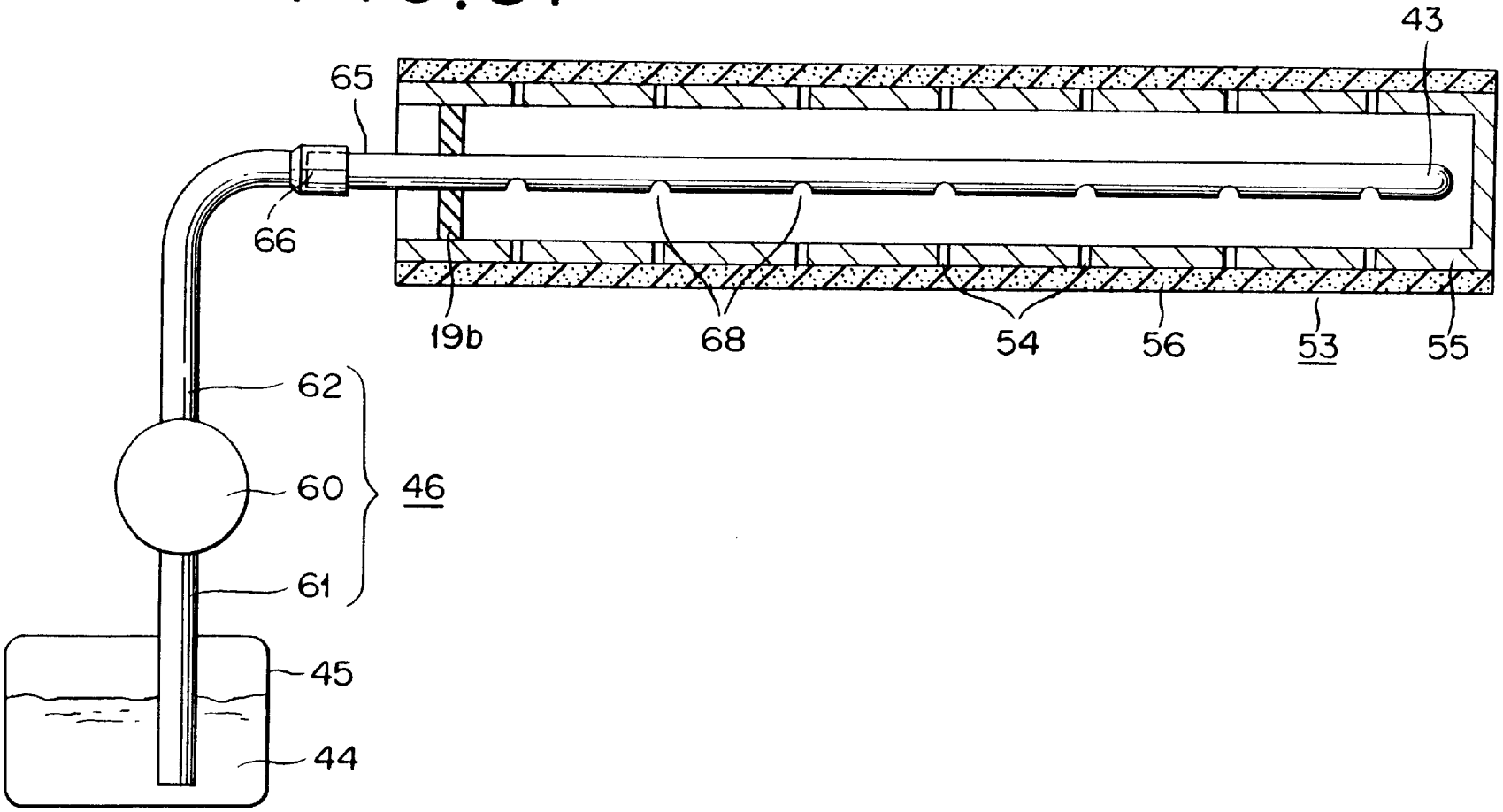
FIG. 61 is an outline schematic drawing showing still another example of the releasing agent leakage prevention member shown in FIG. 57.

FIG. 61 shows another example, of the releasing agent leakage prevention member to prevent the releasing agent, after having been discharged from the discharge ports of the supply nozzle, from flowing down along the outer surface of the supply nozzle. An oil drip prevention muffler 19*b*, another type of the releasing agent leakage prevention member, is provided at the base of supply nozzle 43 in this case. Of the oil 44 discharged from discharge holes 68 of supply nozzle 43, the portion of oil 44 which tends to leak outside by following the surface of supply nozzle 43 without becoming droplets can be effectively stopped by this muffler. Oil 44 that followed the outside of the nozzle up to the oil drip prevention muffler 19*b* is unable to cross muffler 19*b* and stops there. This prevents oil 44 from leaking outside of the fixing apparatus.

Figure 62:
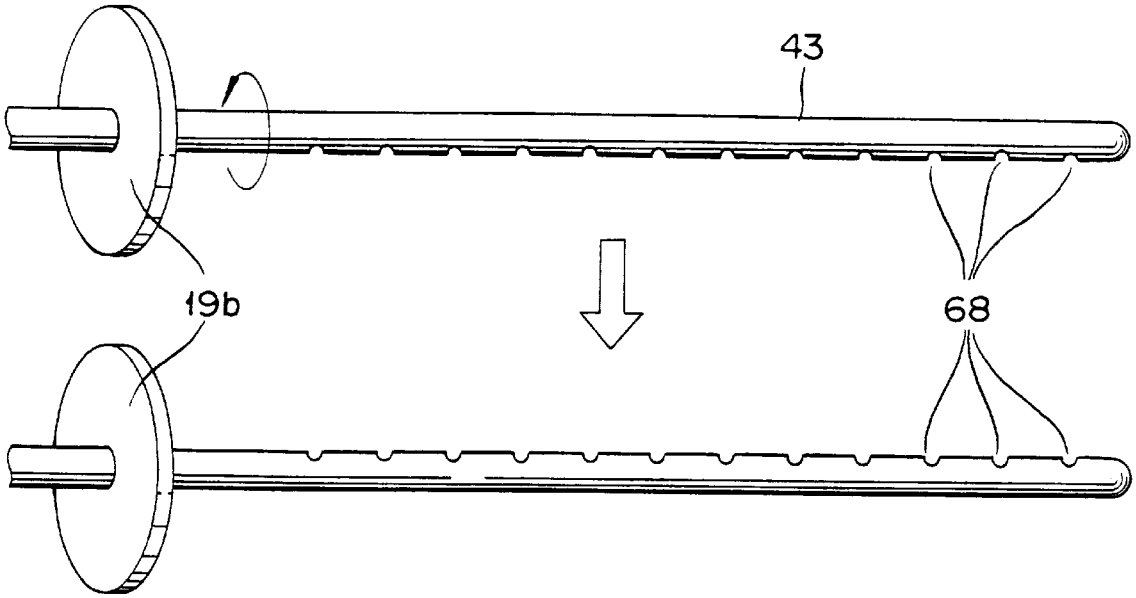
FIG. 62 is a drawing illustrating rotating motions of the releasing agent leakage prevention member shown in FIG. 61.

As shown in FIG. 62, it is possible to keep v discharge ports 68 upward when oil 44 is not to be discharged and downward only when the fixing apparatus is operating by having a reversing mechanism (not shown) on supply nozzle 43. This can effectively prevent oil 44 remaining in supply nozzle 43 causing excessive supply and leaking when the fixing apparatus is not operating, to provide a more preferable oil leakage prevention member in combination with oil dripping prevention muffler 19*b*.

Examples of cranking step 19*a* and oil drip prevention muffler 19*b* were described above as the embodiments of the releasing agent leakage prevention member intended to prevent the leakage of the releasing agent, which is discharged through the discharge ports of the supply nozzle and flows along the outside surface of the supply nozzle. These embodiments however, are, not only applicable as oil leakage prevention members to the cases wherein supply nozzle 43 is provided inside core 55, but also in the cases wherein supply nozzle 43 is provided outside of core 55.

Figure 63:
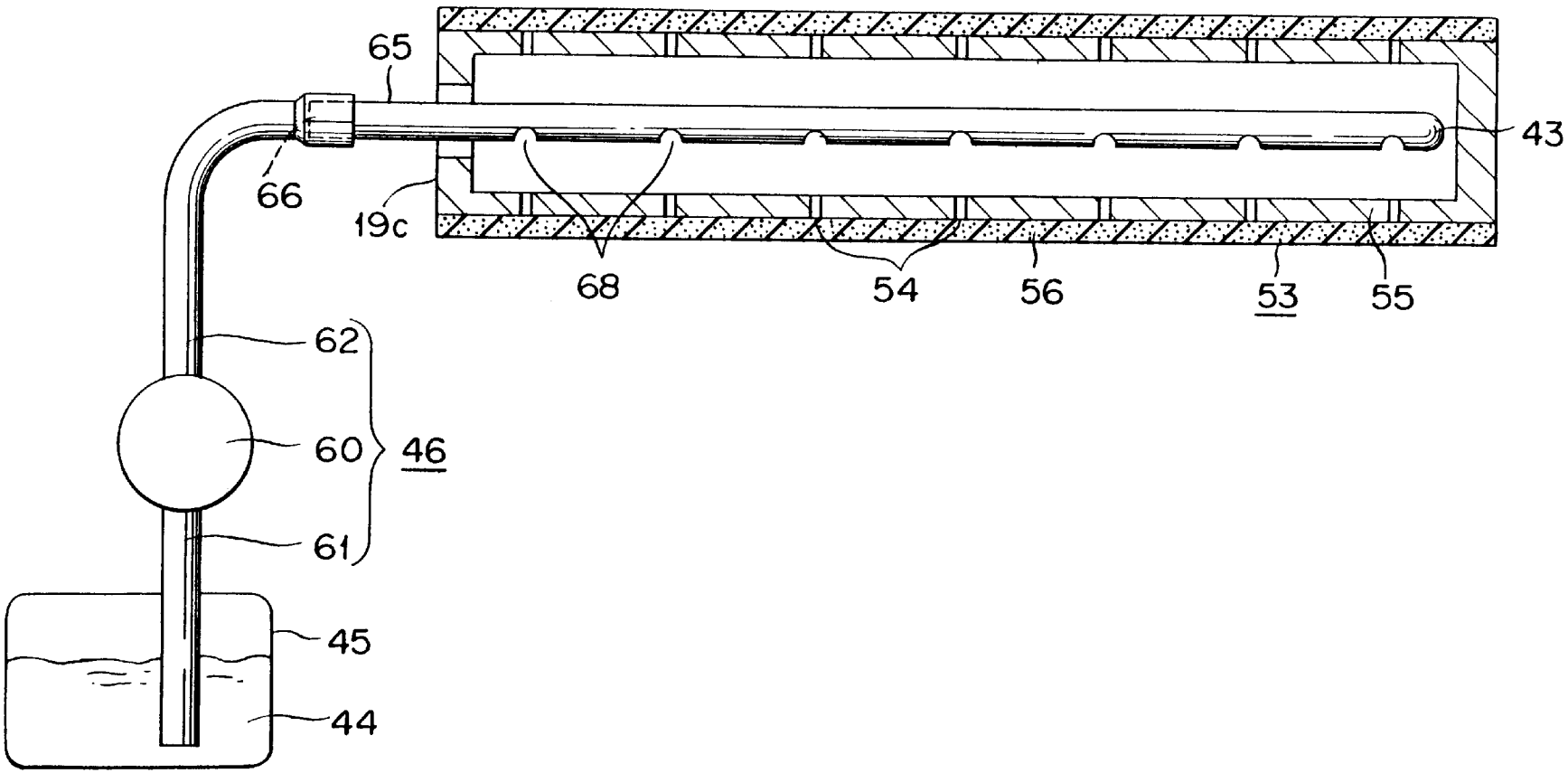
FIG. 63 is an outline schematic drawing showing a releasing agent leakage prevention member which prevents leakage flowing down along the inner surface of a metal core and oil flow route.
Figure 65A:
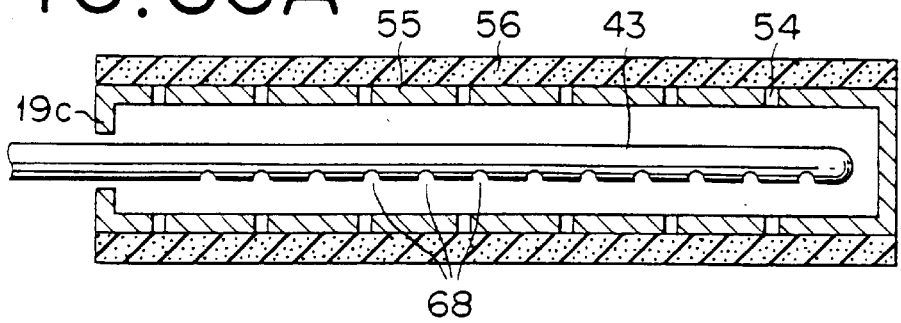
FIGS. 65A through 65D are diagrams illustrating other combination application examples of releasing agent leakage prevention members.

The releasing agent leakage prevention members shown in FIG. 63 and FIG. 65A are the releasing agent leakage prevention members which prevent the releasing agent which flows down along the inner surface of the core member after having been discharged from the supply nozzle.

The difference between those releasing agent leakage prevention members and the aforementioned cranking step 19*a* and oil dripping muffler 19*b* is that they are equipped with an oil leakage prevention hilt 19*c* on the oil supply roller 53 side as a releasing agent leakage prevention member.

Oil leakage prevention hilt 19*c* prevents oil 44 from leaking outside the edge of the inner circumference. Oil 44 that reaches this oil leakage prevention hilt 19*c* stops there and does not leak out of oil supply roller 53.

Figure 64:
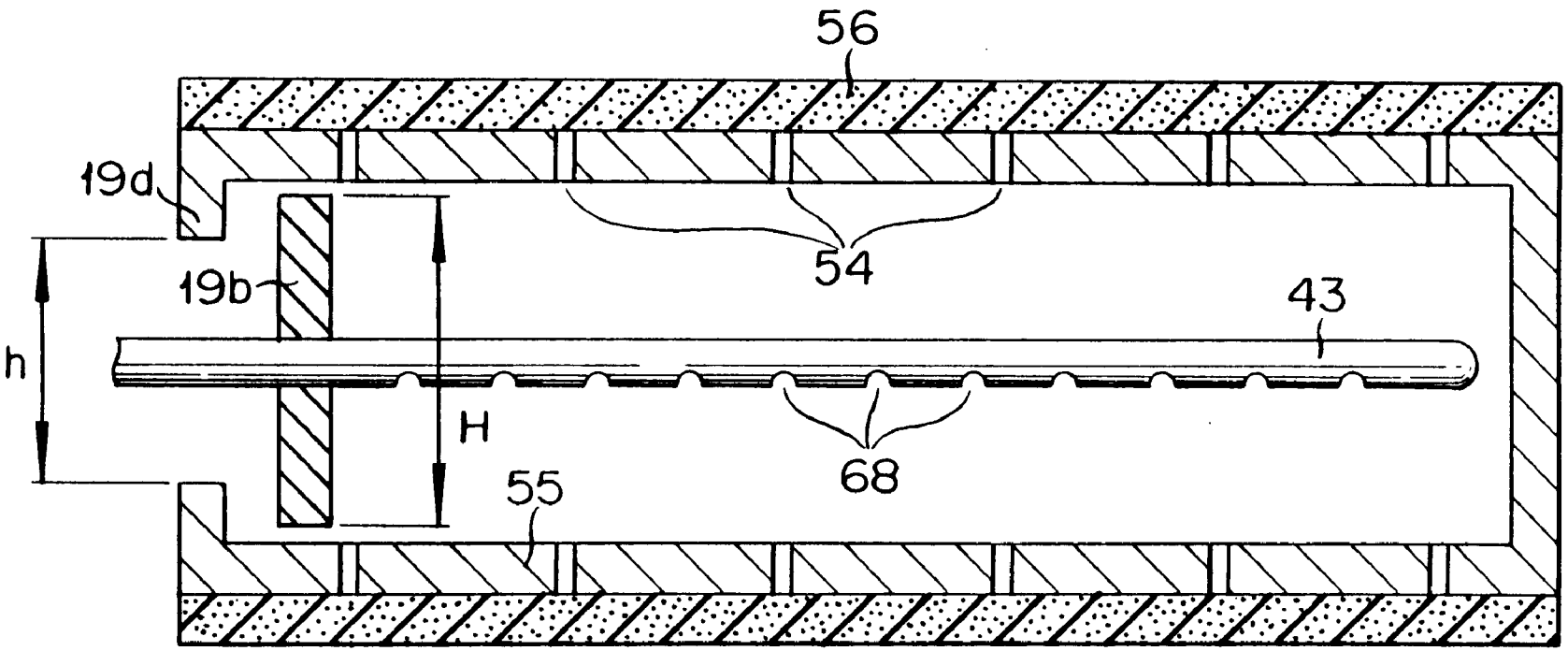
FIG. 64 is a diagram illustrating a combination application example of releasing agent leakage prevention members.

Shown in FIG. 64 is a case wherein metal core 55 equipped with an oil leakage prevention hilt 19*c* at one end is combined with an oil dripping prevention muffler 19 b. The diameter of the opening of metal core 55 is indicated as "h", while the diameter of oil drip prevention muffler 19*b* is indicated as "H." In order to constitute such a structure, an oil dripping prevention muffler 19*b* has to be installed internal to metal core 55. Due to the relation H>h, it is possible to install oil drip prevention muffler 19*b* internal to metal core 55 by passing through the opening "h" by means of using an elastic material for oil dripping prevention muffler 19*b*.

Oil dripping prevention muffler 19*b* stops oil 44 which has followed the surface of supply nozzle 43 and effectively encourages the formation of droplets there. When the droplets grow to a certain size, they will drip to oil supply roller 53 and effectively coat fixing roller 20. Oil drip prevention muffler 19*b* can have a certain clearance from the inner surface of metal core 55, or can have a contact with it to get a similar effect. When they are contacting, there are no growth of droplets oil 44, but rather the oil is supplied continuously to oil supply roller 53.

Figure 65B:
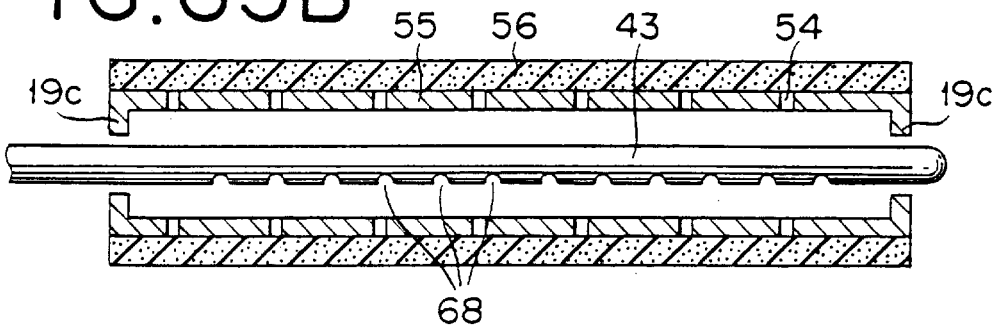
Figure 65C:
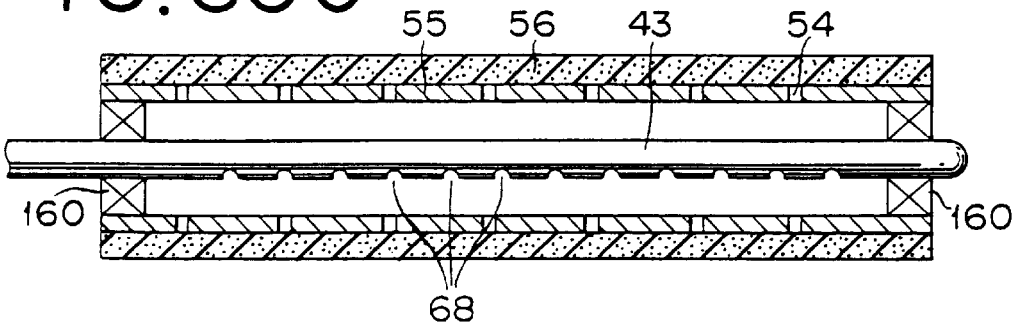

FIG. 65B shows a case wherein metal core 55 has open ends on both sides and oil leakage prevention hilts 19*c* are provided on both open ends to prevent oil 44 from flowing out As a means of seeking a similar effect as oil leakage prevention hilt 19*c*, it is also possible to use a bearing 160 in place of oil leakage prevention hilt 19*c* as shown in FIG. 65C. Supply nozzle 43 serves also as a rotating shaft of oil supply roller 53 in this case. Supply nozzle 43 is inserted into the inner ring of bearing 160, while the outer ring is fitted to the internal diameter of metal core 55. The inner ring and the outer ring together provide the same effect as oil leakage prevention hilt 19*c*.

Figure 65D:
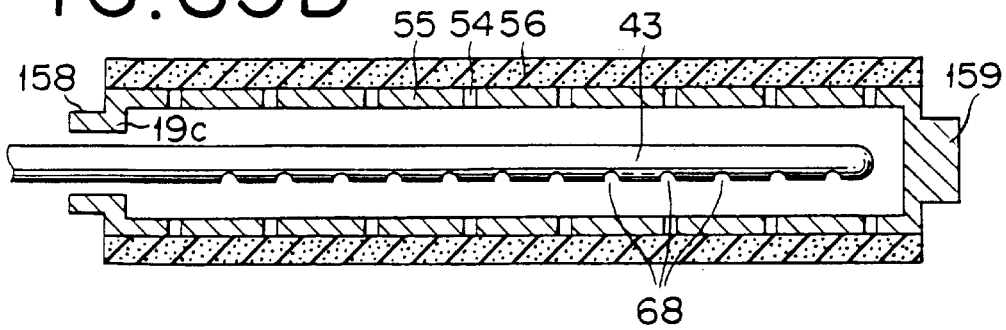

FIG. 65D shows an alternative to oil leakage prevention hilt 19*c* shown in FIG. 63. An oil drip prevention sleeve 158 is provided continuously at the edge of oil leakage prevention hilt 19*c* to stop oil 44 which flows along the internal circumference of metal core 55 toward the open end. Oil 44 which leaks from the end of oil impregnation material 56 is also stopped from proceeding when it reaches the outer surface of oil leakage prevention sleeve 158. A rotating shaft 159 is provided at the end of metal core 55 and serves as the rotating shaft for oil supply roller 53 when it rotates.

Figure 66:
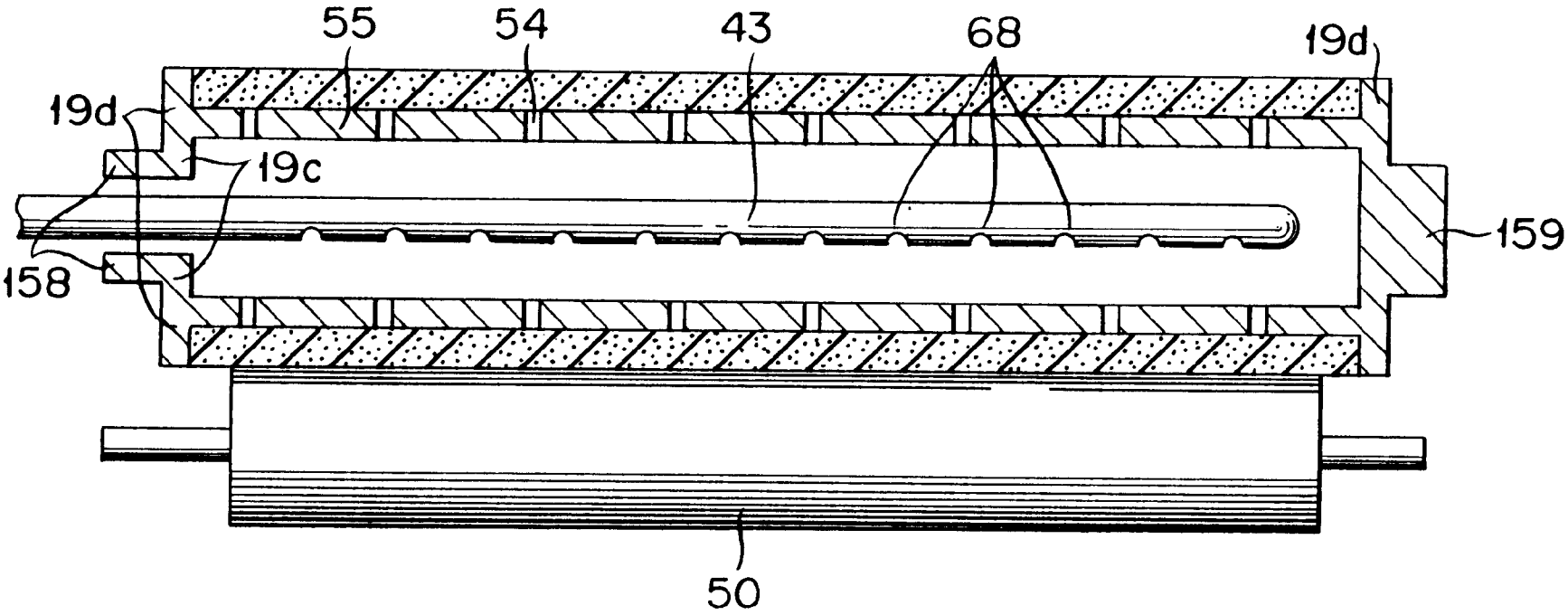
FIG. 66 is an outline schematic drawing showing a releasing agent leakage prevention member which prevents leakage flowing down along the outer surface of a roller and oil flow route.

FIG. 66 shows an embodiment of the releasing agent leakage prevention member that prevents the leakage of the releasing agent after having been discharged from the discharge ports of the supply nozzle from leaking at the end as it flows along the outside of the coating apparatus.

The releasing agent leakage prevention member comprises an oil leakage prevention hilt 19*d,* which is similar to oil leakage hilt 19*c* shown in FIG. 63, provided on the outside end of oil leakage prevention hilt 19*c*. By doing so, the leakage of oil 44 from the outer circumference of metal core 55 and oil impregnation material 56 can be effectively prevented. Furthermore, the axial length of oil impregnation material 56 covering this oil supply roller 53 is chosen to be longer than the axial length of oil supply roller 50. Because of this dimensional relation, oil 44 can be coated on the surface of oil coating roller 50.

The above is a description of oil leakage prevention hilt 19*c*, which is an embodiment of the releasing agent leakage prevention member intended to prevent the leakage of the releasing agent from the end of the holding member in the lengthwise direction after having been discharged from the discharging ports and flowing along the periphery of the coating apparatus. However, these embodiments can be applied a soil leakage prevention members not only to cases wherein supply nozzle 43 is installed within metal core 55 but also to cases wherein it is installed outside of supply roller 53.

Figure 67A:
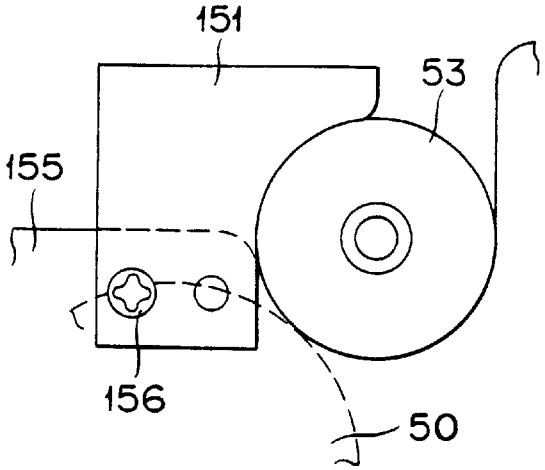
FIGS. 67A through 67C are outline schematic drawings showing structures to make oil supply rollers equipped with a releasing agent leakage prevention member detachable.
Figure 67B:
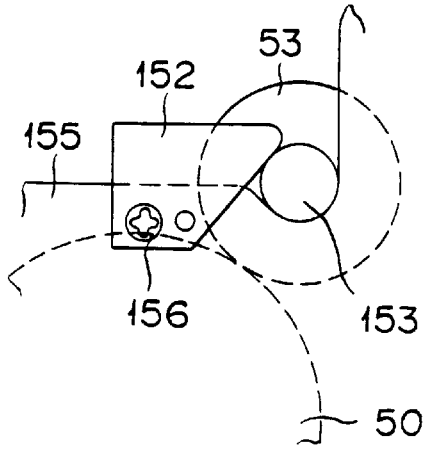
Figure 67C:
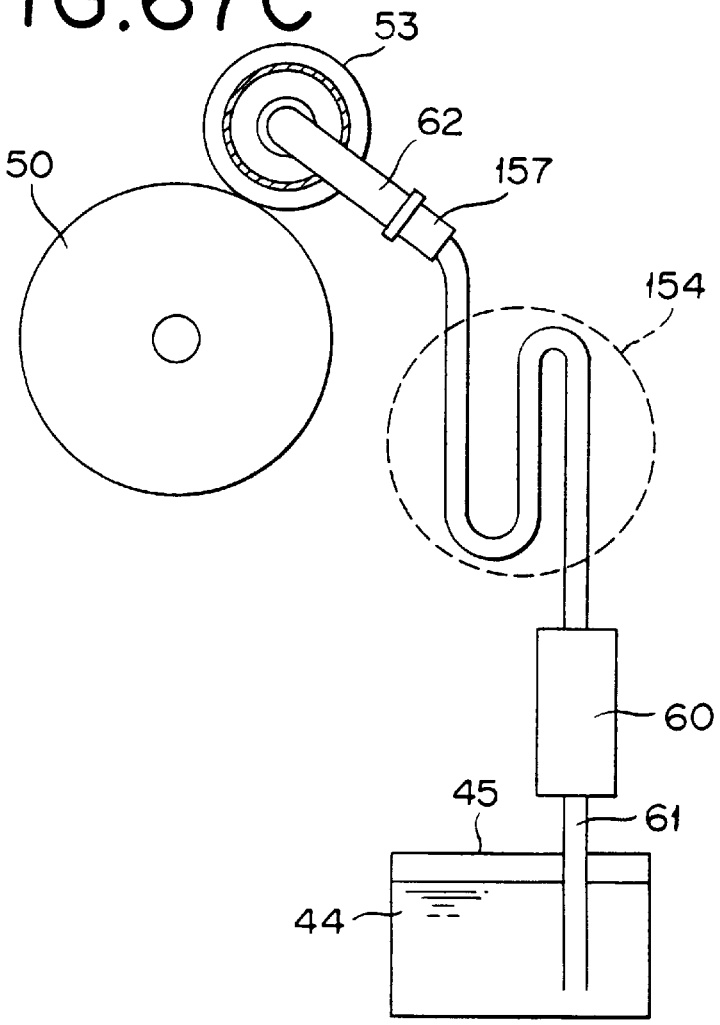

FIGS. 67A through 67C show rotating shaft structures of oil supply roller 53 of the fixing apparatus according to this invention. These structures improve the workability in case of replacing oil supply roller 53.

FIG. 67A shows a case where the periphery of oil supply roller 53 is intended to be used a s a rotating shaft, wherein it is positioned on a main body frame 155 by means of a plate 151 and driven by oil coating roller 50 to supply oil 44. Oil supply roller 53 can be removed by simply removing a fastening screw 156, which is fastening plate 151.

FIG. 67B also shows a design wherein a plate 152 positions a rotary shaft 153 by pressing it down and oil supply roller 53 can be removed by removing fastening screw 156.

FIG. 67C shows a constitution intended to make oil supply roller 53 replacement work easier, in particular, showing how each tube should be laid out. Tube 62 is connected to a variable part 154 by means of a tube joint 157. This variable part 154 is pulled out together when oil supply roller 53 is pulled out from the main unit of the fixing apparatus. After they are pulled out to an area where there is an enough space to work, tube 62 is cut off from variable part 154 at joint 157. The separation can be done also between oil supply roller 53 and tube 62 instead of at tube joint 157. Such a constitution makes the releasing agent leakage prevention member according to this invention more useful and effective.

The aforementioned embodiments can be modified arbitrarily. For example, various leakage prevention members, such as cranking step 19*a*, oil dripping prevention muffler 19*b* and oil leakage prevention hilt 19*c* need not necessarily be used independently, but rather can be used in combination to enhance the effects.

Figure 68:
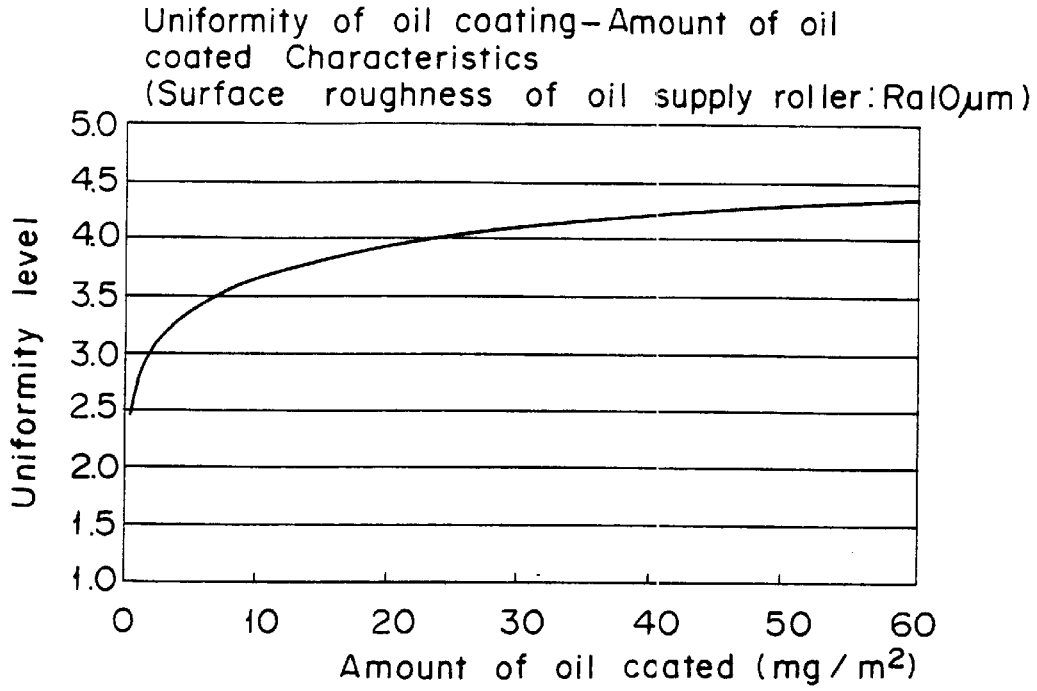
FIG. 68 is a drawing showing the relations between oil coating uniformity and surface roughness with respect to the description of the seventh embodiment of this invention.
Figure 69:
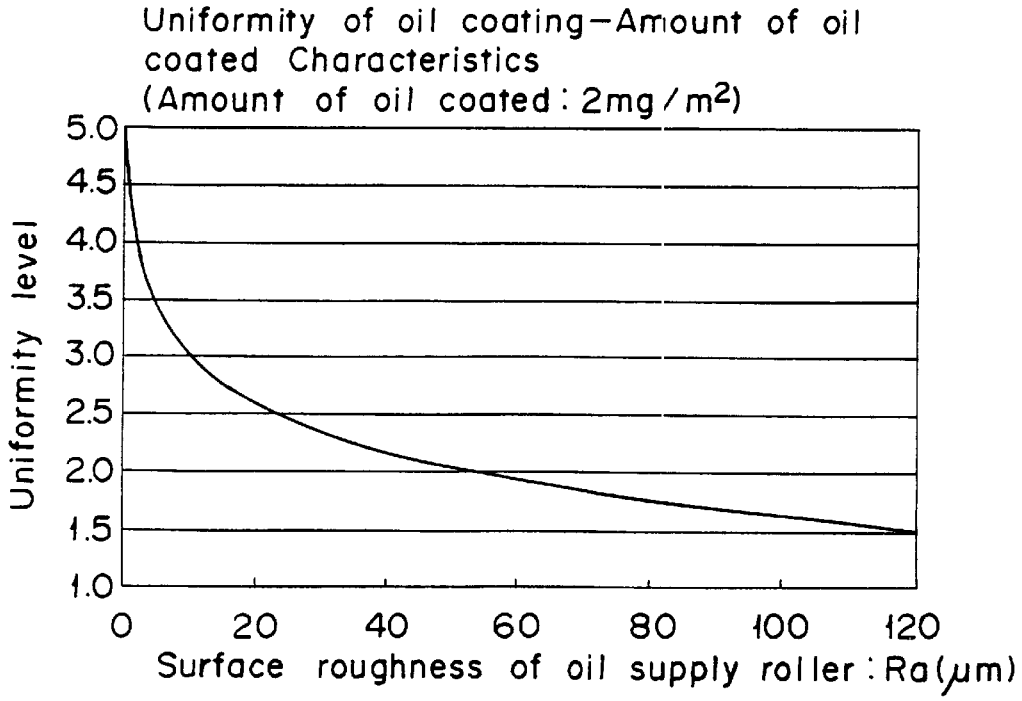
FIG. 69 is a drawing showing the relations between oil coating uniformity and surface roughness of the oil supply roller used in the description of the seventh embodiment of this invention.

FIG. 68 is a drawing to show the relation between oil coating uniformity and surface roughness with respect to the description of the seventh embodiment of this invention, and FIG. 69 is a drawing to show the relation between oil coating uniformity and surface roughness of the oil supply roller used in the description of the seventh embodiment of this invention. The components that are similar to those used in fixing apparatus 200 of the aforementioned embodiment are identified with the same symbols and their descriptions are not repeated here.

Although oil collecting blade 57 abuts on oil coating roller 50 intended to remove the oil which failed to be coated on fixing roller 20, the collection blade 57's function is not to equalize the oil on oil coating roller 50 but to scrape the oil that was not coated on fixing roller 20 and was left on oil coating roller 50.

The seventh embodiment is constituted to set the amount of oil to be coated on fixing roller 20 by oil supply roller 53 based on the centerline average roughness of the surface of oil supply roller 53 so that the evenly discharged oil is finally coated on the fixing roller evenly even if the coating amount is very small.

More specifically, assuming the centerline average roughness of oil supply roller 53 is Ra (m) and the coating amount of the releasing agent to be supplied on fixing roller 20 by oil supply roller 53 is M ($mg/m^2$), it is set within the following range:

$$0 \leqq -0.6 \times 1n(Ra) + 0.4 \times 1n(M) \leqq 3 \quad (6)$$

or, more preferably, $$1 \leqq -0.6 \times 1n(Ra) + 0.4 \times 1n(M) \leqq 2 \quad (7)$$

The above formulas (6) and (7) were determined empirically, wherein the lower limit was determined, as explained later in more detail, from the standpoint of securing an even oil coating on fixing roller 20 to prevent offset phenomena and image luster unevenness. On the other hand, the upper limit was determined from the standpoint of preventing sheet smearing or fixing capability drop or production cost increase or production feasibility problem due to excessive use of oil.

Figure 70:
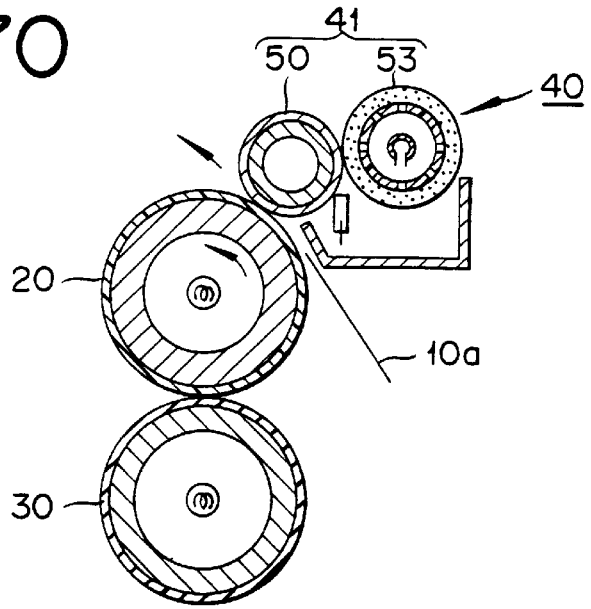
FIG. 70 is a drawing describing an evaluation method of oil coating uniformity.

The evenness of coating shown in FIG. 68 and FIG. 69 were evaluated using the following method. First, as shown in FIG. 70, an oil detection sheet 10*a* is fed between fixing roller 20 and coating apparatus 41 to coat oil detection sheet 10*a* with the oil. The oil coated on oil detection sheet 10*a* is then visualized (brightness conversion), i.e., the amount of oil coated on oil detection sheet 10*a* is converted to the brightness.

Figure 71:
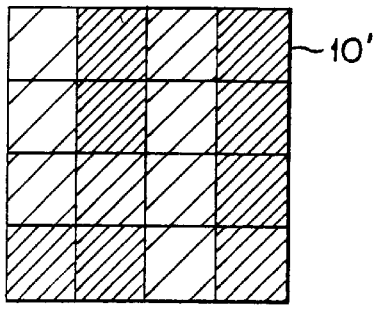
FIG. 71 is a diagram showing oil coverage converted into luminance.
Figure 72:
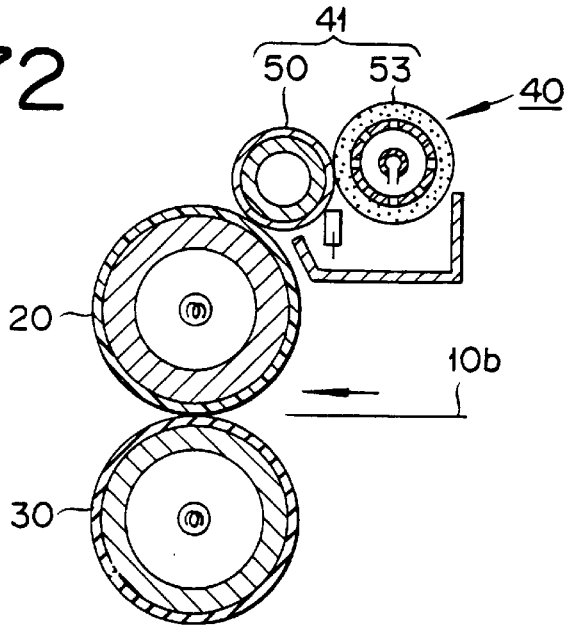
FIG. 72 is a drawing for describing the measurement of oil coverage.

As schematically shown in FIG. 71, the fluctuation of the brightness was evaluated and graded with the scale of 1 to 6, level 1 being the largest fluctuation and level 6 being the smallest fluctuation. If the result of an experiment is lower than level 3, it has uncoated areas and is likely to cause offset phenomena. If it is less than level 4, strong coating unevenness exists and image luster unevenness happens. On the other hand, if it is higher than level 5, it means that the coating amount is too much, which results in image noises such as oil stains (oil streaks), high oil consumption, which in turn results in high running cost. It also results in a higher production cost as the surface roughness has to be reduced. If it is over level 6, excessive amount of coated oil causes poor fixing capability, which in turn becomes extremely small, and it becomes impossible to produce under a normal process. Practically speaking, it is extremely difficult to crease a surface roughness lower than Ra 0.1 $\mu$m.

The amount of oil coated is measured by, for example, feeding an overhead projector (OHP) sheet 10*b* between fixing roller 20 and pressuring roller 30 as shown in FIG. 27 and measuring the amount of oil transferred (mg/m$^2$) to OHP sheet 10*b*. This enables us to measure the amount of oil coated on fixing roller 20 indirectly. The OHP sheet used for this purpose is normally a polyester film.

On the other hand, the surface roughness of oil supply roller 53, i.e., the surface roughness of oil impregnation material 56 can be measured by a surface roughness measuring instrument.

Oil impregnation material 56 of oil supply roller 53 is made of a porous material such as sponge, paper, felt and silicon rubber. Reduction of the surface roughness of oil impregnation material 56 can be achieved by using a grinding wheel of a finer grit size if impregnation material 56 is made of rubber (both solid and sponge), or making the surface roughness of the inner surface of the mold or reducing the filler particle size if it is to be formed by a molding process. If oil impregnation material 56 is a sheet (of paper, felt, etc.) to be wrapped around the core, a finer surface roughness can be achieved on the surface of oil impregnation member 56 by using a higher density and smaller fiber diameters.

As can be seen from FIG. 68, the higher the oil coating amount on the fixing roller, the higher the oil coating uniformity. However, a higher coating amount often results in soiling of the sheet by the oil, a higher running cost and offset phenomena or other problems due to a poor fixing capability. As can also be seen from FIG. 69, the finer the surface roughness of the oil supply roller surface, the higher the oil coating uniformity. However, as it was mentioned before, the finer the surface roughness is intended, the more production troubles and the higher the production costs.

Thus, in reference to the uniformity of oil coating, the oil coating amount and the surface roughness of the oil supply roller can be pointed out as the factors that cause the fluctuation of oil coating.

Figure 73:
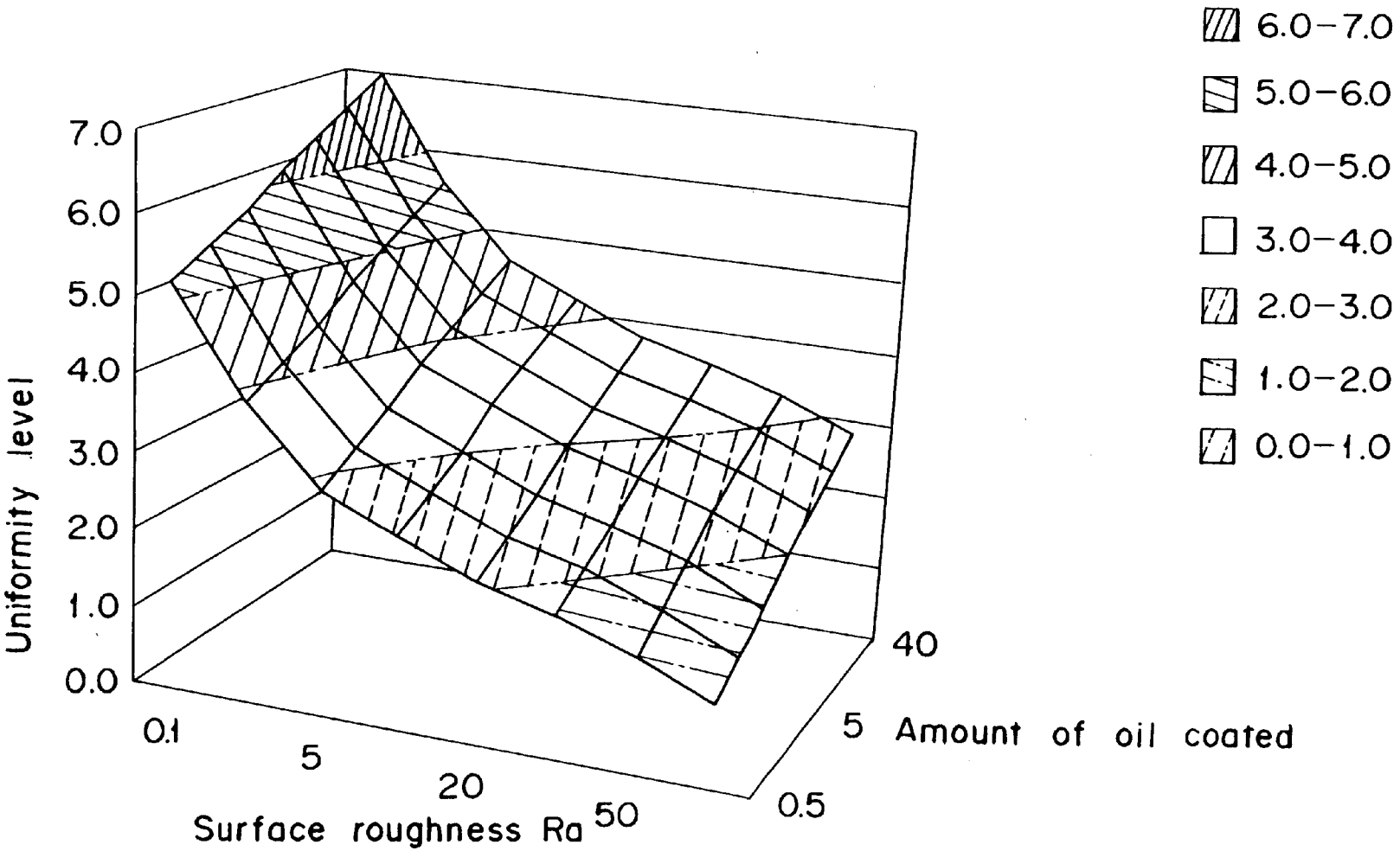
FIG. 73 is a drawing showing the relations between oil coverage in terms of surface roughness and oil coating uniformity.

FIG. 73 is a drawing to show the relation between oil coverage in terms of surface roughness and oil coating uniformity. It is a comprehensive chart combining the relations shown in FIG. 68 and FIG. 69 under various conditions, where the uniformity of oil coating is indicated by a three-dimensional surface. The vertical axis represents the degree of uniformity and the meaning of its value is as explained before.

The relation indicated graphically in FIG. 73 between the uniformity level Y, the centerline average roughness Ra (mm) of the surface of oil supply roller 53, and the oil coating amount M (mg/m$^2$) can be expressed by a formula as follows:

$$Y=-0.6\cdot 1n(Ra)+0.4\cdot 1n(M)$$

The uniformity level Y should be 3 to 6, or preferably 4 to 5 as mentioned before. As a result, it was concluded that a desired oil coating uniformity can be efficiently obtained by selecting the amount of oil to be coated on fixing roller 20 by oil supply roller 53 to satisfy formulas (6) or (7) depending on the centerline average roughness on the surface of oil supply roller 53.

In other words, it is possible to achieve a satisfactory uniformity of oil coating, even if the oil coating amount is very small, without using a blade for oil coating uniformity, by selecting the centerline average roughness of oil supply roller 53 and the amount of oil coated on fixing roller 20 supplied by oil supply roller 53 to satisfy the formula (6). This makes it possible to realize a uniform coating on the fixing roller with a stable coating amount for a long period of time providing an excellent releasing capability and reducing the possibility of odd particles attaching to its surface. This in turn effective prevents the occurrence of offset phenomena caused by toner transfer to the fixing roller and hence provides a better image quality.

It also enables us to eliminate the possibility of a tolerable level of image luster unevenness which occurs in the vicinity of the lower limit of formula (6) and a tolerable level of oil soiling of sheet which occurs in the vicinity of the upper limit of formula (6) by selecting the centerline average roughness of oil supply roller 53 and the amount of oil coated on fixing roller 20 supplied by oil supply 53 to satisfy formula (7).

Figure 74:
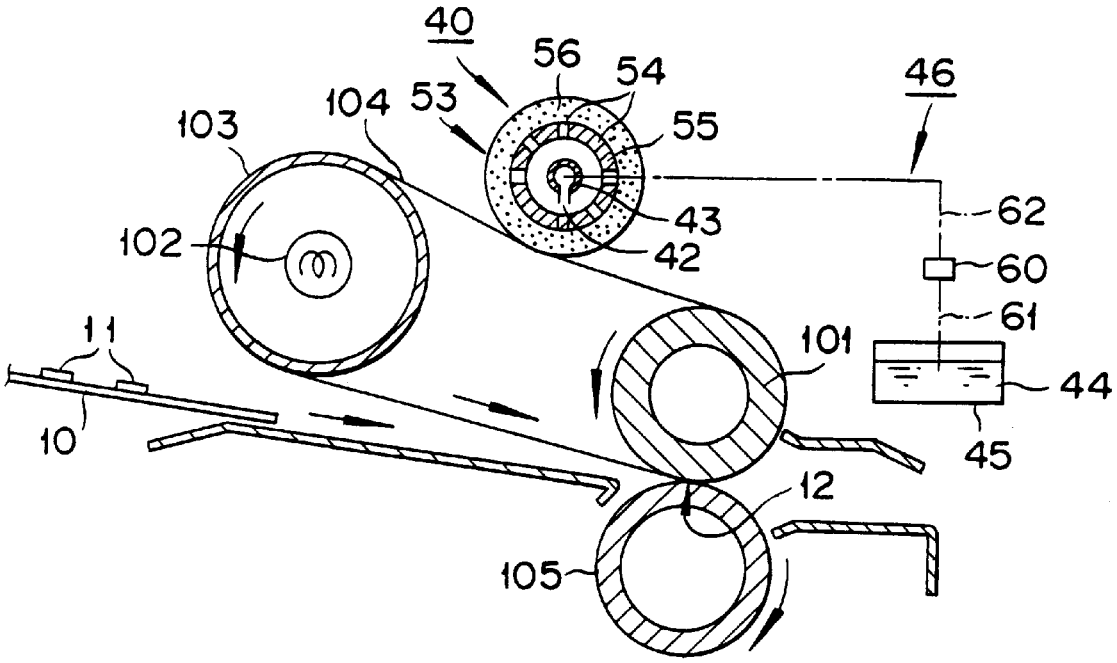
FIG. 74 is an outline schematic showing a rotating member used for toner fixing.

Although a roller has been as a rotating member to coat the toner in the descriptions of the aforementioned embodiments, the invention does not limit itself to the use of a roller but rather allows itself to use a belt-like member such as the one shown in FIG. 74. The items shown in FIG. 74 include a drive roller 101, a halogen heater lamp 102, a heater roller 103, a fixing belt 104 and a pressuring roller 105.

It is obvious that this invention is not limited to the particular embodiments shown and described above but may be variously changed and modified without departing from the technical concept of this invention. Further, the entire disclosure of Japanese Patent application Nos. 09-255751 filed on Sep. 19, 1997, 09-255752 filed on Sep. 19, 1997, 09-255753 filed on Sep. 19, 1997, 09-257059 filed on Sep. 22, 1997, 09-260748 filed on Sep. 26, 1997, 09-274644 filed on Oct. 7, 1997 and 09-280691 filed on Oct. 14, 1997, including the specification, claims, drawings and summary are incorporated herein by reference in its entirety.

What is claimed is:

1. A fixing apparatus comprising:

a first rotating member and a second rotating member arranged to oppose each other to fix unfixed toner images held on sheets of recording media;

a coating apparatus that coats at least one of said first and second rotating members with a releasing agent, said coating apparatus being equipped with a releasing agent holding roller, which has a releasing agent holding layer on its outer surface; and a transfer apparatus that supplies the releasing agent to the releasing agent holding layer so that the releasing agent is not saturating the releasing agent holding layer all the time, wherein content of the releasing agent in said releasing agent holding layer is 20–80 volumetric percent.

2. A fixing apparatus of claim 1 wherein said coating apparatus is equipped with a releasing agent coating roller, which has a releasing agent coating layer on the periphery and is placed to contact with said rotating member and said releasing agent holding roller.

3. A fixing apparatus of claim 1 wherein said releasing agent holding roller is equipped with a hollow metal core, through which the releasing agent supplied to its inside by the transfer apparatus seeps out, and a releasing agent holding layer provided on the surface thereof.

4. A fixing apparatus of claim 1 wherein content of the releasing agent in said releasing agent holding layer is 40–60 volumetric percent.

5. A fixing apparatus comprising:

a first rotating member and a second rotating member arranged to oppose each other to fix unfixed toner images held on sheets of recording media;

a coating apparatus that is arranged along the axial direction of at least one of said first and second rotating members and coats said rotating member with a releasing agent, said coating apparatus comprising a rotating roller that supplies the releasing agent to said rotating member, said roller comprising a hollow metal core on which multiple through holes are provided and a releasing agent holding layer that covers the outer surface of the metal core;

a transfer apparatus that supplies the releasing agent to the coating apparatus, said transfer apparatus comprising a supply nozzle that is arranged along the lengthwise direction of the coating apparatus and is fixedly arranged within the hollow metal core, said supply nozzle comprising multiple discharge ports to supply the releasing agent to the coating apparatus; and a controller that controls the supply of the releasing agent from the transfer apparatus to the coating apparatus.

6. A fixing apparatus of claim 5 wherein said coating apparatus is equipped with a releasing agent holding member, which has a releasing agent holding layer, and a releasing agent coating roller, which has a releasing agent coating layer on the periphery.

7. A fixing apparatus of claim 6 wherein said releasing agent holding member is a releasing agent holding roller, which has a releasing agent holding layer on the periphery.

8. A fixing apparatus of claim 7 wherein an amount of supply of the releasing agent and/or a timing of supply of the releasing agent are controlled based on information of a number of revolutions of the releasing agent holding roller incorporated in said coating apparatus.

9. A fixing apparatus of claim 7 wherein an amount of supply of the releasing agent and/or a timing of supply of the releasing agent are controlled based on information of weight of the releasing agent holding roller incorporated in said coating apparatus.

10. A fixing apparatus of claim 5 wherein said controller controls an amount of supply of the releasing agent and/or a timing of supply of the releasing agent based on information of a number of sheets passed through said rotating members.

11. A fixing apparatus of claim 5 wherein said controller controls an amount of supply of the releasing agent and/or a timing of supply of the releasing agent based on information of a number of revolutions of said rotating members.

12. A fixing apparatus of claim 5 wherein said controller controls an amount of supply of the releasing agent and/or a timing of supply of the releasing agent based on information of mode of paper feed.

13. A fixing apparatus of claim 5 wherein said controller controls an amount of supply of the releasing agent and/or a timing of supply of the releasing agent based on information of sheet size.

14. A fixing apparatus comprising:

a first and a second rotating members arranged to oppose each other to fix unfixed toner images held on sheets of recording media;

a coating apparatus that coats at least one of said two rotating members with a releasing agent;

a transfer apparatus that supplies the releasing agent to the coating apparatus;

a controller that controls the supply of the releasing agent from the transfer apparatus to the coating apparatus; and a forcing switch that forces the supply of the releasing agent from the transfer apparatus to the coating apparatus.

15. A fixing apparatus of claim 14 wherein said controller resets a counter for determining supply control of the releasing agent when said forcing switch is operated.

16. A fixing apparatus comprising:

a first and a second rotating members arranged to oppose each other to fix unfixed toner images held on sheets of recording media;

a coating apparatus that coats at least one of said two rotating members with a releasing agent;

a transfer apparatus that supplies the releasing agent to the coating apparatus; and a controller that controls the supply of the releasing agent from the transfer apparatus to the coating apparatus, said controller resetting a counter that determines the supply control of the releasing agent when said coating apparatus is replaced.

17. A fixing apparatus comprising:

a first rotating member and a second rotating member arranged to oppose each other to fix unfixed toner images held on sheets of recording media;

a coating apparatus that coats at least one of said first and second rotating members with a releasing agent;

a transfer apparatus that supplies the releasing agent to the coating apparatus; and a controller that controls the supply of the releasing agent from the transfer apparatus to the coating apparatus, said controller stopping the image forming operation when a specified amount of releasing agent cannot be supplied during a predetermined releasing agent supply period.

18. A fixing apparatus comprising:

a first rotating member and a second rotating member arranged to oppose each other to fix unfixed toner images held on sheets of recording media;

a coating apparatus that is arranged along the axial direction of at least one of said [two] first and second rotating members and coats said rotating member with a releasing agent, said coating apparatus comprising a rotating roller that supplies the releasing agent to said rotating member, said roller comprising a hollow metal core on which multiple through holes are provided and a releasing agent holding layer that covers the outer surface of the metal core; and a supply nozzle that is arranged along the lengthwise direction of the coating apparatus and is fixedly arranged within the hollow metal core, said supply nozzle comprising multiple discharge ports to supply the releasing agent to said coating apparatus and droplet growth assisting members to help droplets of the releasing agent released from each discharge port to drop beneath each discharge port so that the releasing agent is discharged as discrete points.

19. A fixing apparatus of claim 18 wherein each of said droplet growth assisting members is a protrusive member placed in the vicinity of each discharge port.

20. A fixing apparatus of claim 18 wherein each of said droplet growth assisting members is a protrusive member, which is provided with a discharge port at the tip thereof.

21. A fixing apparatus of claim 18 wherein each of said droplet growth assisting members is a retrusive member placed in the vicinity of each discharge port.

22. A fixing apparatus of claim 18 wherein each of said droplet growth assisting members is a retrusive member, which is provided with a discharge port.

23. A fixing apparatus comprising:

a first and a second rotating members arranged to oppose each other to fix unfixed toner images held on sheets of recording media;

a coating apparatus that is arranged along the axial direction of at least one of said two rotating members and coats said rotation member with a releasing agent; and a supply nozzle that is arranged along the lengthwise direction of the coating apparatus, said supply nozzle comprising multiple discharge ports having approximately equal opening cross section areas to supply the releasing agent to said coating apparatus and an equalizing member that equalizes the amount of the releasing agent discharged from each discharge port.

24. A fixing apparatus of claim 23 wherein a length L (mm) between two discharge ports located at both ends of the supply nozzle and an opening cross-sectional area Sn ($mm^2$) satisfy the following formula (1):

$$10 \leq L \cdot Sn \leq 180 \quad (1).$$

25. A fixing apparatus comprising:

a first and a second rotating members arranged to oppose each other to fix unfixed toner images held on sheets of recording media;

a coating apparatus that coats at least one of said two rotating members with a releasing agent, said coating apparatus comprises a roller that supplies the releasing agent to said rotating member, said roller comprising a metal core, on which multiple through holes are provided, and a releasing agent holding layer that covers the outer surface of the metal core, wherein the roller outer diameter D1, the metal core outer diameter D2, and the distance P between adjacent through holes holding a relation: $0.6<D1\cdot(D1-D2)/(D2\cdot P)<6$; and a transfer apparatus that supplies the releasing agent inside said roller.

26. A fixing apparatus of claim 25 wherein said D1, D2 and P satisfy a relation, $1.2<D1\cdot(D1-D2)/(D2\cdot P)<4$.

27. A fixing apparatus comprising:

a first and a second rotating members arranged to oppose each other to fix unfixed toner images held on sheets of recording media;

a coating apparatus that coats at least one of said two rotating members with a releasing agent, said coating apparatus comprises a roller that supplies the releasing agent to said rotating member, said roller comprising a metal core, on which multiple through holes are provided, and a releasing agent holding layer that covers the outer surface of the metal core, wherein kinematic viscosity S (cSt) of said releasing agent at 25° C. and the bore D3 (mm) of said through holes satisfy a relation: $0.05<D3/(1n\ (S))<0.5$; and a transfer apparatus that supplies the releasing agent inside said roller.

28. A fixing apparatus of claim 27 wherein said S and D3 satisfy a relation, $0.1<D3/(1n(S))<0.3$.

29. A fixing apparatus comprising:

a first and a second rotating members arranged to oppose each other to fix unfixed toner images held on sheets of recording media;

a coating apparatus that coats at least one of said two rotating members with a releasing agent, said coating apparatus comprises a roller that supplies the releasing agent to said rotating member, said roller comprising a metal core, on which multiple through holes are provided, and a releasing agent holding layer that covers the outer surface of the metal core, wherein the peripheral dimension of each through hole is longer than the axial dimension of the same hole; and a transfer apparatus that supplies the releasing agent inside said roller.

30. A fixing apparatus comprising:

a first rotating member and a second rotating member arranged to oppose each other to fix unfixed toner images held on sheets of recording media;

a coating apparatus that coats at least one of said two rotating members with a releasing agent;

a tank unit that stores a releasing agent;

a releasing agent supply apparatus that supplies the releasing agent stored in the tank unit, wherein said releasing agent supply apparatus comprises a transfer passage for transferring the releasing agent stored in the tank and a pump unit for transferring the releasing agent intermittently by switching operating and stopping modes; and a quantifying apparatus that meters the releasing agent amount being transferred to be constant so as to provide a stable transfer of the releasing agent even as the releasing agent is intermittently transferred by the pump unit.

31. A fixing apparatus comprising of claim 30 wherein said quantifying apparatus comprises an oil level holding member for holding a level of the releasing agent in said transfer passage to a specified height while the pump unit is stopped.

32. A fixing apparatus comprising of claim 30 wherein said quantifying apparatus comprises an oil level detection member for detecting a level of the releasing agent in said transfer passage and a controller for stopping the pump unit during a pump operation when the oil level is found to be at a specified height by the oil level detection member.

33. A fixing apparatus comprising of claim 30 wherein said pump unit is essentially immersed in the releasing agent in the tank unit.

34. A fixing apparatus comprising of claim 30 wherein said pump unit comprises a on-off valve member that guides the releasing agent contained in said tank unit into the transfer passage and an air pump that supplies air into the transfer passage and transfers the releasing agent with this air, and said quantifying apparatus comprises an oil level detection means for detecting a level of the releasing agent inside the transfer passage and a controller for operating the air pump after having accumulated the releasing agent in the transfer passage by opening said valve member until the oil level detection means detects a releasing agent level.

35. A fixing apparatus comprising:

a first rotating member and a second rotating member arranged to oppose each other to fix unfixed toner images held on sheets of recording media;

a coating apparatus that is arranged along the axial direction of at least one of said first and second rotating members and coats said rotating member with a releasing agent, said coating apparatus comprising a rotating roller that supplies the releasing agent to said rotating member, said roller comprising a hollow metal core on which multiple through holes are provided and a releasing agent holding layer that covers the outer surface of the metal core;

a supply nozzle that is arranged along the lengthwise direction of the coating apparatus and is fixedly arranged within the hollow metal core, said supply nozzle comprising multiple discharge ports to supply the releasing agent to said coating apparatus; and a releasing agent leak prevention member that prevents the leakage that flows down along the outer surface of the supply nozzle when the releasing agent is discharged from the discharge ports.

36. A fixing apparatus comprising:

a first and a second rotating members arranged to oppose each other to fix unfixed toner images held on sheets of recording media;

a coating apparatus that coats at least one of said two rotating members with a releasing agent, said coating apparatus comprises a roller that supplies the releasing agent to said rotating member, said roller comprising a hollow metal core and a releasing agent holding layer that covers the outer surface of the metal core;

a supply nozzle that is arranged along the lengthwise direction of the coating apparatus, said supply nozzle comprising multiple discharge ports to supply the releasing agent to said coating apparatus; and a releasing agent leak prevention member that prevents the leakage that flows down along the inner surface of the metal core when the releasing agent is discharged from the discharge ports.

37. A fixing apparatus comprising:

a first rotating member and a second rotating member arranged to oppose each other to fix unfixed toner images held on sheets of recording media;

a coating apparatus that is arranged along the axial direction of at least one of said first and second rotating members and coats said rotating member with a releasing agent, said coating apparatus comprises a rotating roller that supplies the releasing agent to said rotating member, said roller comprising a hollow metal core, on which multiple through holes are provided, and a releasing agent holding layer that covers the outer surface of the metal core;

a supply nozzle that is arranged along the lengthwise direction of the coating apparatus and is fixedly arranged within the hollow metal core, said supply nozzle comprising multiple discharge ports to supply the releasing agent to said coating apparatus; and a releasing agent leak prevention member that prevents the leakage that flows down along the outer surface of the roller.

38. A fixing apparatus comprising:

a first and a second rotating members arranged to oppose each other to fix unfixed toner images held on sheets of recording media; and a coating apparatus that coats at least one of said two rotating members with a releasing agent, said coating apparatus comprises a roller that supplies the releasing agent to said rotating member, wherein the centerline mean roughness of said roller's surface and the amount of releasing agent supplied from the roller to the rotating member has a specified relation.

39. A fixing apparatus of claim 38 wherein said centerline mean roughness Ra ($\mu$m) and the oil coating amount M ($mg/m^2$) satisfies the following formula:

$$0 \leqq -0.6 \cdot 1n(Ra) + 0.4 \cdot 1n(M) \leqq 3.$$

40. A fixing apparatus of claim 39 wherein said centerline mean roughness Ra ($\mu$m) and the oil coating amount M ($mg/m^2$) satisfies the following formula:

$$1 \leqq -0.6 \cdot 1n(Ra) + 0.4 \cdot 1n(M) \leqq 2.$$

* * * * *